US006770433B2

(12) United States Patent
Hioki

(10) Patent No.: US 6,770,433 B2
(45) Date of Patent: Aug. 3, 2004

(54) SILVER HALIDE PHOTOGRAPHIC LIGHT-SENSITIVE MATERIAL

(75) Inventor: Takanori Hioki, Minami Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 50 days.

(21) Appl. No.: 10/042,261

(22) Filed: Jan. 11, 2002

(65) Prior Publication Data

US 2003/0068591 A1 Apr. 10, 2003

(30) Foreign Application Priority Data

Jan. 12, 2001 (JP) ..... P.2001-005321

(51) Int. Cl.[7] ..... G03C 1/005; G03C 1/494

(52) U.S. Cl. ..... 430/572; 430/574; 430/577; 430/578; 430/581; 430/582; 430/583; 430/584; 430/585; 430/586; 430/587; 430/588; 430/589; 430/590; 430/567

(58) Field of Search ..... 430/572, 574, 430/577, 578, 581–590, 567

(56) References Cited

U.S. PATENT DOCUMENTS

| | | | | |
|---|---|---|---|---|
| 5,288,738 A | | 2/1994 | Vishwakarma et al. | |
| 6,143,486 A | * | 11/2000 | Parton et al. | 430/574 |
| 6,165,703 A | * | 12/2000 | Parton et al. | 430/572 |
| 6,312,883 B1 | * | 11/2001 | Parton et al. | 430/574 |
| 6,331,385 B1 | * | 12/2001 | Deaton et al. | 430/572 |
| 6,558,893 B1 | * | 5/2003 | Parton et al. | 430/574 |
| 6,582,894 B1 | * | 6/2003 | Hioki et al. | 430/572 |

FOREIGN PATENT DOCUMENTS

EP 0 887 700 A1 12/1998

* cited by examiner

*Primary Examiner*—Geraldine Letscher
(74) *Attorney, Agent, or Firm*—Birch, Stewart, Kolasch & Birch, LLP

(57) ABSTRACT

A high-sensitive silver halide photographic light-sensitive material is provided. A silver halide photographic light-sensitive material comprising a dye having a plurality of dye chromophores, which contains at least one dye where at least one of the dye chromophores is a methine dye chromophore containing a basic nucleus comprising a monocyclic heterocyclic ring.

20 Claims, No Drawings

SILVER HALIDE PHOTOGRAPHIC LIGHT-SENSITIVE MATERIAL

FIELD OF THE INVENTION

The present invention relates to a high-sensitive silver halide photographic light-sensitive material containing a specific sensitizing dye.

BACKGROUND OF THE INVENTION

A great deal of effort has heretofore been made for attaining higher sensitivity of silver halide photographic light-sensitive materials. In a silver halide photographic emulsion, a sensitizing dye adsorbed to the surface of a silver halide grain absorbs light entered into a light-sensitive material and transmits the light energy, to the silver halide grain, whereby light sensitivity can be obtained. Accordingly, in the spectral sensitization of silver halide, it is considered that the light energy transmitted to silver halide can be increased by increasing the light absorption factor per the unit grain surface area of a silver halide grain and thereby the spectral sensitivity can be elevated. The light absorption factor on the surface of a silver halide grain may be improved by increasing the amount of a spectral sensitizing dye adsorbed per the unit grain surface area.

However, the amount of a sensitizing dye adsorbed to the surface of a silver halide grain is limited and the dye chromophore cannot be adsorbed in excess of the single layer saturation adsorption (namely, one layer adsorption). Therefore, individual silver halide grains currently have a low absorption factor in terms of the quantum of ;incident light in the spectral sensitization region.

To solve these problems, the following methods have been proposed.

In *Photographic Science and Engineering*, Vol. 20, No. 3, page 97 (1976), P. B. Gilman, Jr. et al. disclose a technique where a cationic dye is adsorbed to the first layer and an anionic dye is adsorbed to the second layer using the electrostatic force.

In U.S. Pat. No. 3,622,316, G. B. Bird et al. disclose a technique where a plurality of dyes are adsorbed in multiple layers to silver halide and the Forster-type excitation energy transfer is allowed to contribute to the sensitization.

In JP-A-63-138341 (the term "JP-A" as used herein means an "unexamined published Japanese patent publication") and JP-A-64-84244, Sugimoto et al. disclose a technique of performing the spectral sensitization using the energy transfer from a light-emitting dye.

In *Photographic Science and Engineering*, Vol. 27, No. 2, page 59 (1983), R. Steiger et al. disclose a technique of performing the spectral sensitization using the energy transfer from a gelatin-substituted cyanine dye.

In JP-A-61-251842, Ikegawa et al. disclose a technique of performing the spectral sensitization using the energy transfer from a cyclodextrin-substituted dye.

With respect to the so-called linked dye having two separate chromophores which are not conjugated but linked through a covalent bond, examples thereof are described in U.S. Pat. Nos. 2,393,351, 2,425,772, 2,518,732, 2,521,944 and 2,592,196 and European Patent 565,083. However, these are not used for the purpose of improving the light absorption factor. In U.S. Pat. Nos. 3,622,317 and 3,976,493 having an object of improving the light absorption factor, G. B. Bird, A. L. Borror et al. disclose a technique where a linked sensitizing dye molecule having a plurality of cyanine chromophores is adsorbed to increase the light absorption factor and the energy transfer is allowed to contribute to the sensitization. In JP-A-64-91134, Ukai, Okazaki and Sugimoto disclose a technique of bonding at least one substantially non-adsorptive cyanine, merocyanine or hemicyanine dye containing at least two sulfo and/or carboxyl groups to a spectral sensitizing dye which can adsorb to silver halide.

In JP-A-6-57235, L. C. Vishwakarma discloses a method of synthesizing a linked dye by a dehydrating condensation reaction of two dyes. Furthermore, in JP-A-6-27578, it is disclosed that the linked dye of monomethinecyanine and pentamethineoxonol has red sensitivity. However, in this case, the light emission of oxonol and the absorption of cyanine are not overlapped and the spectral sensitization using the Forster-type excitation energy transfer between dyes does not occur, failing in attaining higher sensitization owing to the light-gathering action of linked oxonols.

In European Patent Publication 887700Al, R. L. Parton et al. disclose a linked dye having a specific linking group.

Furthermore, in EP-A-0985964, EP-A-0985965, EP-A-0985967 and EP-A-0985966, Richard Parton et al. disclose a technique where a combination of a cationic dye. and an anionic dye is adsorbed in multiple layers with an attempt to attain high sensitivity using the energy transfer from the dye in the second or upper layer to the dye in the first layer.

In these methods, however, the degree of adsorption of sensitizing dyes in multiple layers on the surface of a silver halide grain is actually insufficient and neither the light absorption factor per the unit grain surface area of silver halide grain nor the sensitivity can be sufficiently highly increased. A technique capable of realizing practically effective multilayer adsorption is

SUMMARY OF THE INVENTION

The object of the present invention is to provide a high-sensitive silver halide photographic light-sensitive material.

As a result of extensive investigations, it has been found that the above-described object can be attained by the following matters (1) to (18).

(1) A silver halide photographic light-sensitive material comprising at least one dye compound having a plurality of dye chromophores, provided that at least one of said dye chromophores is a methine dye chromophore containing a basic nucleus comprising a monocyclic heterocyclic ring.

(2) The silver halide photographic light-sensitive material as described in (1), wherein the dye compound is a compound represented by the following formula (I):

$$(D_1)_{r2}(La-[D_2]_{q1})_{r1}\ M_1m_1 \qquad \text{(I)}$$

wherein $D_1$ and $D_2$ each represents a dye chromophore, provided that at least one of $D_1$ and $D_2$ is a methane dye chromophore containing a basic nucleus comprising a monocyclic heterocyclic ring, La represents a linking group or a single bond, $q_1$, $r_1$ and $r_2$ each represents an: integer of 1 to 100, $M_1$ represents an electric charge balancing counter ion and $m_1$ represents a number necessary for neutralizing the electric charge of molecule.

(3) The silver halide photographic light-sensitive material as described in (1) or (2), wherein the methine dye chromophore containing a basic nucleus comprising a monocyclic heterocyclic ring is represented by the following formula (AI):

(AI)

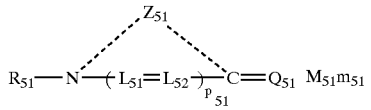

wherein $Z_{51}$ represents an atomic group necessary for forming a monocyclic nitrogen-containing heterocyclic ring, provided that this ring is not condensed by an aromatic ring, $R_{51}$ represents a hydrogen atom, an alkyl group, an aryl group or a heterocyclic group, $Q_{51}$ represents a group necessary for the formation of a methine dye by the compound represented by formula (AI), $L_{51}$ and $L_{52}$ represents a methine group, $p_{51}$ represents 0 or 1, $M_{51}$ represents an electric charge balancing counter ion, and $m_{51}$ represents a number necessary for neutralizing the electric charge of the molecule.

(4) The silver halide photographic light-sensitive material as described in any one of (1) to (3), wherein the compound represented by formula (AI) of (3) is selected from the compounds represented by the following formula (AII):

(AII)

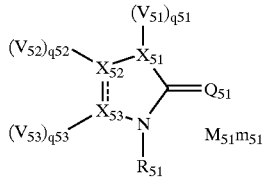

wherein $X_{51}$, $X_{52}$ and $X_{53}$ each represents an oxygen atom, a sulfur atom, a selenium atom, a nitrogen atom or a carbon atom, $V_{51}$, $V_{52}$ and $V_{53}$ each represents a hydrogen atom or a substituent, provided that $V_{51}$, $V_{52}$ and $V_{53}$ are not combined with each other to form an aromatic ring, $q_{51}$, $q_{52}$ and $q_{53}$ each represents 0, 1 or 2, and $Q_{51}$, $R_{51}$, $M_{51}$ and $m_{51}$have the same meanings as in formula (AI), provided that the bond between $X_{52}$ and $X_{53}$ may be a single bond or a double bond.

(5) The silver halide photographic light-sensitive material as described in any one of (1) to (4), wherein the dye chromophore containing a basic nucleus comprising a monocyclic heterocyclic ring has at least one acid radical.

(6) The silver halide photographic light-sensitive material as described in any one of (1) to (5), wherein the basic nucleus comprising a monocyclic heterocyclic ring has at least one acid radical.

(7) The silver halide photographic light-sensitive material as described in any one of (1) to (6), wherein a dye chromophore of the dye compound described in any one of (1) to (6) is adsorbed to the surface of a silver halide grain to form multiple layers.

(8) The silver halide photographic light-sensitive material as described in (7), wherein the dye chromophore containing a basic nucleus comprising a monocyclic heterocyclic ring is present in the second or upper layer.

(9) The silver halide photographic light-sensitive material as described in any one of (1) to (8), which contains silver halide grains having a light absorption intensity of 60 or more at the spectral absorption maximum wavelength of less than 500 nm or a light absorption intensity of 100 or more at the spectral absorption maximum wavelength of 500 nm or more

(10) The silver halide photographic light-sensitive material as described in any one of (1) to (9),; wherein assuming that the maximum value of spectral absorption factor of the silver halide grain by a sensitizing dye is Amax, the distance between the shortest wavelength: showing 50% of Amax and the longest wavelength showing 50%. of Amax is 120 nm or less.

(11) The silver halide photographic light-sensitive material as described in any one of (1) to (10), wherein assuming that the maximum value of spectral sensitivity of the silver halide grain by a sensitizing dye is Smax, the distance between the shortest wavelength showing 50% of Smax and the longest wavelength showing 50% of Smax is 120 nm or less.

(12) The silver halide photographic light-sensitive material as described in any one of (1) to (11), wherein assuming that the maximum value of the spectral absorption factor of the silver halide grain by the dye chromophore in the first layer is A1max, the maximum value of the spectral absorption factor by the dye chromophore in the second or upper layer is A2max, the maximum value of the spectral sensitivity of the silver halide grain by the dye chromophore in the first layer is S1max and the maximum value of the spectral sensitivity by the dye chromophore in the second or upper layer is S2max, each of A1max and A2max or each of S1max and S2max is in the range from 400 to 500 nm, from 500 to 600 nm, from 600 to 700 nm or from 700 to 1,000 nm.

(13) The silver halide photographic light-sensitive material as described in any one of (1) to (12), wherein the longest wavelength showing a spectral absorption factor of 50% of Amax or Smax is in the range from 460 to 510 nm, from 560 to 610 nm or from 640 to 730 nm.

(14) The silver halide photographic light-sensitive material as described in any one of (1) to (13), wherein in the silver halide grain, the excitation energy of the dye chromophore in the second or upper layer transfers to the dye chromophore in the first layer with an efficiency of 10% or more.

(15) The silver halide photographic light-sensitive material as described in any one of (1) to (14), wherein in the silver halide grain, the dye chromophore in the first layer and the dye chromophore in the second or upper layer both show J-band absorption.

(16) The silver halide photographic light-sensitive emulsion as described in (1) to (15), wherein in the silver halide photographic light-sensitive emulsion, tabular grains having an aspect ratio of 2 or more are present in a proportion of 50% (area) or more of all silver halide grains in the emulsion.

(17) The silver halide photographic light-sensitive emulsion as described in any one of (1) to (16), wherein the silver halide photographic emulsion is subjected to selenium sensitization.

(18) The silver halide photographic light-sensitive emulsion as described in any one of (1) to (17), wherein the silver halide grain has a silver halide adsorptive compound other than a sensitizing dye.

DETAILED DESCRIPTION OF THE INVENTION

The present invention is described in detail below.

In the present invention, a compound having a plurality of dye chromophores (the compound is hereinafter referred to as a linked dye), provided that at least one of the dye chromophores is a methine dye chromophore containing a basic nucleus comprising a monocyclic heterocyclic ring.

The linked dye is preferably a dye represented by formula (I).

The basic nucleus comprising a monocyclic heterocyclic ring is described below. The basic nucleus is described, for example, in James (compiler), *The Theory of the Photographic Process,* 4th ed., pp. 197–199, Macmillan (1977). Specific examples thereof include those described later as specific examples of $Z_{11}$ and the like. Among these heterocyclic rings, monocyclic heterocyclic rings are used in the present invention. The term "monocyclic heterocyclic ring" as used herein means a heterocyclic ring to which an aromatic ring is not condensed. A ring other than aromatic ring may be condensed but is preferably not condensed.

Specific examples of the basic nucleus include thiazoline nucleus, thiazole nucleus, oxazoline nucleus, oxazole nucleus, selenazoline nucleus, selenazole nucleus, tetrazoline nucleus, tetrazole nucleus, imidazoline nucleus, imidazole nucleus, pyrroline nucleus, 2-pyridine nucleus, 4-pyridine nucleus, oxadiazole nucleus, thiadiazolel nucleus, pyrazole nucleus, tetrazole nucleus and pyrimidine nucleus. Among these, preferred are thiazoline nucleus, thiazole nucleus, oxazoline nucleus, oxazole nucleus, imidazoline nucleus, imidazole nucleus, oxadiazole nucleus, thiadiazole nucleus and pyrazole nucleus, more preferred are thiazoline nucleus, thiazole nucleus, oxazoline nucleus, oxazole nucleus, oxadiazole nucleus, thiadiazole nucleus and pyrazole nucleus, still more preferred are thiazoline nucleus, thiazole nucleus, thiadiazole nucleus and pyrazole nucleus, particularly preferred are thiadiazole nucleus and pyrazole nucleus, and most preferred is pyrazole nucleus. These nuclei each may be substituted by a substituent but is not condensed with an aromatic ring. Furthermore, nuclei each may be condensed with a ring other than an aromatic ring but is preferably not condensed.

The basic nucleus comprising a monocyclic heterocyclic ring is hydrophilic and small in the molecular size as compared with usually used basic nuclei comprising a heterocyclic ring condensed with an aromatic ring (specific examples of the basic nucleus comprising a heterocyclic ring condensed with an aromatic ring include those described later as specific examples of $Z_{11}$ and the like, which are not monocyclic, such as benzothiazole nucleus, benzoxazole nucleus, benzoselenazole nucleus, benzotellurazole nucleus, 3,3-dialkylindolenine nucleus (e.g., 3,3-dimethylindolenine), benzimidazole nucleus, 2-quinone nucleus, 4-quinoline nucleus, 1-isoquinoline nucleus, 3-isoquinoline nucleus, imidazo[4,5-b]quinoxaline nucleus and these nucleus substituted by a substituent or condensed with a ring). The dye chromophore comprising such a basic nucleus is also hydrophilic and small in the chromophore size. Accordingly, use of this dye chromophore as the dye chromophore for the second layer is advantageous in that the adsorption powder to silver halide is weak, the aggregation of the first layer dye is not inhibited and the linked dye adsorbs in multiple layers.

The dye chromophore containing a basic nucleus comprising a monocyclic heterocyclic ring preferably contains at least one acid radical, more preferably a sulfo group, a carboxyl group, —$CONHSO_2$— group, —CONHCO— group or —$SO_2NHSO_2$— group, still more preferably a sulfo group or a carboxyl group, most preferably a sulfo group. The acid radical is described in detail later. In this respect, the basic nucleus comprising a monocyclic heterocyclic ring preferably has at least one acid radical, more preferably an acid radical other than the substituent on the nitrogen atoms of the monocyclic heterocyclic ring.

The dye chromophore containing a basic nucleus comprising a monocyclic heterocyclic ring is preferably present in the second or upper layer.

The group and the like for use in the present invention is described in detail below.

In the present invention, when a specific site is called "a group", this means that the site itself may not be substituted or may be substituted by one or more (a possible maximum number of) substituents. For example, "an alkyl group" means a substituted or unsubstituted alkyl group. The substituent which can be used in the compound for use in the present invention may be any substituent irrespective of the presence or absence of substitution.

Assuming that this substituent is W, the substituent represented by W may be any substituent and is not particularly limited, however, examples thereof include a halogen atom, an alkyl group [including cycloalkyl group, bicycloalkyl group and tricycloalkyl group, and also including an alkenyl group (including cycloalkenyl group and bicycloalkenyl group) and an alkynyl group], an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an ammonio group, an acylaxino group, an aminocarbonylamino group, an alkoxycarbonylamino group, an aryloxycarbonylamino group, a sulfamoylamino group, an alkylsulfonylamino group, an arylsulfonylamino group, a mercapto group, an alkylthio group, an arylthio group, a heterocyclic thio group, a sulfamoyl group, a sulfo group, an alkylsulfinyl group, an arylsulfinyl group, an alkylsulfonyl group, an arylsulfonyl group, an acyl group, an aryloxycarbonyl group, an alkoxycarbonyl group, a carbamoyl group, an arylazo group, a heterocyclic azo group, an imido group, a phosphino group, a phophinyl group, a phosphinyloxy group, a phosphinylamino group, a phosphono group, a silyl group, a hydrazino group, a ureido group, a boronic acid group (—$B(OH)_2$), a phoshato group (—$OPO(OH)_2$), a sulfato group (—$OOSO_3H$) and other known substituents.

More specifically, W represents a halogen atom (e.g., fluorine, chlorine, bromine, iodine), an alkyl group [which means a linear, branched or cyclic, substituted or unsubstituted alkyl group and which includes an alkyl group (preferably an alkyl group having from 1 to 30 carbon atoms, e.g., methyl, ethyl, n-propyl, isopropyl, tert-butyl, n-octyl, eicosyl, 2-chloroethyl, 2-cyanoethyl, 2-ethylhexyl), a cycloalkyl group (preferably a substituted or unsubstituted cycloalkyl group having from 3 to 30 carbon atoms, e.g., cyclohexyl, cyclopentyl, 4-n-d(odecyl-cyclohexyl), a bicycloalkyl group (preferably a substituted or unsubstituted bicycloalkyl group having from 5 to 30 carbon atoms, namely, a monovalent group resultant from removing one hydrogen atom of a bicycloalkane having from 5 to 30 carbon atoms, e.g., bicyclo[1,2,2]heptan-2-yl, bicyclo[2,2,2]octan-3-yl), and a tricyclo structure having many cyclic structures; the alkyl group in the substituent described below (for example, an alkyl group in an alkylthio group) means an alkyl group having such a concept and also includes an alkenyl group and an alkynyl group], an alkenyl group [which means a linear, branched or cyclic, substituted or unsubstituted alkenyl group and which includes an alkenyl group (preferably a substituted or unsubstituted alkenyl group having from 2 to 30 carbon atoms, e.g., vinyl, allyl, prenyl, geranyl, oreyl), a cycloalkenyl group (preferably a substituted or unsubstituted cycloalkenyl group having from 3 to 30 carbon atoms, namely, a monovalent group resultant from removing one hydrogen atom of a cycloalkane having from 3 to 30 carbon atoms, e.g., 2-cyclopenten-1-yl, 2-cyclohexen-1-yl), a bicycloalkenyl group (a substituted or unsubstituted bicycloalkenyl group, preferably a substituted or unsubstituted bicycloalkenyl group having from 5 to 30 carbon atoms, namely, a monovalent group resultant from removing one hydrogen atom of bicycloalkane having one double bond, e.g., bicyclo[2,2,1]hept-2-en-1-yl, bicyclo[2,2,2]oct-2-en-4-yl)], an alkynyl group (preferably a substituted or unsubstituted alkynyl group having from 2 to 30 carbon atoms, e.g., ethynyl, propargyl, trimethylsilylethynyl), an aryl group (preferably a substituted or unsubstituted aryl group having from 6 to 30 carbon atoms, e.g., phenyl, p-tolyl, naphthyl, m-chlorophenyl, o-hexadecanoylainohenyl), a heterocyclic group (preferably a monovalent group resultant from removing one hydrogen atom of a 5- or 6-membered substituted or unsubstituted, aromatic or non-aromatic heterocyclic compound, more preferably a 5- or 6-membered aromatic heterocyclic group having from 3 to 30 carbon atoms, e.g., 2-furyl, 2-thienyl, 2-pyrimidinyl, 2-benzothiazolyl; the heterocyclic group may also be a cationic heterocyclic group such as 1-meithyl-2-pyridinio and 1-methyl-2-quinolinio), a cyano group, a hydroxyl group, a nitro group, a carboxyl group, an alkoxy group (preferably a substituted or unsubstituted alkoxy group having from 1 to 30 carbon atoms, e.g., methoxy, ethoxy, isopropoxy, tert-butoxy, n-octyloxy, 2-methoxyethoxy), an aryloxy group (preferably a substituted or unsubstituted aryloxy group having from 6 to 30 carbon atoms, e.g., phenoxy, 2-methylphenoxy, 4-tert-butylphenoxy, 3-nitrophenoxy, 2-tetradecanoylamino-phenoxy), a silyloxy group (preferably a silyloxy group having from 3 to 20 carbon atoms, e.g., trimethylsilyloxy, tert-butyldimethylsilyloxy), a heterocyclic oxy group (preferably a substituted or unsubstituted heterocyclic oxy group having from 2 to 30 carbon atoms, e.g., 1-phenyltetrazole-5-oxy, 2-tetrahydropyranyloxy), an acyloxy group (preferably a formyloxy group, a substituted or unsubstituted alkylcarbonyloxy group having from 2 to 30 carbon atoms, or a substituted or unsubstituted arylcarbonyloxy group having from 6 to 30 carbon atoms, e.g., formyloxy, acetyloxy, pivaloyloxy, stearoyloxy, benzoyloxy, p-methoxyphenylcarbonyloxy), a carbamoyloxy group (preferably a substituted or unsubstituted carbamoyloxy group having from 1 to 30 carbon atoms, e.g., N,N-dimethylcarbamoyloxy, N,N-diethylcarbamoyloxy, morpholinocarbonyloxy, N,N-di-n-octylaminocarbonyloxy, N-n-octylcarbamoyloxy), an alkoxycarbonyloxy group (preferably a substituted or unsubstituted alkoxycarbonyloxy group having from 2 to 30 carbon atoms, e.g., methoxycarbonyloxy, ethoxycarbonyloxy, tert-butoxycarbonyloxy, n-octylcarbonyloxy), an aryloxycarbonyloxy group (preferably a substituted or unsubstituted aryloxycarbonyloxy group having from 7 to 30 carbon atoms, e.g., phenoxycarbonyloxy, p-methoxyphenoxy-carbonyloxy, p-n-hexadecyloxyphenoxy-carbonyloxy), an amino group (preferably an amino group, a substituted or unsubstituted alkylamino group having from 1 to 30 carbon atoms, or a substituted or unsubstituted anilino group having from 6 to 30 carbon atoms, e.g., amino, methylamino, dimethylamino, anilino, N-methyl-anilino, diphenylamino), an ammonio group (preferably an amonio group or an ammonio group substituted by a substituted or unsubstituted alkyl, aryl or heterocyclic group having from 1 to 30 carbon atoms, e.g., trimethylammonio, triethyl-ammonio, diphenylmethylammonio), an acylamino group (preferably a formylamino group, a substituted or unsubstituted alkylcarbonylamino group having from 1 to 30 carbon atoms, or a substituted or unsubstituted arylcarbonylamino group having from 6 to 30 carbon atoms, e.g., formylamino, acetylamino, pivaloylamino, lauroylamino, benzoylamino, 3,4,5-tri-n-octyloxyphenylcarbonylamino), an aminocarbonylamino group (preferably a substituted or unsubstituted aminocarbonylamino group having from 1 to 30 carbon atoms, e.g., carbamoylamino, N,N-dimethylamino-carbonylamino, N,N-diethylaminocarbonylamino, morpholino-carbonylamino), an alkoxycarbonylamino group (preferably a substituted or unsubstituted alkoxycarbonylamino group having from 2 to 30 carbon atoms, e.g., methoxycarbonyl-amino, ethoxycarbonylamino, tert-butoxycarbonylamino, n-octadecyloxycarbonylamino, N-methyl-methoxycarbonylamino), an aryloxycarbonylamino group (preferably a substituted or unsubstituted aryloxycarbonylamino group having from 7 to 30 carbon atoms, e.g., phenoxycarbonylamino, p-chloro-phenoxycarbonylamino, m-n-octyloxyphenoxycarbonyl-amino), a sulfamoylamino group (preferably a substituted or unsubstituted sulfamoylamino group having from 0 to 30 carbon atoms, e.g., sulfamoylamino, N,N-dimethylamino-sulfonylamino, N-n-octylaminosulfonylamino), an alkyl- or arylsulfonylamino group (preferably a substituted or unsubstituted alkylsulfonylamino group having from 1 to 30 carbon atoms, or a substituted or unsubstituted arylsulfonylamino group having from 6 to 30 carbon atoms, e.g., methylsulfonylamino, butylsulfonylamino, phenylsulfonylamino, 2,3,5-trichlorophenylsulfonylamino, p-methylphenylsulfonylamino), a mercapto group, an alkylthio group (preferably a substituted or unsubstituted alkylthio group having from 1 to 30 carbon atoms, e.g., methylthio, ethylthio, n-hexadecylthio), an arylthio group (preferably a substituted or unsubstituted arylthio having from 6 to 30 carbon atoms, e.g., phenylthio, p-chlorophenylthio, m-methoxyphenylthio), a heterocyclic thio group (preferably a substituted or unsubstituted heterocyclic thio group having from 2 to 30 carbon atoms, e.g., 2-benzothiazolylthio, 1-phenyltetrazol-5-ylthio), a sulfamoyl group (preferably a substituted or unsubstituted sulfamoyl group having from 0 to 30 carbon atoms, e.g., N-ethylsulfamoyl,. N-(3-dodecyloxypropyl)sulfamoyl, N,N-dimethylsulfamoyl, N-acetylsulfamoyl, N-benzoylsulfamoyl, N-(N'-phenylcarbamoyl)sulfamoyl), a sulfo group, an alkyl- or arylsulfinyl group (preferably a substituted or unsubstituted alkylsulfinyl group having from 1 to 30 carbon atoms, or a substituted or unsubstituted arylsulfinyl group having from 6 to 30 carbon atoms, e.g., methylsulfinyl, ethylsulfinyl, phenylsulfinyl, p-methylphenylsulfinyl), an alkyl- or arylsulfonyl group (preferably a substituted or unsubstituted alkylsulfonyl group having from 1 to 30 carbon atoms, or a substituted or unsubstituted arylsulfonyl group having from 6 to 30 carbon atoms, e.g., methylsulfonyl, ethylsulfonyl, phenylsulfonyl, p-methylphenylsulfonyl), an acyl group (preferably a formyl group, a substituted or unsubstituted alkylcarbonyl group having from 2 to 30 carbon atoms, a substituted or unsubstituted arylcarbonyl group having from 7 to 30carbon atoms, or a substituted or unsubstituted heterocyclic carbonyl group having from 4 to 30 carbon atoms and being bonded to a carbonyl group through a carbon atom, e.g., acetyl, pivaloyl, 2-chloroacetyl, stearoyl, benzokl, p-n-octyloxyphenylcarbonyl, 2-pyridylcarbonyl, 2-furylcarbonyl), an aryloxycarbonyl group (preferably a substituted or unsubstituted aryloxycarbonyl group having from 7 to 30 carbon atoms, e.g., phenoxycarbonyl, o-chlorophenoxy-carbonyl, m-nitrophenoxycarbonyl, p-tert-butylphenoxy-carbonyl), an alkoxycarbonyl group (preferably a substituted or unsubstituted alkoxycarbonyl group having from 2 to 30 carbon atoms, e.g., methoxycarbonyl, ethoxycarbonyl, tert-butoxycarbonyl, n-octadecyl-oxycarbonyl), a carbamoyl group (preferably a substituted or unsubstituted carbamoyl group having from 1 to 30 carbon atoms, e.g., carbamoyl, N-methylcarbamoyl, N,N-dimethyl-carbamoyl, N,N-di-n-octylcarbamoyl, N-(methylsulfonyl)-carbamoyl), an aryl or heterocyclic azo group (preferably a substituted or unsubstituted arylazo group having from 6 to 30 carbon atoms, or a substituted or unsubstituted heterocyclic azo group having from 3 to 30 carbon atoms, e.g., phenylazo, p-chlorophenylazo, 5-ethylthio-1,3,4-thiadiazol-2-ylazo), an imido group (preferably N-succinimido or N-phthalimido), a phosphino, group (preferably a substituted or unsubstituted phosphino group having from 2 to 30 carbon atoms, e.g., dimethylphosphino, diphenylphosphino, methylphenoxyphosphino), a phosphinyl group (preferably a substituted or unsubstituted phosphinyl group having from 2 to 30 carbon atoms, e.g., phosphinyl, dioctyloxyphosphinyl, diethoxyphosphinyl), a phosphinyloxy group (preferably a substituted or unsubstituted phosphinyloxy group having from 2 to 30 carbon atoms, e.g., diphenoxyphosphinyloxy, dioctyloxyphosphinyloxy), a phosphinylamino group (preferably a substituted or unsubstituted phosphinylamino group having from 2 to 30 carbon atoms, e.g., dimethoxyphosphinylamino, dimethylaminophosphinylamino), a phospho group, a silyl group (preferably a substituted or unsubstituted silyl group having from 3 to 30 carbon atoms, e.g., trimethylsilyl, tert-butyldimethylsilyl, phenyldimethylsilyl), a hydrazino group (preferably a substituted or unsubstituted hydrazino group having from 0 to 30 carbon atoms, e.g., trimethylhydrazino), or a ureido group (preferably a substituted or unsubstituted ureido group having from 0 to 30 carbon atoms, e.g., N,N-dimethylureido).

Two W's may form a ring in co-operation (for example, an aromatic or non-aromatic hydrocarbon or heterocyclic ring or a polycyclic condensed ring comprising a combination of these rings, e.g., benzene ring, naphthalene ring, anthracene ring, quinoline ring, phenanthrene ring, fluorene ring, triphenylene ring, naphthacene ring, biphenyl ring, pyrrole ring, furan ring, thiophene ring, imidazole ring, oxazole ring, thiazole ring, pyridine ring, pyrazine ring, pyrimidine ring, pyridazine ring, indolizine ring, indole ring, benzofuran ring, benzothiophene ring, isobenzofuran ring, quinolidine ring, phthalazine ring, naphthylidine ring, quinoxaline ring, quinoxazoline ring, isoquinoline ring, carbazole ring, phenanthridine ring, acridine ring, phenanthroline ring, thianthrene: ring, chromene ring, xanthene ring, phenoxathiine ring, phenothiazine ring, phenazine ring).

Among these substituents W, those having a hydrogen atom may be remove the hydrogen atom and may be substituted by the above-described substituent. Examples of such a substituent include —$CONHSO_2$ group (e.g., sulfonylcarbamoyl group, carbamoylsulfamoyl group), —CONHCO— group (e.g., carbonylcarbamoyl group) and —$SO_2NHSO_2$— group (e.g., sulfonylsulfamoyl group).

Specific examples thereof include an alkylcarbonylaminosulfonyl group (e.g., acetylaminosulfonyl), an arylcarbonylaminosulfonyl group (e.g., benzoylamino-sulfonyl), an alkylsulfonylaminocarbonyl group (e.g., methylsulfonylaminocarbonyl) and an arylsulfonylaminocarbonyl group (e.g., p-methylphenylsulfonylaminocarbonyl).

The compound having a plurality of dye chromophores, which is used in the present invention, is described in detail below. This compound can be preferably used as a sensitizing dye. Preferred examples of the dye chromophore are the same as $D_1$ and $D_2$ described later. The dye chromophores may be the same or different but are preferably different. The number of dye chromophores contained in the compound may be any number insofar as it is two or more, but is preferably from 2 to 10,000, more preferably from 2 to 1,000, further more preferably from 2 to 100, still more preferably from 2 to 10, yet still more preferably from 2 to 5, particularly preferably 2 or 3, and most preferably 2.

In the compound, two or more dye chromophores may be linked through a covalent bond or a coordinate bond but is preferably linked through a covalent bond. Furthermore, in the compound, the covalent bond or coordinate bond may be previously formed or may be formed in the process of preparing a silver halide light-sensitive material (for example, in the silver halide emulsion). In the latter case, the bond may be formed by the method described, for example, in JP-A-2000-81678. Preferred is the case where the bond is previously formed.

The dye chromophores $D_1$ and $D_2$ and La are described below. The dye chromophores represented by $D_1$ and $D_2$ may be any chromophore, however, at least one of $D_1$ and $D_2$ is a methine dye chromophore containing a basic nucleus comprising a monocyclic heterocyclic ring and this methine dye chromophore is preferably represented by formula (AI), more preferably by formula (AII). Examples of the dye chromophore represented by $D_1$ and $D_2$ include cyanine dyes, styryl dyes, hemicyanine dyes, merocyanine dyes, trinuclear merocyanine dyes, tetranuclear merocyanine dyes, rhodacyanine dyes, complex cyanine dyes, complex merocyanine dyes, allopolar dyes, oxonol dyes, hemioxonol dyes, squarylium dyes, croconium dyes, azamethine dyes, coumarin dyes, arylidene dyes, anthraquinone dyes, triphenylmethane dyes, azo dyes, azomethine dyes, spiro compounds, metallocene dyes, fluorenone dyes, fulgide dyes, perylene dyes, phenazine dyes, phenothiazine dyes,: quinone dyes, indigo dyes, diphenylmethane dyes, polyene dyes, acridine dyes, acridinone dyes, diphenylamine dyes, quinacridone dyes, quinophthalone dyes, phenoxazine dyes, phthaloperylene dyes, porphyrin dyes, chlorophile dyes, phthalocyanine dyes and metal complex dyes.

Among these methine dye chromophores, preferred are cyanine dyes, styryl dyes, hemicyanine dyes, merocyanine dyes, trinuclear merocyanine dyes, tetranuclear merocyanine dyes, rhodacyanine dyes, complex cyanine dyes, complex merocyanine dyes, allopolar dyes, oxonol dyes, hemioxonol dyes, squarylium dyes, croconium dyes and azamethine dyes, more preferred are cyanine dyes, merocyanine dyes, trinuclear merocyanine dyes, tetranuclear merocyanine dyes, oxonol dyes and rhodacyanine dyes, still more preferred are cyanine dyes, merocyanine dyes and oxonol dyes, and particularly preferred are cyanine dyes and merocyanine dyes. The dye chromophore for the first layer is most preferably a cyanine dye and the dye chromophore for the second or upper layer is most preferably a merocyanine dye.

These dyes are described in detain in F. M. Harmer, *Heterocyclic Compounds—Cyanine Dyes and Related Compounds*, John Wiley & Sons, New York, London (1964), D. M. Sturmer, *Heterocyclic Compounds—Special tonics in heterocyclic chemistry,* Chap. 18, Section 14, pp. 482–515, John Wiley & Sons, New York, London (1977), and *Rodd's Chemistry of Carbon Compounds,* 2nd ed., Vol. IV, Part B, Chap. 15, Items 369–422, Elsevier Science Publishing Company Inc., New York (1977). Examples of the formulae of preferred dyes include the formulae described in U.S. Pat. No. 5,994,051, pp., 32–36, and the formulae described in U.S. Pat. No. 5,747,236, pp. 30–34. For cyanine dyes, merocyanine dyes and rhodacyanine dyes, formulae (XI), (XII) and (XIII) described in U.S. Pat. No. 5,340,694, columns 21 to 22, are preferred, (where, however, the numbers of n12, n15, n17 and n18 are not limited and each is an integer of 0 or more (preferably 4 or less)).

In the present invention, the compound having a plurality of dye chromophores may be any compound but is preferably the compound represented by formula (I).

In the present invention, $D_1$ and $D_2$ of formula: (I) may be the same but are preferably different. When $D_1$ and $D_2$ are different, multilayer adsorption can be advantageously attained as described below.

In the present invention, in the case where the linked dye represented by formula (I) is adsorbed to a silver halide grain, $D_2$ is preferably a chromophore which:. adsorbs to silver halide and $D_2$ is preferably a chromophore which does not directly adsorb to silver halide.

In other words, $D_2$ is preferably lower than $D_1$ in the adsorption strength to a silver halide grain,. The adsorption strength to a silver halide grain is most preferably in the order of $D_1$>La>$D_2$.

As such, $D_1$ is preferably a sensitizing dye moiety having adsorptivity to a silver halide grain, however, the adsorption may be attained by either physical adsorption or chemical adsorption.

$D_2$ is preferably weak in the adsorptivity to a silver halide grain and is also preferably a light-emitting dye. With respect to the kind of the light-emitting dye, those having a skeleton structure of dyes used for dye laser are preferred. These are described, for example, in Mitsuo Maeda, *Laser Kenkyu (Study of Laser)*, Vol. 8, page 694, page 803 and page 958 (1980), *ibid.*, Vol. 9, page 85 (1981), and F. Schaefer, *Dye Lasers, Springer* (1973).

The absorption maximum wavelength of $D_1$ in a silver halide photographic light-sensitive material is preferably longer than the absorption maximum wavelength of $D_2$. Furthermore, the light emission of $D_2$ preferably overlaps the absorption of $D_1$. In addition, $D_1$ preferably forms a J-assiciation product (i.e., J-aggregate). In order to let the linked dye represented by formula (I) have absorption and spectral sensitivity in a desired wavelength range, $D_2$ also preferably forms a J-association product.

$D_1$ and $D_2$ each may have any reduction potential and any oxidation potential, however, the reduction potential of $D_1$ is preferably more positive than the value obtained by subtracting 0.2 V from the reduction potential of $D_2$.

In order to satisfy the above-described requirements of $D_1$ and $D_2$, $D_2$ is preferably a methine dye chromophore containing a basic nucleus comprising a monocyclic heterocyclic ring.

La represents a linking group (preferably a divalent linking group) or a single bond. This linking group preferably comprises an atom or atomic group containing at least one of carbon atom, nitrogen atom, sulfur atom and oxygen atom. La preferably represents a linking group having from 0 to 100 carbon atoms, more preferably from 1 to 20 carbon atoms, constituted by one or a combination of two or more of an alkylene group (e.g., methylene, ethylene, trimethylene, tetramethylene, pentamethylene), an: arylene group (e.g., phenylene, naphthylene,), an alkenylene group (e.g., ethenylene, propenylene), an alkynylene group (e.g., ethynylene, propynylene), an amide group, an ester group, a sulfoamido group, a sulfonic acid ester group, a ureido group, a sulfonyl group, a sulfinyl group, a thioether group, an ether group, a carbonyl group, —N(Va)- (wherein Va represents a hydrogen atom or a monovalent substituent; examples of the monovalent group include those represented by W described above) and a heterocyclic divalent group (e.g., 6-chloro-1,3,5-triazine-2,4-diyl, pyrimidine-2,4-diyl, quinoxaline-2,3-diyl).

The above-described linking group may have a substituent represented by W described above. Furthermore, these linking groups each may contain a ring (aromatic or non-aromatic hydrocarbon or heterocyclic ring).

La more preferably represents a divalent linking group having from 1 to 10 carbon atoms, constituted by one or a combination of two or more of an alkylene group having from 1 to 10 carbon atoms (e.g., methylene, ethylene, trimethylene, tetramethylene, pentamethylene), an arylene group having from 6 to 10 carbon atoms (e.g., phenylene, naphthylene), an alkenylene group having from 2 to 10 carbon atoms (e.g., ethenylene, propenylene), an alkynylene group having from 2 to 10 carbon atoms (e.g., ethynylene, propynylene), an ether group, an amide group, an ester group, a sulfoamido group and a sulfonic acid ester group. This linking group may be substituted by W described above.

La is a linking group which may perform energy transfer or electron transfer by a through-bond interaction. The through-bond interaction includes a tunnel interaction and a super-exchange interaction. Among these, a through-bond interaction based on a super-exchange interaction is preferred. The through-bond interaction and the, super-exchange interaction are interactions defined in Shammai Speiser, *Chem. Rev.*, Vol. 96, pp. 1960–1963 (1996). Preferred examples of the linking group which performs the energy transfer or electron transfer by such an interaction include those described in Shammai Speiser, *Chem. Rev.*, Vol. 96, pp. 1967–1969 (1996).

La may represent a plurality (preferably 2 to 4, more preferably 2) linking groups or a single bond. In the case where a plurality of linking groups are present, this means that the pair $D_1$ and $D_2$ or the pair $D_2$ and $D_2$ are linked through a plurality of linking groups or a single bond. More specifically, the pair $D_1$ and $D_2$ and the pair $D_2$ and $D_2$ each may be linked at one site or at a plurality of sites. The plurality of linking groups La may be the same or different but is preferably the same. La is preferably one linking group rather than a plurality of linking groups.

$q_1$, $r_1$ and $r_2$ each represents an integer of from 1 to 100, preferably from 1 to 5, more preferably from 1 to 2, still more preferably 1. When $q_1$, $r_1$ and $r_2$ each is 2 or more, the plurality of linking groups La contained may be different from each other and the plurality of respective dye chromophores $D_2$ and $D_1$ contained may also be different from each other. La may be bonded to any site of $D_1$ and $D_2$ but is preferably not bonded to the methine chain moiety.

Here, formula (I) shows that the dye chromophores can be linked with each other in any linking form.

The dye represented by formula (I) as a whole preferably has an electric charge of −1 or less, more preferably −1.

The dye is more preferably a methine dye where $D_1$ and $D_2$ in formula (I) each is independently represented by the following formula (II), (III), (IV) or (V):

(II)

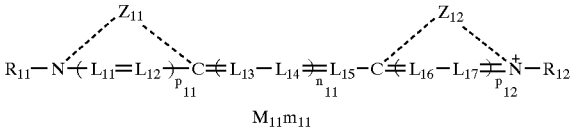

wherein $L_{11}$, $L_{12}$, $L_{13}$, $L_{14}$, $L_{15}$, $L_{16}$ and $L_{17}$ each represents a methine group, p11 and p12 each represents 0 or 1, $n_{11}$ represents 0, 1, 2, 3 or 4, $Z_{11}$ and $Z_{12}$ each represents an atomic group necessary for forming a nitrogen-containing heterocyclic ring, provided that a ring may be condensed to $Z_{11}$ and $Z_{12}$, $M_{11}$ represents a electric charge balancing counter ion, $m_{11}$ represents a number of 0 or more necessary for neutralizing the electric charge of the molecule, and $R_{11}$ and $R_{12}$ each represents a hydrogen atom, an alkyl group, an aryl group or a heterocyclic group, provided that when the dye chromophore is a methine dye chromophore containing a basic nucleus comprising a monocyclic heterocyclic ring, at least one of the heterocyclic ring comprising $Z_{11}$, $R_{11}$, $L_{11}$, $L_{12}$ and $p_{11}$ and the heterocyclic ring comprising, $Z_{12}$ $R_{12}$, $L_{16}$, $L_{17}$ and $p_{12}$ is a monocyclic heterocyclic ring;

(III)

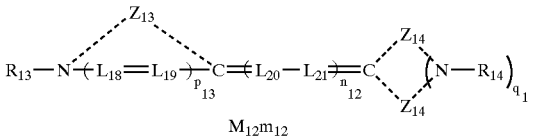

$M_{12}m_{12}$ wherein $L_{18}$, $L_{19}$, $L_{20}$ and $L_{21}$ each represents a methine group, $p_{13}$ represents 0 or 1, $q_{11}$ represents 0 or 1, $n_{12}$ represents 0, 1, 2, 3 or 4, $Z_{13}$ represents an atomic group necessary for forming a nitrogen-containing heterocyclic ring, $Z_{14}$ and $Z_{14}'$ each represents an atomic group necessary for forming a heterocyclic or acyclic acidic terminal group together with $(N—R_{14})q_{11}$, provided that a ring may be condensed to $Z_{13}$, $Z_{14}$ and $Z_{14}'$, $M_{12}$ represents an electric charge balancing counter ion, $m_{12}$ represents a number of 0 or more necessary for neutralizing the electric charge of the molecule, and $R_{13}$ and $R_{14}$ each represents a hydrogen atom, an alkyl group, an aryl group or a heterocyclic group, provided that when the dye chromophore is a methine dye chromophore containing a basic nucleus comprising a monocyclic heterocyclic ring, the heterocyclic ring comprising $Z_{13}$, $R_{13}$, $L_{18}$, $L_{19}$ and $p_{13}$ is a monocyclic heterocyclic ring;

(IV)

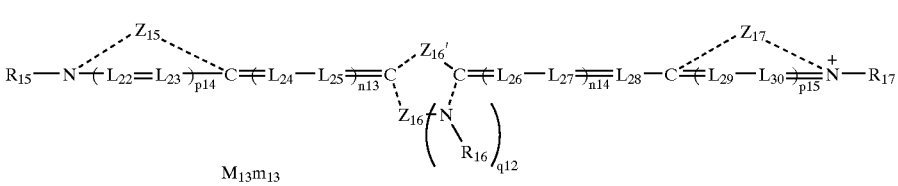

$M_{13}m_{13}$ wherein $L_{22}$, $L_{23}$, $L_{24}$, $L_{25}$, $L_{26}$, $L_{27}$, $L_{28}$, $L_{29}$ and $L_{30}$ each represents a methine group, $p_{14}$ and $p_{15}$ each represents 0 or 1, $q_{12}$ represents 0 or 1, $n_{13}$ and $n_{14}$ each represents 0, 1, 2, 3 or 4, $Z_{15}$ and $Z_{17}$ each represents an atomic group necessary for forming a nitrogen-containing heterocyclic ring; $Z_{16}$ and $Z_{16}'$ each represents an atomic group necessary for forming a heterocyclic ring together with $(N—R_{16})$ $q_{12}$, provided that a ring may be condensed to $Z_{15}$, $Z_{16}$, $Z_{16}'$ and $Z_{17}$, $M_{13}$ represents an electric charge balancing counter ion, $m_{13}$ represents a number of 0 or more necessary for neutralizing the electric charge of the molecule, and $R_{15}$, $R_{16}$ and $R_{17}$ each represents a hydrogen atom, an alkyl group, an aryl group or a heterocyclic group, provided that when the dye chromophore is a methine dye chromophore containing a basic nucleus comprising a monocyclic heterocyclic ring, at lease one of the heterocyclic ring comprising $Z_{15}$, $R_{15}$, $L_{22}$, $L_{23}$ and $p_{14}$ and the heterocyclic ring comprising $Z_{17}$, $R_{17}$, $L_{29}$, $L_{30}$ and $p_{15}$ is a monocyclic heterocyclic ring;

(VII)

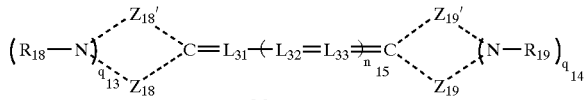

$M_{14}m_{14}$ wherein $L_{31}$, $L_{32}$ and $L_{33}$ each represents a methine group, $q_{13}$ and $q_{14}$ each represents 0 or 1, $n_{15}$ represents 0, 1, 2, 3 or 4, each $Z_{18}$ and $Z_{18}'$ and each $Z_{19}$ and $Z_{19}'$ represents an atomic group necessary for forming a heterocyclic ring or an acyclic acidic terminal group, together with $(N—R_{18})_{q13}$ and together with $(N—R_{19})_{q14}$, respectively, provided that a ring may be condensed to $Z_{18}$ and $Z_{18}'$ and to $Z_{19}$ and $Z_{19}'$, $M_{14}$ represents an electric charge balancing counter ion, $m_{14}$ represents a number of 0 or more necessary for neutralizing the electric charge of the molecule, and $R_{18}$ and $R_{19}$ each represents a hydrogen atom, an alkyl group, an aryl group or a heterocyclic group.

$D_1$ in formula (I) is preferably a methine dye represented by formula (II), (III) or (IV), more preferably a methine dye represented by formula (II). $D_2$ in formula (I) is preferably a methine dye represented by formula (II), (III) or (V), more preferably a methine dye represented by formula (II) or (III), still more preferably a methine dye represented by formula (III).

The methine compounds represented by formulae (I), (II), (III), (IV), (V), (AI) and (AII) are described in detail below.

In formula (AI), when a cyanine dye or a rhodacyanine dye is formed by $Q_{51}$, the methine compound may also be expressed by the following resonance formulae (the same applies to formula (AII)):

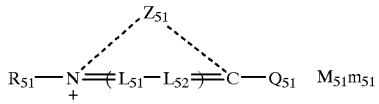

$M_{51}m_{51}$

In formulae (II), (III) and (IV), $Z_{11}$, $Z_{12}$, $Z_{13}$, $Z_{15}$ and $Z_{14}$ each represents an atomic group necessary for forming a nitrogen-containing heterocyclic ring, preferably a 5- or 6-membered nitrogen-containing heterocyclic ring. However, a ring may be condensed to each of these groups. The ring may be either an aromatic ring or a non-aromatic ring, but an aromatic ring is preferred and examples thereof include hydrocarbon aromatic rings such as benzene ring and naphthalene ring, and heteroaromatic rings such as pyrazine ring and thiophene ring.

Examples of the nitrogen-containing heterocyclic ring include thiazoline nucleus, thiazole nucleus, benzothiazole nucleus, oxazoline nucleus, oxazole nucleus, benzoxazole nucleus, selenazoline nucleus, selenazole nucleus, benzoselenazole nucleus, tetrazoline nucleus, tetrazole nucleus, benzotellurazole nucleus, 3,3-dialkylindolenine nucleus (e.g., 3,3-dimethylindolenine), imidazoline nucleus, imidazole nucleus, benzimidazole nucleus, pyrroline nucleus, 2-pyridine nucleus, 4-pyridine nucleus, 2-quinoline nucleus, 4-quinoline nucleus, 1-isoquinoline nucleus, 3-isoquinoline nucleus, imidazo[4,5-b]quinoxaline nucleus, oxadiazole nucleus, thiadiazole nucleus, pyrazole nucleus, tetrazole nucleus and pyrimidine nucleus. The nucleus other than the monocyclic heterocyclic ring for use in the present invention is preferably a benzothiazole nucleus, a benzoxazole nucleus, a 3,3-dialkylindolenine nucleus (e.g., 3,3-dimethylindolenine), a benzimidazole nucleus, a 2-pyridine nucleus, a 4-pyridine nucleus, a 2-quinoline nucleus, a 4-quinoline nucleus, a 1-isoquinoline nucleus or a 3-isoquinoline nucleus, more preferably a benzothiazole nucleus, a benzoxazole nucleus, a 3,3-dialkylindolenine nucleus (e.g., 3,3-dimethylindolenine) or a benzimidazole nucleus, still more preferably a benzoxazole nucleus, benzothiazole nucleus or a benzimidazole nucleus, and most preferably a benzoxazole nucleus or a benzothiazole nucleus.

These nuclei each may be substituted by a substituent represented by W or may be substituted or condensed by a ring. The substituent is preferably an alkyl group, an aryl group, an alkoxy group, a halogen atom, an aromatic ring condensed group, a sulfo group, a carboxyl group or a hydroxyl group.

Specific examples of the heterocyclic ring formed by $Z_{11}$, $Z_{12}$, $Z_{13}$, $Z_{15}$ and $Z_{17}$ include those described as examples of $Z_{11}$, $Z_{12}$, $Z_{13}$, $Z_{14}$ and $Z_{16}$ in U.S. Pat. No. 5,340,694, pp. 23–24.

When the methine dye represented by formula (II), (III) or (IV) is the dye chromophore represented by $D_1$ of formula (I), the substituent W on $Z_{11}$, $Z_{12}$, $A_{13}$, $Z_{15}$ and $Z_{17}$ is more preferably a halogen atom, an aromatic group or an aromatic ring condensation.

When the methine dye represented by formula (II), (III) or (IV) is the dye chromophore represented by $D_2$ of formula (I), the substituent W on $Z_{11}$, $Z_{12}$, $A_{13}$, $Z_{15}$ and $Z_{17}$ is still more preferably an acid radical.

The acid radial is described below. The acid radial is a group having a dissociative proton.

Specific examples thereof include a group from which a proton dissociates depending on the pKa thereof and the pH in the environment, such as a sulfo group, a carboxyl group, a sulfato group, —$CONHSO_2$ group (e.g., sulfonylcarbamoyl group, carbonylsulfamoyl group), —CONHCO— group (e.g., carbonylcarbamoyl group), —$SO_2NHSO_2$— group (e.g., sulfonylsulfamoyl group), a sulfonamido group, a sulfamoyl group, a phosphato group, a phoshono group, a boronic acid group and phenolic hydroxyl group. A proton-dissociative acid radical capable of dissociating in 90% or more, for example, at a pH from 5 to 11 is preferred.

The acid radical is preferably a sulfo group, a carboxyl group, —$CONHSO_2$— group, —CONHCO— group or —$SO_2NHSO_2$— group, more preferably a sulfo group or a carboxy group, and most preferably a sulfo group.

Each of the trios $Z_{14}$, $Z_{14}'$ and $(N—R_4)_{q11}$, $Z_{18}$, $Z_{18}'$ and $(N—R_{18})_{q13}$, and $Z_{19}$, $Z_{19}'$ and $(N—R_{19})_{q14}$ represents an atomic group necessary for forming a heterocyclic or acyclic acidic terminal group by combining with each other. Any heterocyclic ring (preferably 5- or 6-membered heterocyclic ring) may be formed but an acidic nucleus is preferred. The acidic nucleus and the acyclic acidic terminal group are described below. The acidic nucleus and the acyclic acidic terminal group each may have any acidic nucleus or acyclic acidic terminal group form of ordinary merocyanine dyes. In preferred forms, $Z_{14}$, $Z_{18}$ and $Z_{19}$ each is a thiocarbonyl group, a carbonyl group, an ester group, an acyl group, a carbamoyl group, a cyano group or a sulfonyl group, more preferably a thiocarbonyl group or a carbonyl group. $Z_{14}'$, $Z_{18}'$ and $Z_{19}'$ each represents a remaining atomic group necessary for forming the acidic nucleus or acyclic acidic terminal group. In the case of forming an acyclic acidic terminal group, $Z_{14}'$, $Z_{18}'$ and $Z_{19}'$ each is preferably a thiocarbonyl group, a carbonyl group, an ester group, an acyl group, a carbamoyl group, a cyano group or a sulfonyl group.

$q_{11}$, $q_{13}$ and $q_{14}$ each is 0 or 1, preferably 1.

The "acidic nucleus and acyclic acidic terminal group" as used herein are described, for example, in James (compiler), *The Theory of the Photographic Process,* 4th ed., pp. 197–200, Macmillan (1977). The acyclic acidic terminal group as used herein means an acidic, namely, electron-accepting terminal group which does not form a ring.

Specific examples of the acidic nucleus and acyclic acidic terminal group include those described in U.S. Pat. Nos. 3,567,719, 3,575,869, 3,804,634, 3,837,862, 4,002,480 and 4,925,777, JP-A-3-167546, and U.S. Pat. Nos. 5,994,051 and 5,747,236.

The acidic nucleus preferably forms a heterocyclic ring (preferably a 5- or 6-membered nitrogen-containing heterocyclic ring) comprising carbon, nitrogen, and/or chalcogen (typically oxygen, sulfur, selenium and tellurium) atoms, more preferably a 5- or 6-membered nitrogen-containing heterocyclic ring comprising carbon, nitrogen and/or chalcogen (typically oxygen, sulfur, selenium and tellurium) atoms. Specific examples; thereof include the following nuclei:

nuclei of 2-pyrazolin-5-one, pyrazolidine-3,5-dione, imidazolin-5-one, hydantoin, 2- or 4-thiohydantoin, 2-iminooxazolidin-4-one, 2-oxazolin-5-one, 2-thiooxazoline-2,5-dione, 2-thiooxazoline-2,4-dione, isooxazolin-5-one, 2-thiazolin-4-one, thiazolidin-4-one, thiazolidine-2,4-dione, rhodanine, thiazolidine-2,4-dione, isorhodanine, indane-1,3-dione, thiophen-3-one, thiophen-3-one-1,1-dioxide, indolin-2-one, indolin-3-one, 2-oxoindazolinium, 3-oxoindazolinium, 5,7-dioxo-6,7-dihydrothiazolo[3,2-a]-pyrimidine, cyclohexane-1,3-dione, 3,4-dihydroisoquinolin-4-one, 1,3-dioxane-4,6-dione, barbituric acid, 2-thiobarbituric acid, chroman-2,4-dione, indazolin-2-one, pyrido[1,2-a]pyrimidine-1,3-dione, pyrazolo[1,5-b]-quinazolone, pyrazolo[1,5-a]benzimidazole, pyrazolopyridone, 1,2,3,4-tetrahydroquinoline-2,4-dione, 3-oxo-2,3-dihydrobenzo[d]thiophene-1,1-dioxide and 3-dicyanomethine-2,3-dihydrobenzo[d]thiophene-1,1-dioxide;

additionally include nuclei having an exomethylene structure in which the carbonyl or thiocarbonyl group constituting the above-described nuclei is substituted at the active methylene position of the acidic nucleus, and nuclei having an exomethylene structure in which an active methylene compound having a structure such as ketomethylene or cyanomethylene as a starting material of an; acyclic acidic terminal group is substituted at the.: active methylene position.

These acidic nuclei and acyclic acidic terminal groups each may be substituted by a substituent represented by W described above or condensed with a ring.

Each of the trios $Z_{14}$, $Z_{14}'$ and $(N—R_{14})_{q11}$, $Z_{18}$, $Z_{18}'$ and $(N—R_{18})_{q13}$, and $Z_{19}$, $Z_{19}'$ and $(N—R_{19})_{q14}$ preferably forms hydantoin, 2- or 4-thiohydantoin, 2-oxazolin-5-one, 2-thiooxazolin-2,4-dione, thiazolidine-2,4-dione, rhodanine, thiazolidine-2,4-dithione, barbituric acid or 2-thiobarbituric acid, more preferably hydantoin, 2- or 4-thiohydantoin, 2-oxazolin-5-one, rhodanine, barbituric acid or 2-thiobarbituric acid.

In the case where the methine dye represented by formula (III) or (V) is the dye chromophore represented by $D_1$ of formula (I), 2- or 4-thiohydantoin, 2-oxazolin-5-one or rhodanine is preferably formed.

In the case where the methine dye represented by formula (III) or (V) is the dye chromophore represented by $D_2$ of formula (I), a barbituric acid is preferably formed.

Examples of the heterocyclic ring formed by $Z_{16}$, $Z_{16}'$ and $(N—R_{16})_{q12}$ are the same as those described above for the heterocyclic ring formed by $Z_{14}$, $Z_{14}'$ and $(N—R_{14})_{q11}$, $Z_{18}$, $Z_{18}'$ and $(N—R_{18})_{q13}$, and $Z_{19}$, $Z_{19}'$ and $(N—R_{19})_{q14}$. The heterocyclic ring is preferably the heterocyclic ring formed by $Z_{14}$, $Z_{14}'$ and $(N—R_{14})_{q11}$, $Z_{18}$, $Z_{18}'$ and $(N—R_{18})_{q13}$, or $Z_{19}$, $Z_{19}'$ and $(N—R_{19})_{q14}$, from which an oxo group or a thioxo group is eliminated The heterocyclic group is more preferably a heterocyclic group obtained by removing an oxo group or a thioxo group from hydantoin, 2- or 4-thiohydantoin, 2-oxazolin-5-one, 2-thiooxazolin-2,4-dione, thiazolidine-2,4-dione, rhodanine, thiazolidine-2,4-dione, barbituric acid or 2-thiobarbituric acid, particularly preferably a heterocyclic group obtained by removing an oxo group or a thioxo group from hydantoin, 2- or 4-thiohydantoin, 2-oxazolin-5-one, rhodanine, barbituric acid or 2-thiobarbituric acid, and most preferably a heterocyclic group obtained by removing an oxo group or a thioxo group from 2- or 4-thiohydantoin, 2-oxazolin-5-one or rhodanine.

$q_{12}$ is 0 or 1, preferably 1.

$R_{11}$, $R_{12}$, $R_{13}$, $R_{14}$, $R_{15}$, $R_{16}$, $R_{17}$, $R_{18}$ and $R_{19}$ each represents a hydrogen atom, an alkyl group, an aryl group or a heterocyclic group, preferably an alkyl group, an aryl group or a heterocyclic group. Specific examples of the alkyl group, aryl group and heterocyclic group represented by $R_{11}$, $R_{12}$, $R_{13}$, $R_{14}$, $R_{15}$, $R_{16}$, $R_{17}$, $R_{18}$ and $R_{19}$ include an unsubstituted alkyl group having from 1 to 18, preferably from 1 to 7, more preferably from 1 to 4, carbon atoms (e.g., methyl, ethyl, propyl, isopropyl, butyl, isobutyl, hexyl, octyl, dodecyl, octadecyl), a substituted alkyl group having from 1 to 18, preferably from 1 to 7, more preferably from 1 to 4, carbon atoms {for example, an alkyl group substituted by the above-described substituent W, preferably an alkyl group having an acid radical described above; preferred examples thereof include an aralkyl group (e.g., benzyl, 2-phenylethyl), an unsaturated hydrocarbon group (e.g., allyl, vinyl, that is, the substituted alkyl group as used herein includes an alkenyl group and an alkynyl group), a hydroxyalkyl group (e.g., 2-hydroxyethyl, 3-hydroxypropyl), a carboxyalkyl group (e.g., 2-caxboxyethyl, 3-carboxypropyl, 4-carboxybutyl, carboxymethyl), an alkoxyalkyl group (e.g., 2-methoxyethyl, 2-(2-methoxyethoxy)ethyl), an aryloxyalkyl group (e.g., 2-phenoxyethyl, 2-(1-naphthoxy)ethyl), an alkoxycarbonylalkyl group (e.g., ethoxycarbonylmethyl, 2-benzyloxycarbonyl-ethyl), an aryloxycarbonylalkyl group (e.g., 3-phenoxy-carbonylpropyl), an acyloxyalkyl group (e.g., 2-acetyloxy-ethyl an acylalkyl group (e.g., 2-acetylethyl), a carbamoylalkyl group (e.g., 2-morpholinocarbonylethyl), a sulfamoylalkyl group (e.g., N,N-dimethylsulfamoylmethyl), a sulfoalkyl group (e.g., 2-sulfoethyl, 3-sulfopropyl, 3-sulfobutyl, 4-sulfobutyl, 2-[3-sulfopropoxyl]ethyl, 2-hydroxy-3-sulfopropyl, 3-sulfopropoxyethoxyethyl), a sulfoalkenyl group, a sulfatoalkyl group, (e.g., 2-sulfato-ethyl, 3-sulfatopropyl, 4-sulfatobutyl), a heterocyclic ring-substituted alkyl group (e.g., 2-(pyrrolidin-2-on-1-yl)ethyl, tetrahydrofurfuryl), an alkylsulfonylcarbamoyl-alkyl group (e.g., methanesulfonylcarbamoylmethyl), an acylcarbamoylalkyl group (e.g., acetylcarbamoylmethyl), an acylsulfamoylalkyl group (e.g., acetylsulfamoylmethyl) and an alkylsulfonyl-sulfamoylalkyl group (e.g., methane-sulfonylsulfamoylmethyl) }, an unsubstituted or substituted aryl group having from 6 to 20, preferably from 6 to 10, more preferably from 6 to 8, carbon atoms (in the case of a substituted aryl group, for example, an aryl group substituted by W described above, e.g., phenyl, 1-naphthyl, p-methoxyphenyl, p-methylphenyl, p-chlorophenyl), and an unsubstituted or substituted heterocyclic group having from 1 to 20, preferably from 3 to 10, more preferably from 4 to 8, carbon atoms (in the case of a substituted heterocyclic group, for example, a heterocyclic group substituted by W described above, e.g., 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl), 5-tetrazolyl, 5-methyl-2-thienyl, 4-methoxy-2-pyrimidyl).

In the case where the methine dye represented by formula (II), (III), (IV) or (V) is the chromophore represented by $D_1$ of formula (I), the substituents represented by $R_{11}$, $R_{12}$, $R_{13}$, $R_{14}$, $R_{15}$, $R_{16}$, $R_{17}$, $R_{18}$ and $R_{19}$ each is preferably an unsubstituted alkyl group or a substituted alkyl group. The substituted alkyl group is preferably an alkyl group having an acid radical described above. The acid radical is preferably a sulfo group, a carboxyl group, —$CONHSO_2$— group, —CONHCO— group or —$SO_2NHSO_2$— group, more preferably a sulfo group or a carboxyl group, and most preferably a sulfo group.

In the case where the methine dye represented by formula (II), (III), (IV) or (V) is the chromophore represented by $D_2$ of formula (I), the substituents represented by $R_{11}$, $R_{12}$, $R_{13}$, $R_{14}$, $R_{15}$, $R_{16}$, $R_{17}$, $R_{18}$ and $R_{19}$ each is preferably an unsubstituted alkyl group or a substituted alkyl group, more preferably an alkyl group having an acid radical described above. The acid radical is preferably a sulfo group, a carboxyl group, —$CONHSO_2$— group, —CONHCO— group or —$SO_2NHSO_2$— group, more preferably a sulfo group or a carboxyl group, and most preferably a sulfo group.

$L_{11}$, $L_{12}$, $L_{13}$, $L_{14}$, $L_{15}$, $L_{16}$, $L_{17}$, $L_{18}$, $L_{19}$, $L_{20}$, $L_{21}$, $L_{22}$, $L_{23}$, $L_{24}$, $L_{25}$, $L_{26}$, $L_{27}$, $L_{28}$, $L_{29}$, $L_{30}$, $L_{31}$, $L_{32}$ and $L_{33}$ each independently represents a methine group. The methine group represented by $L_1$ to $L_{33}$ may have a substituent. Examples of the substituent include W described above, such as a substituted or unsubstituted alkyl group having from 1 to 15, preferably from 1 to 10, more preferably from 1 to 5, carbon atoms (e.g., methyl, ethyl, 2-carboxyethyl), a substituted or unsubstituted aryl group having from 6 to 20, preferably from 6 to 15, more preferably from 6 to 10, carbon atoms (e.g., phenyl, o-carboxyphenyl), a substituted or unsubstituted heterocyclic group having from 3 to 20, preferably from 4 to 15, more preferably from 6 to 10, carbon atoms (e.g., N,N-dimethylbarbituric acid), a halogen atom (e.g., chlorine, bromine, iodine, fluorine), an alkoxy group having from 1 to 15, preferably from 1 to 10, more preferably from 1 to 5, carbon atoms (e.g., methoxy, ethoxy), an amino group having from 0 to 15, preferably from 2 to 10, more preferably from 4 to 10, carbon atoms (e.g., methylamino, N,N-dimethylamino, N-methyl-N-phenylamino, N-methylpiperazino), an alkylthio group having from 1 to 15, preferably from 1 to 10, more preferably from 1 to 5, carbon atoms (e.g., methylthio, ethylthio) and an arylthio group having from 6 to 20, preferably from 6 to 12, more preferably from 6 to 10, carbon atoms (e.g., phenylthio, p-methylphenylthio). The methine group may form a ring together with another methine group or together with $Z_{11}$ to $Z_{19}$ or $R_{11}$ to $R_{19}$.

$L_{11}$, $L_{12}$, $L_{16}$, $L_{17}$, $L_{18}$, $L_{19}$, $L_{22}$, $L_{23}$, $L_{29}$ and $L_{30}$ each is preferably an unsubstituted methine group.

$n_{11}$, $n_{12}$, $n_{13}$, $n_{14}$ and $n_{15}$ each independently represents 0, 1, 2, 3 or 4, preferably 0, 1, 2 or 3, more preferably 0, 1 or 2, still more preferably 0. or 1. When $n_{11}$, $n_{12}$, $n_{13}$, $n_{14}$ and $n_{15}$ each is 2 or more, the methine group is repeated but these methine groups need not be the same.

$p_{11}$, $p_{12}$, $p_{13}$, $p_{14}$ and $p_{15}$ each independently represents 0 or 1, preferably 0.

$M_1$, $M_{11}$, $M_{12}$, $M_{13}$ and $M_{14}$ each is included in the formulae for the purpose of showing the presence of a cation or an anion when required for neutralizing the ion charge of the dye. Typical examples of the cation include inorganic cation such as hydrogen ion ($H^+$), alkali metal ion (e.g., sodium ion, potassium ion, lithium ion) and alkaline earth metal ion (e.g., calcium ion), and organic cation such as ammonium ion (e.g., ammonium ion, tetraalkylammonium ion, triethylammonium ion, pyridinium ion, ethylpyridinium ion, 1,8-diazabicyclo[5.4.0]-7-undecenium ion). The anion may be either inorganic anion or organic anion and examples thereof include halogen anion (e.g., fluoride ion, chloride ion, iodide ion), substituted arylsulfonate ion (e.g., p-toluenesulfonate ion, p-chlorobenzenesulfonate ion), aryldisulfonate ion (e.g., 1,3-benzenesulfonate ion, 1,5-naphthalenedisulfonate ion, 2,6-naphthalenedisulfonate ion), alkylsulfate ion (e.g., methylsulfate ion), sulfate ion, thiocyanate ion, perchlorate ion, tetrafluoroborate ion, picrate ion, acetate ion and trifluoromethanesulfonate ion. Also, an ionic polymer or another dye having a charge opposite the dye may be used. When the counter ion is hydrogen ion, $CO_2^-$ and $SO_3^-$ may be denoted as $CO_2H$ and $SO_3H$, respectively.

$m_1$, $m_{11}$, $m_{12}$, $m_{13}$ and $m_{14}$ each represents a number of 0 or greater necessary for balancing the electric charge, preferably a number of from 0 to 4, more preferably from 0 to 1, and is 0 when an inner salt is formed.

Formula (AI) is described below. $Z_{51}$ represents an atomic group necessary for forming a monocyclic nitrogen-containing heterocyclic ring and this ring is not condensed with an aromatic ring. Preferred examples thereof include those described above for the basic nucleus comprising a monocyclic heterocyclic ring. Preferred nuclei among these are also the same. This heterocyclic ring may be substituted or may not be substituted but is preferably unsubstituted or substituted by an alkyl group or an acid radical, more preferably substituted by an alkyl group or an acid radical, still more preferably substituted by an acid radical. The acid radical is preferably a sulfo group, a carboxyl group, —$CONHSO_2$— group, —CONHCO— group or —$SO_2NHSO_2$— group, more preferably a sulfo group or a carboxyl group, still more preferably a sulfo group. $R_{51}$ represents a hydrogen atom, an alkyl group, an aryl group or a heterocyclic group, and examples and preferred examples thereof are the same as those described above for $R_{11}$. $Q_{51}$ represents a group necessary for allowing the compound represented by formula (AI) to form a methine dye, and examples and preferred examples thereof are the same as those described above for the methine dye chromophore. $L_{51}$ and $L_{52}$ each represents a methine group, and examples and preferred examples thereof are the same as those described above for $L_{11}$ and $L_{12}$. $p_{51}$ represents 0 or 1, preferably 0. $M_{51}$, represents an electric charge balancing counter ion and $m_{51}$ represents a number necessary for neutralizing the electric charge of the molecule. Examples and preferred examples thereof are the same as those described above for $M_{11}$ and $m_{11}$.

Formula (AII) is described below. In the Formula, $X_{51}$, $X_{52}$ and $X_{53}$ each represents an oxygen atom, a sulfur atom, a selenium atom, a nitrogen atom or a carbon atom. $X_{51}$ is preferably an oxygen atom, a sulfur atom, a nitrogen atom or a carbon atom, more preferably a sulfur atom or a carbon atom, still more preferably a carbon atom. $X_{52}$ is preferably a nitrogen atom or a carbon atom, more preferably a carbon atom. $X_{53}$ is preferably a nitrogen atom or a carbon atom, more preferably a nitrogen atom.

The bond between $X_{52}$ and $X_{53}$ may be a single bond or a double bond and is preferably a double bond. $V_{51}$, $V_{52}$ and $V_{53}$ each represents a hydrogen atom or a substituent, provided that $V_{51}$, $V_{52}$ and $V_{53}$ are not combined with each other to form an aromatic ring. $V_{51}$, $V_{52}$ and $V_{53}$ may form a ring other than an aromatic ring but are preferably not combined to form a ring. Examples of the substituent include W described above. $V_{51}$, $V_{52}$ and $V_{53}$ each is preferably a hydrogen atom or a non-aromatic substituent, more preferably a hydrogen atom, an alkyl group or an acid radical. The acid radical is preferably a sulfo group, a carboxyl group, —$CONHSO_2$— group, —CONHCO— group or —$SO_2NHSO_2$— group, more preferably a sulfo group or a carboxyl group, and most preferably a sulfo group.

In the case where the bond between $X_{52}$ and $X_{53}$ is a single bond, $q_{51}$ is 2 when $X_{51}$ is a carbon atom, 1 when $X_{51}$ is a nitrogen atom, and 0 when $X_{51}$ is other atom. $q_{52}$ is 2 when $X_{52}$ is a carbon atom, 1 when $X_{52}$ is a nitrogen atom, and 0 when $X_{52}$ is other atom. $q_{53}$ is 2 when $X_{53}$ is a carbon atom, 1 when $X_{53}$ is a nitrogen atom, and 0 when $X_{53}$ is other atom. When $q_{51}$, $q_{52}$ and $q_{53}$ each is 2, $V_{51}$, $V_{52}$ and $V_{53}$ each is repeated but repeated $V_{51}$, $V_{52}$ or $V_{53}$ need not be the same.

In the case where the bond between $X_{52}$ and $X_{53}$ is a double bond, $q_{51}$ is 2 when $X_{51}$ is a carbon atom, 1 when $X_{51}$ is a nitrogen atom, and 0 when $X_{51}$ is other atom. $q_{52}$ is 1 when $X_{52}$ is a carbon atom, and 0 when $X_{52}$ is other atom. $q_{53}$ is 1 When $X_{53}$ is a carbon atom, and 0 when $X_{53}$ is other atom. When $q_{51}$is 2, $V_{511}$ is repeated but repeated $V_{51}$ need not be the same.

Preferred examples of Formula (AII) include the following formulae (a) to (1):

(a)

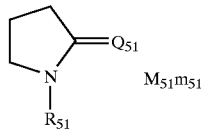

(b)

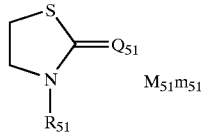

-continued (c)

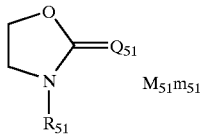

(d)

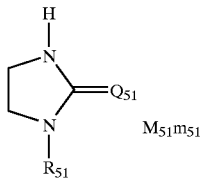

(e)

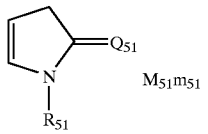

(f)

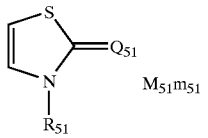

(g)

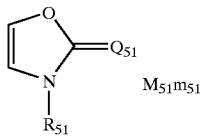

(h)

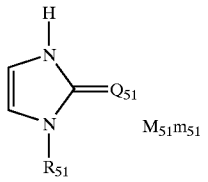

(i)

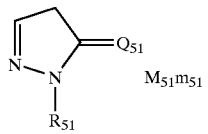

(j)

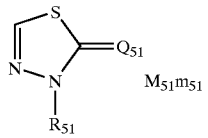

(k)

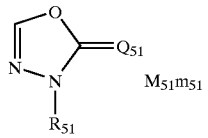

(l)

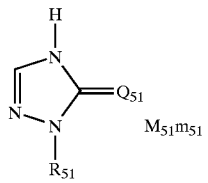

wherein $Q_{51}$, $R_{51}$, $M_{51}$ and $m_{51}$ have the same meanings as in formula (AII). In the heterocyclic rings (a) to (1), the hydrogen atom of —$CH_2$—, =CH— and —NH— may be or may not be further substituted. The substituent may be any substituent but examples thereof include W described above. The substituent is preferably a non-aromatic substituent, more preferably an alkyl group or an acid radical. These substituents are not combined with each other to form an aromatic ring. These substituents may be combined to form a ring other than an aromatic ring but are preferably not combined to form a ring.

In (a) to (1), among the group of (a) to (d), the group of (e) to (h) and the group (i) to (1), the group of (e) to (h) and the group of (i) to (1) are preferred, and the group (i) to (1) is more preferred. In the group of (a) to (d), preferred are (a) and (b), more preferred, is (a). In the group (e) to (h), preferred are (e) and (f), more preferred is (e). In the group (i) to (1), preferred are (i) and (j), more preferred is (i).

The compound of formula (AII) is most preferably represented by the following formula (m) or (n):

(m)

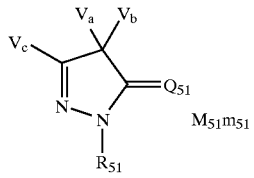

(n)

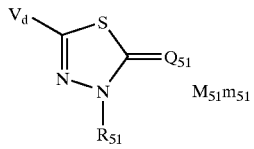

wherein $Q_{51}$, $R_{51}$, $M_{51}$ and $m_{51}$ have the same meanings as in formula (VII) and $V_a$, $V_b$ and $V_c$ each represents a hydrogen atom or a substituent. The substituent may be any substituent but examples thereof include W described above. $V_a$, $V_b$ and $V_c$ each preferably represents a hydrogen atom or a non-aromatic substituent, more preferably an alkyl group (which may be substituted), still more preferably an unsubstituted alkyl group (preferably an unsubstituted alkyl group having from 1 to 4 carbon atoms), and most preferably a methyl group. Between formulae (m) and (n), preferred is formula (m).

Out of the dyes for use in the present invention described in detail in the foregoing pages, specific examples of only dyes which are used in preferred embodiments are set forth below, however, the present invention is of course not limited thereto.

Specific examples of $D_1$- for use in the present invention are set forth below.

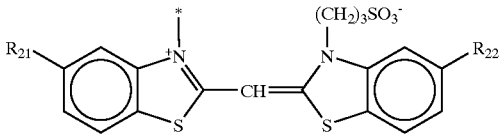
| | $R_{21}$ | $R_{22}$ |
|---|---|---|
| DA-1 | —Ph | —Cl |
| DA-2 | —Cl | —Cl |
| DA-3 | —Ph | —Ph |
| DA-4 | —Cl | —H |
| DA-5 | 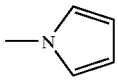 | —Cl |
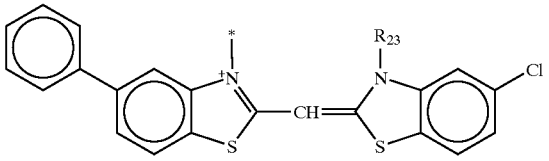
| | $R_{23}$ |
|---|---|
| DA-6 | $-(CH_2)_4-SO_3^-$ |
| DA-7 | $-(CH_2)_2-CH(CH_3)SO_3^-$ |
| DA-8 | —C2H5 |
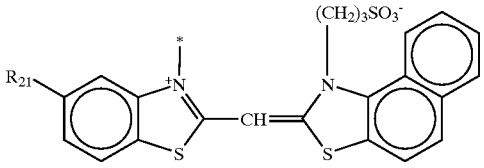
| | $R_{21}$ |
|---|---|
| DA-9 | —Cl |
| DA-10 | $—OCH_3$ |
DA-11
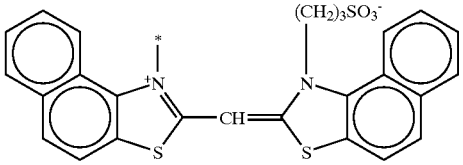
DA-12
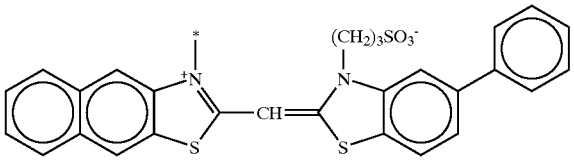
DA-13
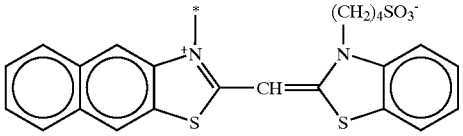

-continued
DA-14
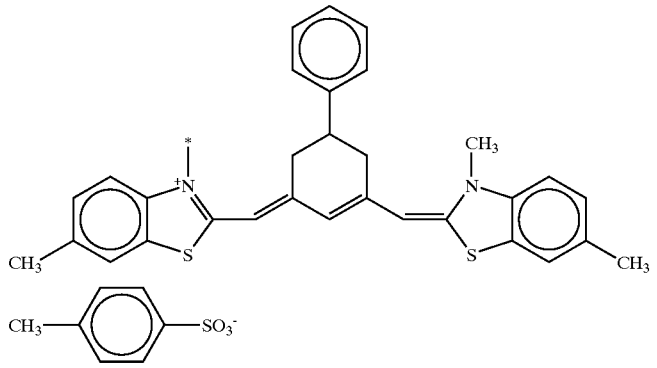
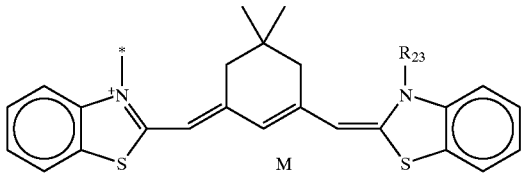
| | $R_{23}$ | M |
|---|---|---|
| DA-15 | $—C_2H_5$ | $I^-$ |
| DA-16 | $—(CH_2)_3—SO_3^-$ | — |
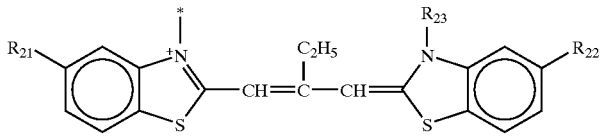
| | $R_{21}$ | $R_{22}$ | $R_{23}$ |
|---|---|---|---|
| DA-17 | —Cl | —Cl | $—(CH_2)—SO_3^-$ |
| DA-18 | $—CH_3$ | $—CH_3$ | $—(CH_2)—SO_3^-$ |
| DA-19 | —Cl | —Cl | $—CH_2CONH—(CH_2)—SO_3^-$ |
| DA-20 | —Cl | —Cl | $—CH_2CH(OH)CH_2SO_3^-$ |
DA-21
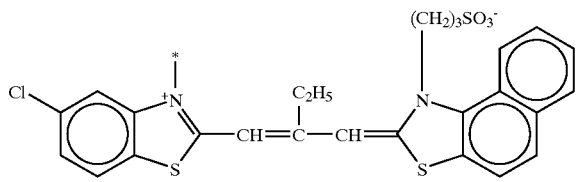
DA-22
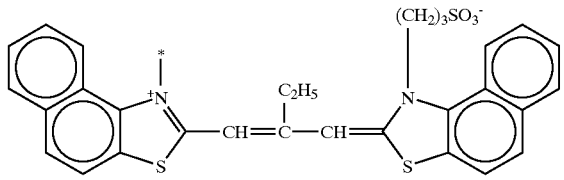

-continued
DA-23
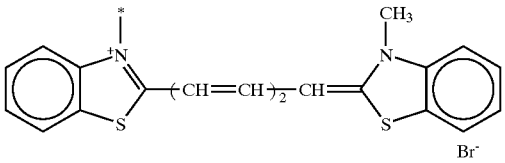
| | $n_{21}$ |
|---|---|
| DA-24 | 1 |
| DA-25 | 2 |
| | $n_{22}$ |
|---|---|
| DA-26 | 0 |
| DA-27 | 1 |
| DA-28 | 2 |
DA-29
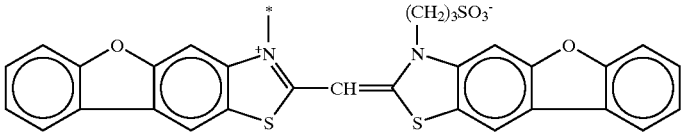
DA-30
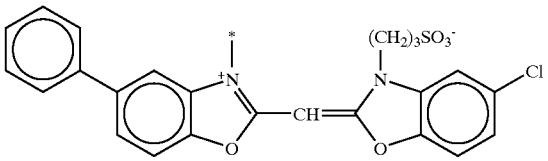
DA-31
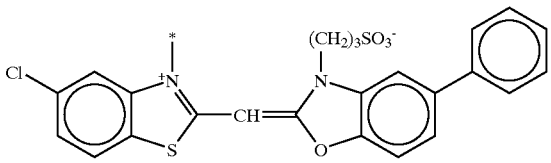
DA-32
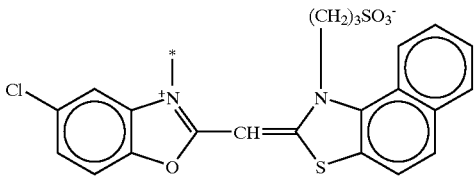

-continued
DA-33
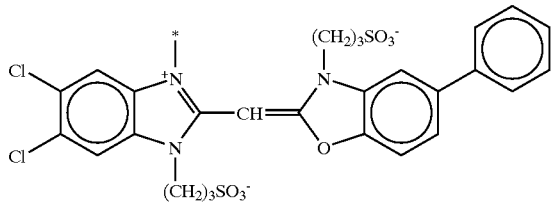
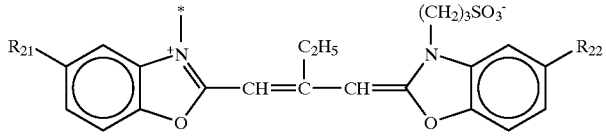
| | $R_{21}$ | $R_{22}$ |
|---|---|---|
| DA-34 | —Br | —Br |
| DA-35 | —Ph | —Cl |
| DA-36 | —Cl | —Cl |
| DA-37 | —Ph | —Ph |
DA-38
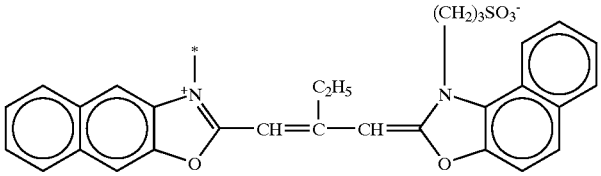
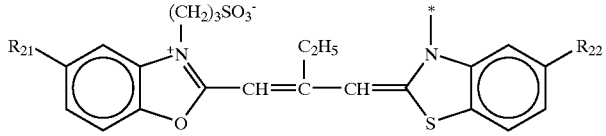
| | $R_{21}$ | $R_{22}$ |
|---|---|---|
| DA-39 | —Cl | —Cl |
| DA-40 | —Ph | —$CH_3$ |
| DA-41 | —$OCH_3$ | —$CH_3$ |
DA-42
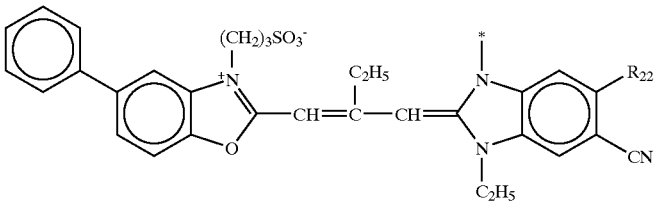
DA-43
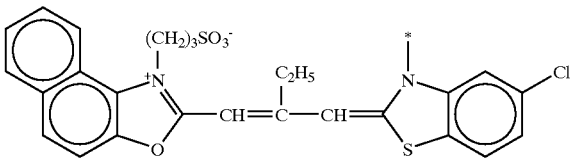
DA-44
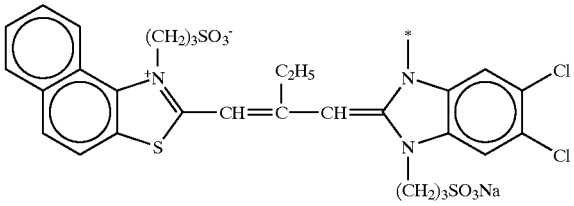

-continued
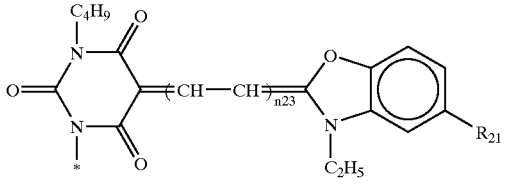
| | $n_{23}$ | $R_{21}$ |
|---|---|---|
| DA-45 | 1 | H |
| DA-46 | 1 | —$SO_3Na$ |
| DA-47 | 2 | H |
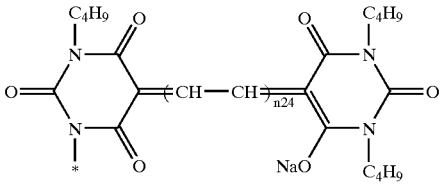
| | $n_{24}$ |
|---|---|
| DA-48 | 0 |
| DA-49 | 1 |
| DA-50 | 2 |
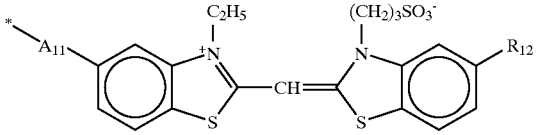
| | $A_{11}$ | $R_{12}$ |
|---|---|---|
| DA-51 | —O— | —Ph |
| DA-52 | —OC(=O)— | " |
| DA-53 | —NHCO— | " |
| DA-54 | —$NHSO_2$— | " |
| DA-55 | —CONH— | " |
| DA-56 | —$SO_2NH$— | " |
| DA-57 | —NHCO— | —Cl |
DA-58
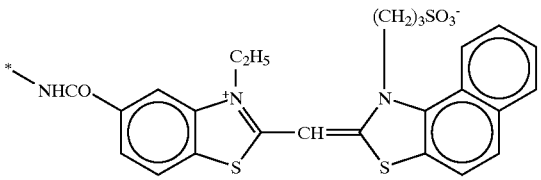
DA-59
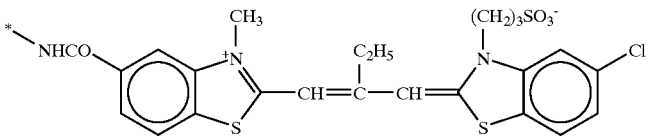

-continued
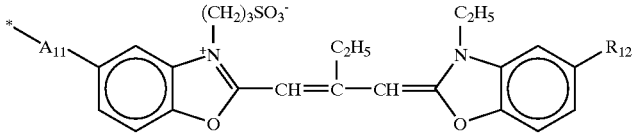
| | $A_{11}$ | $R_{12}$ |
|---|---|---|
| DA-60 | —NHCO— | —Br |
| DA-61 | —CONH— | —Cl |
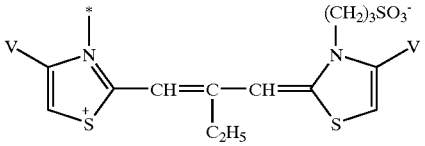
| | V |
|---|---|
| DA-62 | Br |
| DA-63 | 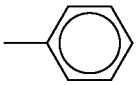 |
| DA-64 | I |
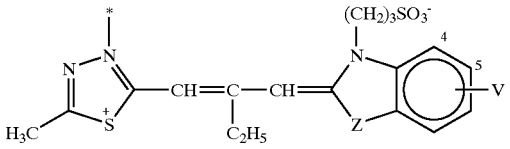
| | Z | V |
|---|---|---|
| DA-65 | S | 4,5-ベンゾ |
| DA-66 | S | 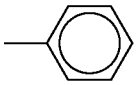 |
| DA-67 | O | 4,5-ベンゾ |
| DA-68 | O | 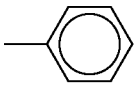 |

-continued
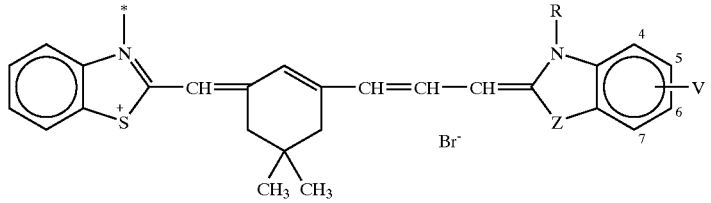
| | Z | R | V |
|---|---|---|---|
| DA-69 | S | $C_2H_5$ | 6-$OCH_3$ |
| DA-70 | O | 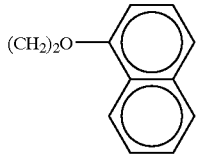 | 5,6-$(CH_3)_2$ |
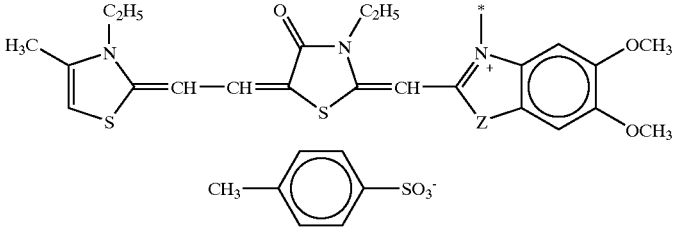
| | Z |
|---|---|
| DA-71 | S |
| DA-72 | O |
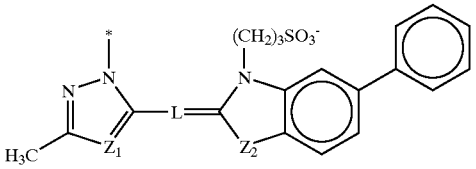
| | $Z_1$ | L | $Z_2$ |
|---|---|---|---|
| DA-73 | S | —CH= | S |
| DA-74 | $C(CH_3)_2$ | —CH= | S |
| DA-75 | S | —CH=C($C_2H_5$)—CH= | Se |
| DA-76 | $NCH_3$ | —CH=C($C_2H_5$)—CH= | O |
| DA-77 | $C(CH_3)_2$ | —CH=C($C_2H_5$)—CH= | S |
| DA-78 | O | —CH=C($C_2H_5$)—CH= | S |
| DA-79 | Se | —CH=C($C_2H_5$)—CH= | O |

-continued
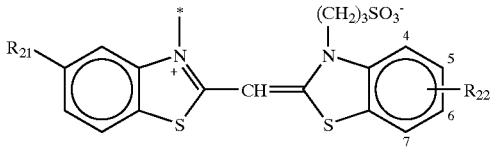
| | $R_{21}$ | $R_{22}$ |
|---|---|---|
| DA-80 | —Br | 4,5-benzo |
| DA-81 | —Ph | 4,5-benzo |
| DA-82 | 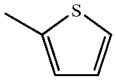 | 5-Cl |
| DA-83 | 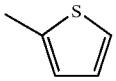 | 5-Br |
| DA-84 | 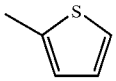 | 5-Ph |
| DA-85 | 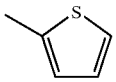 | 5-I |
Ph = 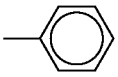
Specific examples of $-D_2$ for use in the present invention are set forth below.
Examples of $-D_2$ Residue
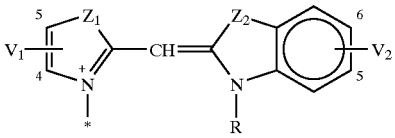
| | $Z_1$ | $Z_2$ | $V_1$ | $V_2$ | R |
|---|---|---|---|---|---|
| DB-1 | S | S | 4-$SO_3^-$ | 5-$SO_3Na$ | $C_2H_5$ |
| DB-2 | S | O | H | 5-$SO_3^-$ | $C_2H_5$ |
| DB-3 | O | S | H | 6-$SO_3^-$ | $(CH_2)_3SO_3Na$ |
| DB-4 | S | Se | 4-$CH_3$ | 6-$CO_2H$ | $(CH_2)_3SO_3^-$ |
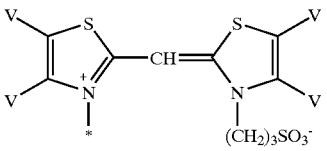
| | V |
|---|---|
| DB-5 | OH |
| DB-6 | $OCH_3$ |

-continued

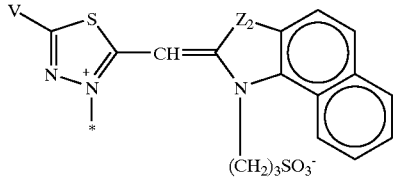

| | V | $Z_2$ |
|---|---|---|
| DB-7 | $SO_3K$ | S |
| DB-8 | $CH_3$ | O |

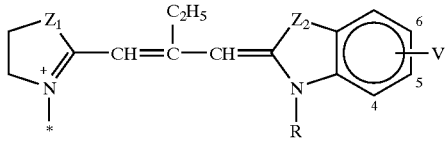

| | $Z_1$ | $Z_2$ | V | R |
|---|---|---|---|---|
| DB-9 | S | O | 5-$SO_3^-$ | $(CH_2)_3SO_3Na$ |
| DB-10 | O | S | 6-$SO_3^-$ | $C_2H_5$ |
| DB-11 | S | O | 5,6-benzo | $(CH_2)_3SO_3^-$ |

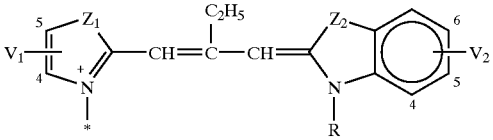

| | $Z_1$ | $Z_2$ | $V_1$ | $V_2$ | R |
|---|---|---|---|---|---|
| DB-12 | O | S | 4-$CH_3$ | 5-$SO_3^-$ | $C_2H_5$ |
| DB-13 | S | S | 4-$CH_3$ | 6-$SO_3^-$ | $(CH_2)_3SO_3Na$ |
| DB-14 | S | O | 5-$SO_3^-$ | 5,6-benzo | $(CH_2)_2SO_3Na$ |
| DB-15 | S | S | 4-OH | 6-$SO_3^-$ | $(CH_2)_4SO_3K$ |
| DB-16 | O | N—$C_2H_5$ | 4-$CH_3$ | 5,6-$Cl_2$ | $(CH_2)_4SO_3K$ |
| DB-17 | O | O | 5-$CH_2OH$ | 6-$CO_2^-$ | $CH_2CO_2H$ |
| DB-18 | S | S | 5-$CH_3$ | 6-$SO_3^-$ | $CH_2CONHSO_2CH_3$ |

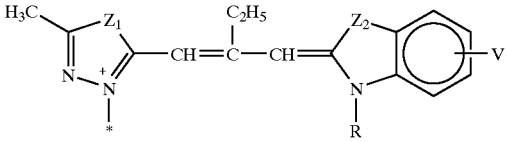

| | $Z_1$ | $Z_2$ | V | R |
|---|---|---|---|---|
| DB-19 | S | O | 5,6-benzo | $CH_2CO_2^-$ |
| DB-20 | S | S | 6-$SO_3^-$ | $(CH_2)_3SO_3Na$ |
| DB-21 | S | Se | 6-$SO_3^-$ | $(CH_2)_2CH(CH_3)SO_3K$ |
| DB-22 | O | O | 5-$SO_3^-$ | $(CH_2)_2OSO_3Na$ |
| DB-23 | 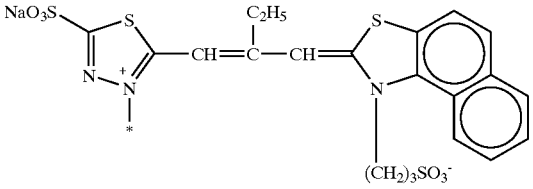 | | | |

-continued
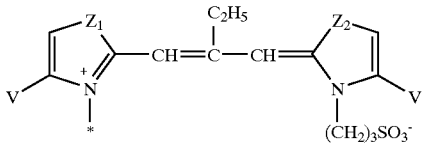
| | $Z_1$ | $Z_2$ | V |
|---|---|---|---|
| DB-24 | S | S | $CH_3$ |
| DB-25 | O | O | $SO_3Na$ |
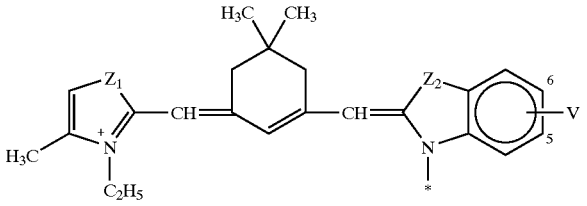
| | $Z_1$ | $Z_2$ | V |
|---|---|---|---|
| DB-26 | S | S | 5-$SO_3^-$ |
| DB-27 | S | O | 5-$SO_3^-$ |
| DB-28 | O | Se | 5-$SO_3^-$ |
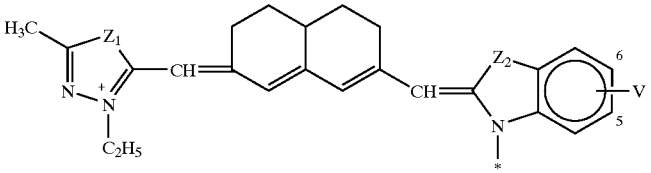
| | $Z_1$ | $Z_2$ | V |
|---|---|---|---|
| DB-29 | S | S | 5-$SO_3^-$ |
| DB-30 | O | O | 5-$SO_3^-$ |
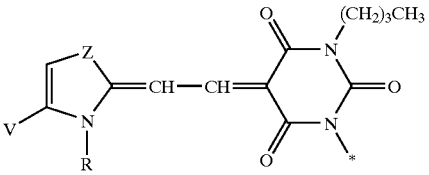
| | Z | V | R |
|---|---|---|---|
| DB-31 | S | $CH_3$ | $(CH_2)_3SO_3Na$ |
| DB-32 | O | $SO_3Na$ | $C_2H_5$ |
| DB-33 | S | $SO_3Na$ | $C_2H_5$ |
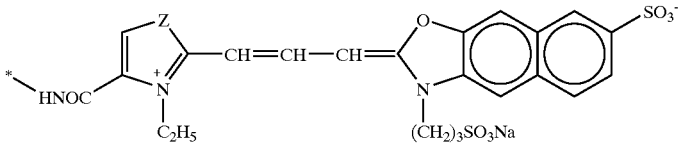
| | Z |
|---|---|
| DB-34 | S |
| DB-35 | O |

-continued
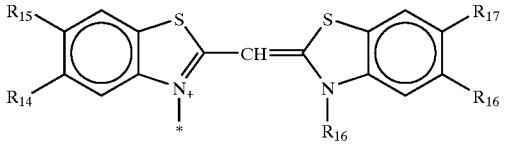
| | $R_{14}$ | $R_{15}$ | $R_{16}$ | $R_{17}$ | $R_{18}$ |
|---|---|---|---|---|---|
| DB-36 | $—SO_3^-$ | H | H | $—SO_3Na$ | $—C_2H_5$ |
| DB-37 | $—SO_3Na$ | H | H | $—SO_3Na$ | $—(CH_2)_3SO_3^-$ |
| DB-38 | H | H | H | $—SO_3Na$ | $—(CH_2)_3SO_3^-$ |
| DB-39 | H | $—O—(CH_2)_4SO_3Na$ | H | H | $—(CH_2)_3SO_3^-$ |
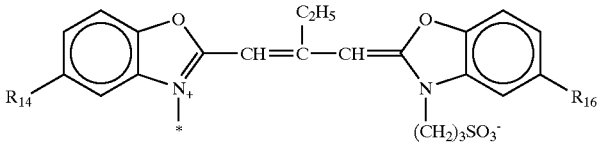
| | $R_{14}$ | $R_{16}$ |
|---|---|---|
| DB-40 | $—SO_3Na$ | $—SO_3Na$ |
| DB-41 | —Cl | $—OPO_3Na_2$ |
| DB-42 | H | $—O—(CH_2)_3SO_3K$ |
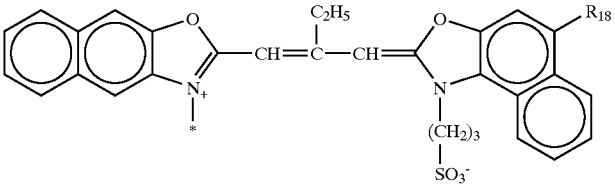
| | $R_{18}$ |
|---|---|
| DB-43 | H |
| DB-44 | $—SO_3Na$ |
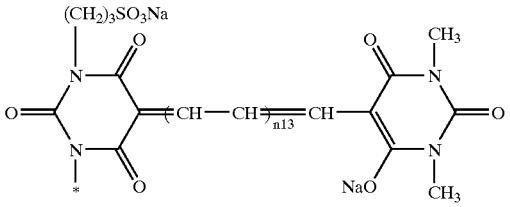
| | n13 |
|---|---|
| DB-45 | 0 |
| DB-46 | 1 |
| DB-47 | 2 |

-continued
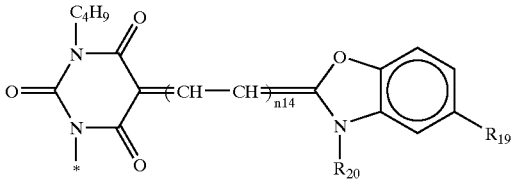
| | n14 | $R_{19}$ | $R_{20}$ |
|---|---|---|---|
| DB-48 | 1 | —$SO_3Na$ | —$C_2H_5$ |
| DB-49 | 2 | —$SO_3Na$ | —$C_2H_5$ |
DB-50
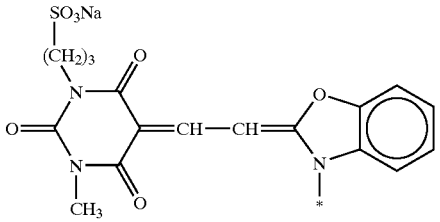
DB-51
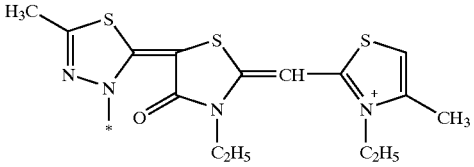
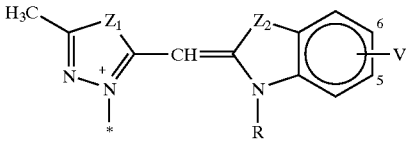
| | $Z_1$ | $Z_2$ | R | V |
|---|---|---|---|---|
| DB-52 | S | S | $(CH_2)_3SO_3^-$ | 6-$SO_3Na$ |
| DB-53 | $C(CH_3)_2$ | S | $(CH_2)_3SO_3^-$ | 6-$SO_3Na$ |
| DB-54 | O | S | $C_2H_5$ | 5-$SO_3^-$ |
| DB-55 | $C(CH_3)_2$ | O | $C_2H_5$ | 5-$SO_3^-$ |
| DB-56 | $NC_2H_5$ | S | $(CH_2)_4SO_3^-$ | 6-$SO_3Na$ |
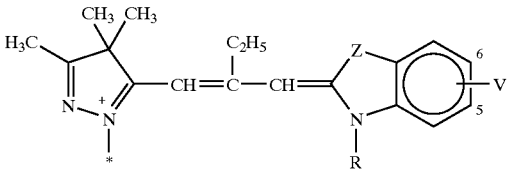
| | Z | R | V |
|---|---|---|---|
| DB-57 | S | $(CH_2)_3SO_3^-$ | 6-$SO_3Na$ |
| DB-58 | S | $C_2H_5$ | 6-$SO_3^-$ |
| DB-59 | O | $C_2H_5$ | 5-$SO_3^-$ |
| DB-60 | N—$C_2H_5$ | $(CH_2)_4SO_3^-$ | 5-$SO_3Na$ |
| DB-61 | S | $(CH_2)_3SO_3^-$ | 5-OH |

-continued
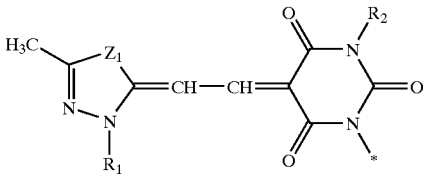
| | $Z_1$ | $R_1$ | $R_2$ |
|---|---|---|---|
| DB-62 | S | $(CH_2)_3SO_3Na$ | $(CH_2)_3CH_3$ |
| DB-63 | S | $C_2H_5$ | $C_2H_5$ |
| DB-64 | S | $C_2H_5$ | 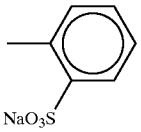 |
| DB-65 | $C(CH_3)_2$ | $(CH_2)_3SO_3Na$ | $(CH_2)_3CH_3$ |
| DB-66 | $C(CH_3)_2$ | $C_2H_5$ | $(CH_2)_3CH_3$ |
| DB-67 | $C(CH_3)_2$ | $(CH_2)_3SO_3Na$ | 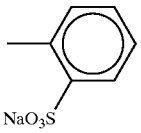 |
| DB-68 | $C(CH_3)_2$ | $C_2H_5$ | 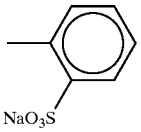 |
| DB-69 | O | $(CH_2)_3SO_3Na$ | $C_2H_5$ |
| DB-70 | $NCH_3$ | $(CH_2)_3SO_3Na$ | $CH_3$ |
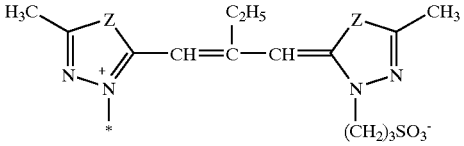
| | Z |
|---|---|
| DB-71 | S |
| DB-72 | $C(CH_3)_2$ |
DB-73
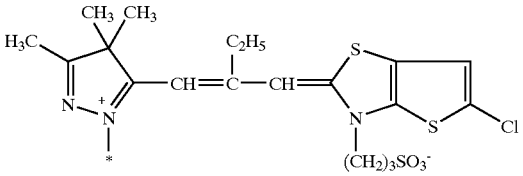
DB-74
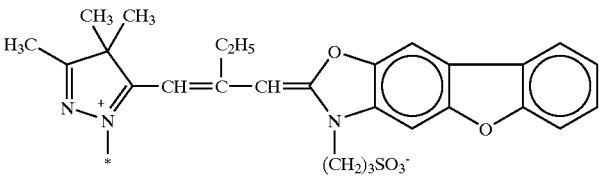

-continued
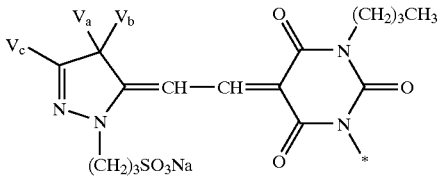
| | $V_a$ | $V_b$ | $V_c$ |
|---|---|---|---|
| DB-75 | $C_2H_5$ | H | H |
| DB-76 | $CH_3$ | $CH_3$ | H |
| DB-77 | | $-(CH_2)_5-$ | $CH_3$ |
| DB-78 | $CH_2SO_3Na$ | $CH_3$ | $CH_3$ |
| DB-79 | $CH_3$ | $CH_3$ | $SO_3Na$ |
Specific examples of La for use in the present invention are set forth below.
Examples of Linking Chain —La— ($D_1$ in the left side)
L-1 $-(CH_2)_4-$
L-2 $-(CH_2)_8-$
L-3 $-(CH_2)_7-CH=CH-(CH_2)_7-$
L-4
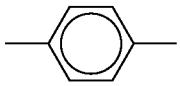
L-5
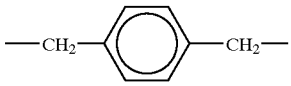
L-6
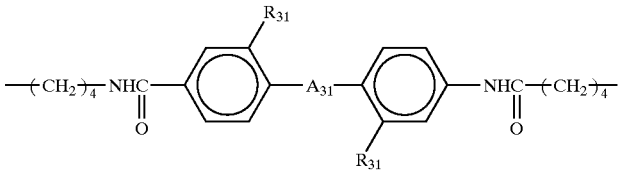
| | $A_{31}$ | $R_{31}$ |
|---|---|---|
| L-6 | — | H |
| L-7 | — | $-SO_3^-\cdot\overset{+}{H}NEt(i\text{-}Pr)_2$ |
| L-8 | —O— | H |
| L-9 | —O— | $-SO_3Na$ |
| L-10 | $-SO_2-$ | H |
L-11
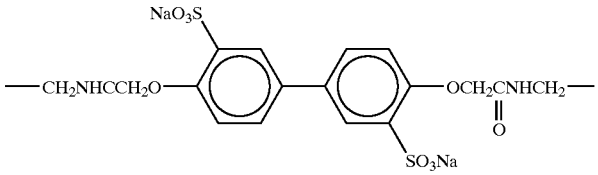

-continued
L-12
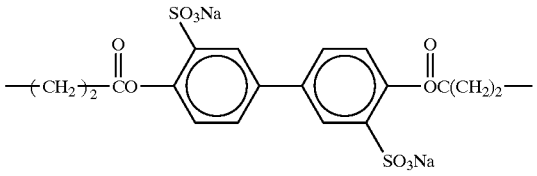
L-13
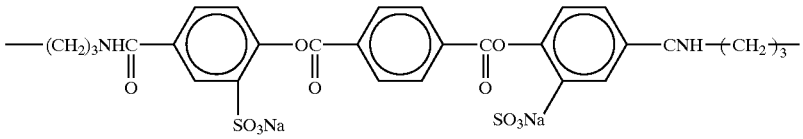
L-14
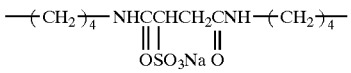
L-15
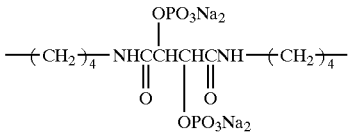
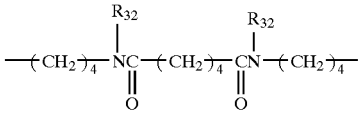
| | $R_{32}$ |
|---|---|
| L-16 | $-(CH_2)_3-SO_3Na$ |
| L-17 | $-(CH_2)_2-COONa$ |
| L-18 | $-(CH_2)_2-PO_3Na_2$ |
L-19
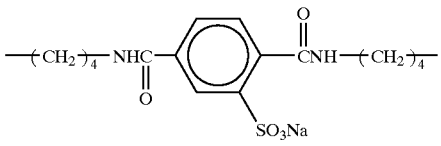
| | $n_{31}$ | $n_{32}$ |
|---|---|---|
| L-20 | 4 | 5 |
| L-21 | 8 | 5 |
| L-22 | 8 | 1 |
| L-23 | 4 | 3 |
| L-24 | 4 | 1 |
L-25
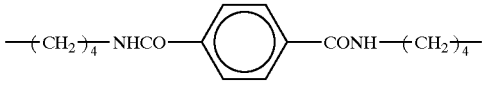
L-26 $-(CH_2)_4-NHCO-(CH_2)_2-CONH-(CH_2)_4-$ -continued $$-(CH_2)_{n33}-\underset{\underset{O}{\|}}{C}NH-(CH_2)_{n34}-$$

| | $n_{33}$ | $n_{34}$ |
|---|---|---|
| L-27 | 5 | 4 |
| L-28 | 5 | 8 |
| L-29 | 1 | 6 |

L-30 $-(CH_2)_6-\underset{\underset{O}{\|}}{C}O-(CH_2)_5-$

L-31 $-(CH_2)_5-\underset{\underset{O}{\|}}{C}O-(CH_2)_6-$

L-32 $-(CH_2)_8-NHSO_2-(CH_2)_3-$ $$-(CH_2)_2-(OCH_2CH_2)_{n35}-NH\underset{\underset{O}{\|}}{C}-(CH_2)_{n36}-$$

| | $n_{35}$ | $n_{36}$ |
|---|---|---|
| L-33 | 2 | 5 |
| L-34 | 2 | 1 |
| L-35 | 3 | 1 |

$$-(CH_2)_2-(OCH_2CH_2)_{n37}-\underset{\underset{O}{\|}}{C}NH-(CH_2)_{n38}-$$

| | $n_{37}$ | $n_{38}$ |
|---|---|---|
| L-36 | 2 | 3 |
| L-37 | 2 | 4 |
| L-38 | 2 | 8 |

L-39 $-(CH_2)_3-\underset{\underset{O}{\|}}{C}NH-(CH_2)_2-(OCH_2CH_2)_2-CONH-(CH_2)_3-$ L-40 $-(CH_2)_4-NH\underset{\underset{O}{\|}}{C}-(CH_2CH_2O)_2-(CH_2)_2-$ L-41 $-(CH_2)_5-\underset{\underset{O}{\|}}{C}-NH-(CH_2CH_2O)_2-(CH_2)_2-$

L-42

$$-(CH_2)_2-(OCH_2CH_2)_2-O\overset{\overset{O}{\|}}{C}-(CH_2)_5-$$

L-43 $-(CH_2)_2-(OCH_2CH_2)_2-NHSO_2-(CH_2)_3-$

-continued

| | $-(CH_2)_2-A_{32}CH_2CH_2-NHCO-(CH_2)_5-$ |
|---|---|
| | $A_{32}$ |
| L-44 | —S— |
| L-45 | $-N(CH_3)-$ |
| L-46 | $-CH(OH)-$ |
| L-47 | $-(CH_2)_2-SO_2-(CH_2)_2-NHCO-(CH_2)_5-$ |
| L-48 | — |

Specific examples of the dye represented by formula (I) for use in the present invention are set forth below.

Specific Examples of Dye $D_1$-La-$D_2$ of the Present Invention

| No. | $D_1$-La-$D_2$ | | |
|---|---|---|---|
| (1) | DA-1 | L-27 | DB-1 |
| (2) | DA-9 | L-33 | DB-7 |
| (3) | DA-37 | L-39 | DB-9 |
| (4) | DA-39 | L-37 | DB-12 |
| (5) | DA-17 | L-28 | DB-20 |
| (6) | DA-18 | L-27 | DB-23 |
| (7) | DA-9 | L-34 | DB-33 |
| (8) | DA-10 | L-43 | DB-5 |
| (9) | DA-14 | L-36 | DB-26 |
| (10) | DA-70 | L-28 | DB-30 |
| (11) | DA-65 | L-29 | DB-12 |
| (12) | DA-65 | L-43 | DB-40 |
| (13) | DA-1 | L-27 | DB-31 |
| (14) | DA-3 | L-35 | DB-32 |
| (15) | DA-71 | L-23 | DB-27 |
| (16) | DA-81 | L-33 | DB-52 |
| (17) | DA-81 | L-35 | DB-53 |
| (18) | DA-81 | L-34 | DB-62 |
| (19) | DA-81 | L-34 | DB-65 |
| (20) | DA-81 | L-34 | DB-66 |
| (21) | DA-81 | L-33 | DB-67 |
| (22) | DA-81 | L-27 | DB-68 |
| (23) | DA-92 | L-34 | DB-65 |
| (24) | DA-84 | L-34 | DB-65 |
| (25) | DA-38 | L-33 | DB-59 |
| (26) | DA-17 | L-37 | DB-57 |

The dyes of the present invention can be synthesized by the methods described in F. M. Harmer, *Heterocyclic Compounds—Cyanine Dyes and Related Compounds*, John, Wiley & Sons, New York, London (1964), D. M. Sturmer, *Heterooyclic Compounds—Special tonics in heterocyclic chemistry*, Chap. 18, Sec. 14, pp. 482–515, John Wiley & Sons, New York, London (1977), *Rodd's Chemistry of Carbon Compounds*, 2nd ed., Vol. IV, Part B, Chap. 15, pp. 369–422, Elsevier Science Publishing Company Inc., New York (1977).

In the present invention, not only the sensitizing dyes of the present invention but also a sensitizing dye other than those of the present invention can be used in combination. Preferred examples of the dye which can be used in combination include cyanine dyes, merocyanine dyes, rhodacyanine dyes, trinuclear merocyanine dyes, tetranuclear merocyanine dyes, allopolar dyes, hemilcyanine dyes and styryl dyes. Among these, more preferred are cyanine dyes, merocyanine dyes and rhodacyanine dyes, still more preferred are cyanine dyes. These dyes are described in detail in F. M. Harmer, *Heterocyclic Compounds—Cyanine Dyes and Related Compounds*, John Wiley & Sons, New York, London (1964), D. M. Sturmer, *Heterocyclic Compounds—Special topics in heterocyclic chemistry*, Chap. 18, Section 14, pp. 482–515.

Examples of preferred dyes include the sensitizing dyes represented by the formulae or described as specific examples in U.S. Pat. No. 5,994,051, pp. 32–44, and U.S. Pat. No. 5,747,236, pp. 30–39.

Examples of the formulae for preferred cyanine dyes, merocyanine dyes and rhodacyanine dyes include formulae (XI), (XII) and (XIII) described in U.S. Pat. No. 5,340,694, columns 21 to 22 (where, however, the numbers of n12, n15, n17 and n18 are not limited and each is an integer of 0 or more (preferably 4 or less).

These sensitizing dyes may be used either individually or in combination of two or more thereof. The combination of sensitizing dyes is often used for the purpose of supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,303,377, 3,769,301, 3,814,609, 3,837,862 and 4,026,707, British Patents 1,344,281 and 1,507,803!, JP-B-43-49336 (the term "JP-B" as used herein means an "examined Japanese patent publication") and JP-B-53-12375, JP-A-52-110618 and JP-A-52-109925.

Together with the sensitizing dye, a dye which itself has no spectral sensitization effect or a substance which absorbs substantially no visible light, but which exhibits supersensitization may be contained in the emulsion.

Examples of the supersensitizing agent (for example, pyrimidylamino compounds, triazinylamino compounds, azolium compounds, aminostyryl compounds, aromatic organic formaldehyde condensates, azaindene compounds and cadmium salts) useful for the spectral sensitization of the present invention and examples of the combination of a supersensitizing agent with a sensitizing dye are described in U.S. Pat. Nos. 3,511,664, 3,615,613, 3,615,632, 3,615,641, 4,596,767, 4,945,038, 4,965,182, 2,933,390, 3,635,721, 3,743,510, 3,617,295 and 3,635,721. With respect to the use method thereof, those described in these patents are also preferred.

The sensitizing dyes (the same applies to other sensitizing dyes and supersensitizing agents) of the present invention may be added to the silver halide emulsion for use in the present invention in any process during the preparation of the emulsion, which has been heretofore recognized as useful. The addition may be performed at any time or step as long as it is before the. coating of the emulsion, for example, during the formation and/or before the desalting of silver halide grains, during the desalting and/or after the desalting but before the initiation of chemical ripening as disclosed in U.S. Pat. Nos. 2,735,766, 3,628,960, 4,183,756 and 4,225,666, JP-A-58-184142 and JP-A-60-196749, immediately before or during the chemical ripening, or after the chemical ripening but before the coating as disclosed in JP-A-58-113920. Also, as disclosed in U.S. Pat. No. 4,225,666 and JP-A-58-7629, the same compound solely or in combination with a compound having a different structure may be added in parts, for example, during the grain formation and during or after the completion of chemical ripening, or before or during the chemical ripening and after the completion of chemical ripening. When added in parts, the kind of the compounds or the combination of compounds may be varied.

The amount added of the sensitizing dye (the same applies to other sensitizing dyes and supersensitizing dyes) for use in the present invention varies depending on the shape and size of silver halide grain and the sensitizing dye may be added in any amount, however, the sensitizing dye can be preferably used in an amount of $1\times10^{-8}$ to $8\times10^{-1}$ mol, more preferably from $1\times10^{-7}$ to $8\times10^{-2}$ mol, per mol of silver halide. For example, when the silver halide grain size is from 0.2 to 1.3 $\mu$m the amount added is preferably from $2\times10^{-6}$ to $3.5\times^{-3}$ mol, more preferably from $7.5\times10^{-6}$ to $1.5\times10^{-3}$ mol, per mol of silver halide.

However, the sensitizing dye is preferably added in an amount large enough to allow the dye chromophores of the linked dye for use in the present invention to adsorb in multiple layers.

The sensitizing dye of the present invention (the same applies to other sensitizing dyes and supersensitizing dyes) for use in the present invention can be dispersed directly in the emulsion or can be added to the emulsion in the form of a solution after dissolving the dye in an appropriate solvent such as methyl alcohol, ethyl alcohol, methyl cellosolve, acetone, water or pyridine or in a mixed solvent thereof. At this time, additives such as base, acid or surfactant can be added and allowed to be present together. For the dissolving, an ultrasonic wave may also be used. With respect to the method for adding these compounds, a method of dissolving the compound in a volatile organic solvent, dispersing the solution in a hydrophilic colloid and adding the dispersion to the emulsion described in U.S. Pat. No. 3,469,987, a method of dispersing the compound in a water-soluble solvent and adding the dispersion to the emulsion described in JP-B-46-24185, a method of dissolving the compound in a surfactant and adding the solution to the emulsion described in U.S. Pat. No. 3,822,135, a method of dissolving the compound using a compound capable of red shifting and adding the solution to the emulsion described in JP-A-51-74624, and a method of dissolving the compound in an acid substantially free of water and adding the solution to the emulsion described in JP-A-50-80826 may be used. In addition, for the addition to the emulsion, the methods described in U.S. Pat. Nos. 2,912,343, 3,342,605, 2,996,287 and 3,429,935 may be used.

The multilayer adsorption is described below. The term "multilayer adsorption" as used in the present invention means that the dye chromophore is stacked in two or more layers on the surface of a silver halide grain. In the present invention, multilayer adsorption is preferred.

In the present invention, the light absorption intensity is an integrated intensity of light absorption by a sensitizing dye per the unit grain surface area and defined as a value obtained by, assuming that the quantity of light incident on the unit surface area of a grain is $I_0$ and the quantity of light absorbed into a sensitizing dye on the surface is I, integrating the optical density $\mathrm{Log}(I_0/(I_0-I))$ with respect to the wave number ($cm^{-1}$). The integration range is from 5,000 $cm^{-1}$ to 35,000 $cm^{-1}$.

The silver halide photographic emulsion for use in the present invention preferably contains a silver halide grain having a light absorption intensity of 100 or more in the case of a grain having a spectral absorption maximum wavelength of 500 nm or more, or having a light absorption intensity of 60 or more in the case of a grain having a spectral absorption maximum wavelength of less than 500 nm, in a proportion of a half or more of the entire projected area of all silver halide grains. In the case of a grain having a spectral absorption maximum wavelength of 500 nm or more, the light absorption intensity is preferably 150 or more, more preferably 170 or more, still more preferably 200 or more. In the case of a grain having a spectral absorption maximum wavelength of less than 500 nm;, the light absorption intensity is preferably 90 or more, more preferably 100 or more, still more preferably 120 or more. The upper bound is not particularly limited but it is preferably 2,000 or less, more preferably 1,000 or less, still more preferably 500 or less.

The spectral absorption maximum wavelength of a grain having a spectral absorption maximum wavelength of less than 500 nm is preferably 350 nm or more.

One example of the method for measuring the light absorption intensity is a method using a microspectrophotometer. The microspectrophotometer is a device capable of measuring the absorption spectrum of a microscopic area and can measure the transmission spectrum of one grain. The measurement of absorption spectrum of one grain by the microspectrometry is described in the report by Yamashita et al. (see, Nippon Shashin Gakkai, 1996 *Nendo Nenji Taikai Ko'en Yoshi Shu (Lecture Summary at Annual Meeting of Japan Photographic Association in* 1996), page 15). From this absorption spectrum, an absorption intensity per one grain can be obtained, however, the light transmitted through the grain is absorbed on two faces of upper face and lower face, therefore, the absorption intensity per unit are on the grain surface can be obtained as a half (½) of the absorption intensity per one grain obtained by the above-described method. At this time, the segment for the integration of absorption spectrum is from 5,000 to 35,000 $cm^{-1}$ in the definition, however, in experiments, the integration may be performed in the segment containing the region of 500 $cm^{-1}$ shorter or longer than the segment having absorption by the sensitizing dye.

The light absorption intensity is a value indiscriminately determined by the oscillator strength of sensitizing dye and the number of molecules adsorbed per unit area and therefore, when the oscillator strength of sensitizing dye, the amount of dye adsorbed and the surface area of grain are obtained, the values obtained can be converted into the light absorption intensity.

The oscillator strength of sensitizing dye can be experimentally obtained as a value in proportion to the absorption integrated intensity (optical density$\times cm^{-1}$) of a sensitizing dye solution. Therefore, assuming that the absorption integrated intensity of a dye per 1 M is A (optical density$\times cm^{-1}$), the amount of sensitizing dye adsorbed is B (mol/mol-Ag)

and the surface area of grain is C ($m^2$/mol-Ag), the light absorption intensity can be obtained according to the following formula within an error of about 10%:

$$0.156 \times A \times B/C$$

The light absorption intensity calculated from this formula is substantially the same as the light absorption intensity measured based on the above-described definition (a value obtained by the integration of $Log(I_0/(I_0--I))$ with respect to the wave number ($cm^{-1}$)).

For increasing the light absorption intensity, multilayer adsorption as in the present invention is effective.

The multilayer adsorption is described in detail below. The state where the dye chromophore is adsorbed in one or more layers to the grain surface means that two or more dye layers are bound to the vicinity of a silver halide grain. Here, the dyes present in the dispersion medium are excluded. Even in the case where a dye chromophore is connected through a covalent bond to a substance adsorbed to the grain surface, if the linking group is very long and the dye chromophore is present in the dispersion medium, the effect of increasing the light absorption intensity is disadvantageously low.

The "chromophore" as used herein means an atomic group mainly responsible for the absorption band of a molecule as described in *Rikagaku Jiten* (*Physicochemical Dictionary*), pp. 985–986, 4th ed., Iwanami Shoten (1987), and any atomic group, for example, an atomic group having an unsaturated bond such as C═C or N═N, may be used.

Specific examples thereof include the dye chromophores described above as specific examples of the dye chromophore represented by $D_1$ and $D_2$ of formula (I). Among these, preferred is polymethine chromophore.

The dye chromophore is preferably adsorbed to a silver halide grain in 1.5 or more layers, more preferably in 1.7 or more layers, still more preferably in 2 or more layers. The upper limit of the number of adsorbed layers is not particularly limited but is preferably 10 layers or less, more preferably 5 layers or less.

One of the methods for evaluating the multilayer adsorption state is described below. As the amount of dye chromophores adsorbed per unit area based on a single layer saturation coverage is larger, the adsorption can be said greater multilayer adsorption. The single layer saturation coverage is defined as the saturation adsorption amount per unit area attainable, out of the sensitizing dyes added to the silver halide emulsion in the state where dye chromophores are linked through a covalent bond, by a dye having a smallest dye occupation area on the surface of a silver halide grain when individual dyes are not linked.

The dye occupation area can be obtained from an adsorption isotherm showing the relationship between the free dye concentration and the amount of dye adsorbed, and a grain surface area. The adsorption isotherm can be obtained by referring, for example, to A. Herz et al., *Adsorption from Aqueous Solution, Advances in chemistry Series*), No. 17, page 173 (1968).

For determining the amount of the sensitizing dye adsorbed to an emulsion grain, two methods may be used, namely, one is a method of centrifuging an emulsion having adsorbed thereto a dye, separating the emulsion grains from the supernatant aqueous gelatin solution, measuring the spectral absorption of the supernatant to obtain the concentration of non-adsorbed dye, and subtracting the obtained concentration from the amount of dye added, thereby determining the amount of dye adsorbed, and another is a method of drying the emulsion grains precipitated, dissolving a predetermined mass (or weight) of the precipitate in a 1:1 mixed solution of aqueous sodium thiosulfate solution and methanol, and measuring the spectral absorption, thereby determining the amount of dye adsorbed. In the case where a plurality of dyes are used, the amount of individual dyes adsorbed may also be determined using means such as high-performance liquid chromatography. The method of determining the amount of dye adsorbed by quantitating the amount of dye in the supernatant is described, for example, in W. West et al., *Journal of Physical Chemistry*, Vol. 56, page 1054 (1952). However, under the conditions of adding the dye in a large amount, even non-adsorbed dyes may precipitate and exact determination of the amount of dye adsorbed may not be obtained by the method of quantitating the dye concentration in the supernatant. On the other hand, according to the method of dissolving precipitated silver halide grains and measuring the amount of dye adsorbed, the amount of only the dye adsorbed to grains can be exactly determined because the emulsion grain is by far higher in the precipitation rate and the grains can be easily separated from the precipitated dye. This method is most reliable for determining the amount of dye adsorbed.

The amount of a photographically useful compound adsorbed to a grain can also be measured in the same manner as the sensitizing dye, however, since the absorption in the visible region is small, a quantitative method using high performance liquid chromatography is preferred more than the quantitative method by spectral absorption.

According to one example of the method for measuring the surface area of a silver halide grain, a photograph of grains is taken through a transmission electron microscope by a replica process, individual grains are measured on the shape and the size and the surface area is calculated from the obtained values. In this case, the thickness of a tabular grain is calculated from the length of a shadow of the replica. The method for taking a photograph through a transmission electron microscope is described, for example, in *Denshi Kenbikyo Shirvo Gijutsu Shu* (*Electron Microscopic Samble Technologies*), Nippon Denshi Kenbikyo Gakkai Kanto Shibu (compiler), Seibundo Shinko Sha (1970), and P. B. Hirsch et al., *Electron Microscop of Thin Crystals*, Butterworths, London (1965).

Other examples of the measuring method include those described in A. M. Kragin et al., *The Journal of Photographic Science*, Vol. 14, page 185 (1966), J. F. Paddy, *Transactions of the Faraday Society*, Vol. 60, page 1325 (1964), S. Boyer et al., *Journal de Chimie Physique et de Physicochimie Biologique*, Vol. 63, page 1123 (1963), W. West et al., *Journal of Physical Chemistry*, Vol. 56, page 1054 (1952), E. Klein et al., *International Colloquium*, compiled by H. Sauvernier, and *Scientific Photography*, Liege (1959).

The dye occupation area of individual grains can be experimentally determined by the above-described methods, however, the molecular occupation area of sensitizing dyes usually used is present almost in the vicinity of 80 $Å^2$, therefore, the number of layers adsorbed can be roughly estimated by counting the dye occupation area of all dyes as 80 $Å^2$.

In the case of so-called multilayer adsorption where a dye chromophore is adsorbed in one or more layers to the grain surface, spectral sensitization need be generated by the dye not directly adsorbed to the grain surface and for this purpose, an excitation energy or an electron must be transmitted from the dye not directly adsorbed to silver halide to the dye directly adsorbing to a grain. Between the excitation energy transmission and the electron transmission, the excitation energy transmission is preferred.

If the transmission of excitation energy or electron is attained through 10 or more stages, the final transmission efficiency of excitation energy and electron disadvantageously decreases. One example thereof is a polymer dye described in JP-A-2-113239, where the majority of dye chromophores are present in a dispersion medium and the excitation energy must be transmitted through over 10 stages.

In the present invention, the number of dye chromophores per one molecule is preferably from 2 to 3, more preferably 2.

In the case where dye chromophores are adsorbed in multiple layers to a silver halide grain, the dye chromophore directly adsorbing to the silver halide grain, namely, the dye chromophore in the first layer, and the dye chromophore in the second or upper layer may have any reduction potential and any oxidation potential, however, the reduction potential of the dye chromophore in the first layer is preferably more positive than the value obtained by subtracting 0.2 V from the reduction potential of the dye chromophore in the second or upper layer.

The reduction potential and the oxidation potential can be measured by various methods, however, these are preferably measured by phase discrimination-type second harmonic a.c. polarography for obtaining exact values. The method for measuring the potential by phase discrimination-type second harmonic a.c. polarography is described in *Journal of Imaging Science*, Vol. 30, page 27 (1986).

The dye chromophore in the second or upper layer is preferably a light-emitting dye. As for the kind of the light-emitting dye, those having a skeleton structure of dyes used for dye laser are preferred. These are described, for example, in Mitsuo Maeda, *Laser Kenkyu* (*Study of Lasers*), Vol. 8, page 694, page 803 and page 958 (1980), *ibid.*, Vol. 9, page 85 (1981), and F. Schaefer, *Dye Lasers*, Springer (1973).

The absorption maximum wavelength of the dye chromophore in the first layer in a silver halide photographic light-sensitive material is preferably longer than the absorption maximum wavelength of the dye chromophore in the second or upper layer. Furthermore, the light emission of the dye chromphore in the second or upper layer preferably overlaps the absorption of the dye chromophore in the first layer. In addition, the dye chromophore in the first layer preferably forms, a J-association product (i.e., J-aggregate). In order to have absorption and spectral sensitivity in a desired wavelength range, the dye chromophore in the second or upper layer also preferably forms a J-association product.

The excitation energy of the second layer dye chromophore preferably has an energy transfer efficiency to the first layer dye, of 30% or more, more preferably 60% or more, still more preferably 90% or more. The term "excitation energy of the second layer dye chromophore" as used herein means the energy of a dye in the excited state produced as a result of the second layer dye chromophore absorbing light energy. When excitation energy of a certain molecule transfers to another molecule, the excitation energy is considered to transfer through excitation electron transfer mechanism, Forster model energy transfer mechanism, Dextor model energy transfer mechanism or the like. Therefore, it is also preferred for the multilayer adsorption system of the present invention to satisfy the conditions for causing an efficient excitation energy transfer achievable by these mechanisms, more preferably to satisfy the conditions for causing Forster model energy transfer mechanism. In order to elevate the efficiency of the Forster model energy transfer, reduction in the refractive index near the surface of an emulsion grain may be also effective.

The efficiency of the energy transfer from the second layer dye chromophore to the first layer dye chromophore can be determined as a spectral sensitization efficiency at the excitation of the second layer dye chromophore/spectral sensitization efficiency at the excitation of the first layer dye chromophore.

The meanings of the terms used in the present invention are described below.

Dye Occupation Area

An occupation area per one dye molecule. This can be experimentally determined from the adsorption isotherm. In the case of a dye when dye chromophores are linked through a covalent bond, the dye occupation area of unlinked individual dyes is used as a base. This is simply 80 $Å^2$.

Single Layer Saturation Coverage

An amount of dye adsorbed per unit grain surface area at the time of single layer saturation covering. A reciprocal of the minimum dye occupation area of a dye among dyes added.

Multilayer Adsorption

This means a state where two or more dye chromophores are stacked on the surface of a silver halide grain. According to one of the methods for evaluating; this, whether the amount of a dye chromophore adsorbed per unit grain surface area is larger than the single layer saturation coverage is determined.

Number of Adsorbed Layer

This means the number of dye chromophores stacked on the surface of a silver halide grain. According to one of the methods for evaluating this, the amount of the dye chromophore adsorbed per unit grain surface area is determined based on the single layer saturation coverage. For example, when a compound in which two dye chromophores are connected through a covalent bond is adsorbed in one layer portion as the compound, this means two-layer adsorption as the dye chromophore.

In the emulsion containing silver halide photographic emulsion grains having a light absorption intensity of 60 or a light absorption intensity of 100 or more, the distance between the shortest wavelength showing 50% of the maximum value Amax of spectral absorption factor by a sensitizing dye and the longest wavelength showing 50% of Amax and the distance between the shortest wavelength showing 50% of the maximum value Smax of spectral sensitivity and the longest wavelength showing 50% of Smax each is preferably 120 nm or less, more preferably 100 nm or less.

The distance between the shortest wavelength showing 80% of Amax and the longest wavelength showing 80% of Amax and the distance between the shortest wavelength showing 80% of Smax and the longest wavelength showing 80% of Smax each is 20 nm or more, preferably 100 nm or less, more preferably 80 nm or less, still more preferably 50 nm or less.

The distance between the shortest wavelength showing 20% of Amax and the longest wavelength showing 20% of Amax and the distance between the shortest wavelength showing and 20% of Smax and the longest wavelength showing 20% of Smax each is preferably 180 nm or less, more preferably 150 nm or less, still more preferably 120 nm or less, most preferably 100 nm or less.

The longest wavelength showing 50% of Amax is preferably from 460 to 510 nm, from 560 nm to 610 nm, or from 640 to 730 nm.

The longest wavelength showing 50% of Smax is preferably from 460 to 510 nm, from 560 nm to 610 nm, or from 640 to 730 nm.

Assuming that the maximum value of spectral absorption factor by the first layer dye chromophore of a silver halide grain is A1max and the maximum value of spectral absorption factor by the dye chromophore of second or upper layer is A2max, A1max and A2max each is preferably in the range from 400 to 500 nm, from 500 to 600 nm, from 600 to 700 nm or from 700 to 1,000 nm.

Even when multilayer adsorption can be realized by using a linked dye, if the second layer dye chromophore is adsorbed in the monomer state, the absorption width and the spectral sensitivity width each sometimes becomes, wider than the desired width. Accordingly, in the present invention, the dye chromophore adsorbed in the second layer preferably forms a J-association product (i.e., a J-aggregate). The J-association product gives a high fluorescence yield and a small Stokes shift and therefore, is preferred for transferring the light energy absorbed by the second layer dye chromophore to the first layer dye chromophore, which are approximated in the light absorption wavelength, using the Forster-type energy transfer.

In the present invention, the dye chromophore of the second or upper layer is a dye chromophore which is bound to a silver halide grain but not adsorbed directly, to the silver halide.

In the present invention, the J-association ;;product formed by the dye chromophore of the second or upper layer is defined to satisfy the condition such that the absorption width in the longer wavelength side of absorption shown by the dye chromophore adsorbed in the second or upper layer is 2 times or less the absorption width in the longer wavelength side of absorption shown by the dye solution in the monomer state lacking in the interaction between dye chromophores. The absorption width in the longer wavelength side as used herein means an energy width between the absorption maximum wavelength and the wavelength being longer than the absorption maximum wavelength and showing absorption as small as ½ of the absorption maximum. It is well known that when a J-association product is formed, the absorption width in the longer wavelength side is generally reduced as compared with the case in the monomer state. When the dye chromophore of the second layer is adsorbed in the monomer state, the absorption width increases to as large as 2 times or more the absorption width in the longer wavelength side of a dye solution in the monomer state because the adsorption site and the adsorption state are not uniform. The J-association product of dye chromophore of the second or upper layer can be defined as above.

The spectral absorption of the dye chromophore adsorbed in the second or upper layer can be determined by subtracting the spectral absorption attributable to the first layer dye chromophore from the entire spectral absorption of the emulsion.

The spectral absorption attributable to the first layer dye can be determined by measuring the absorption spectrum when only the first layer dye moiety in the unlinked state is added.

In the case where multilayer adsorption can be attained by modifying the dye in the unlinked state, the spectral absorption spectrum attributable to the first layer dye can also be measured by adding a dye desorbing agent to the emulsion and thereby desorbing the dye of the second or upper layer.

In the experiment of desorbing a dye in the unlinked state from the grain surface using a dye desorbing agent, the first layer dye is usually desorbed after the dye of the second or upper layer is desorbed. Therefore, by selecting appropriate desorption conditions, the spectral absorption attributable to the first layer dye can be determined and thereby the spectral absorption of the dye of the second or upper layer can be obtained. The method of using a dye desorbing agent is described in Asanuma et al., *Journal of Physical Chemistry B*, Vol. 101, pp. 2149–2153 (1997).

In the present invention, a dye other than the dyes of the present invention may be added, however, the dye of the present invention preferably occupies 50% or more, more preferably 70% or more, most preferably 90% or more, of the total amount of dyes added.

In the present invention, the multilayer adsorption means the state where the amount of dye chromophore adsorbed per unit grain surface area is larger than the single layer saturation coverage, and therefore, when a dye in which two dye chromophores are connected through a covalent bond is adsorbed in the one-layer portion, this means two-layer adsorption.

The emulsion for use in the present invention is preferably sensitized by selenium sensitization. When the sensitizing dye for use in the present invention is used in combination with selenium sensitization, a high-sensitive silver halide photographic light-sensitive material having good latent image storability can be peculiarly provided.

The selenium sensitizer may be a selenium compound disclosed in conventionally known patents. More specifically, the selenium sensitization is usually performed by adding a labile selenium compound and/or a non-labile selenium compound and stirring the emulsion at a high temperature, preferably at 40° C. or more, for a predetermined time period. Preferred examples of the labile selenium compound include the compounds described in JP-B-44-15748, JP-B-43-13489, JP-A-4-25832 and JP-A-4-109240. Specific examples of the labile selenium sensitizer include isoselenocyanates (for example, aliphatic isoselenocyanates such as allyl isocyanate), selenoureas, selenoketones, selenoamides, selenocarboxylic acids (e.g., 2-selenopropionic acid, 2-selenobutyric acid), selenoesters, diacyl selenides (e.g., bis(3-chloro-2,6-dimethoxybenzoyl) selenide), selenophosphates, phosphine selenides and colloidal metal selenium.

Preferred categories of the labile selenium compounds are described above but the present invention is not limited thereto. As for the labile selenium compound as a sensitizer for photographic emulsions, it is generally understood by one skilled in the art that the structure of the compound is not particularly important insofar as the selenium is labile and the organic moiety of the selenium sensitizer molecule plays no part other than to carry selenium and allow the selenium in the labile form to be present in emulsion. In the present invention, labile selenium compounds having such a wide concept are preferably used.

Examples of the non-labile selenium compound which can be used in the present invention include the compounds described in JP-B-46-4553, JP-B-52-34492 and JP-B-52-34491. Specific examples of the non-labile selenium compound include selenious acid, potassium selenocyanate, selenazoles, quaternary salt of selenazoles, diaryl selenide, diaryl diselenide, dialkyl selenide, dialkyl diselenide, 2-selenazolidinedione, 2-selenooxazolidine-thione and derivatives thereof.

Among these selenium compounds, preferred are the compounds represented by formulae (VII) and (VIII) of JP-A-11-15115.

The selenium sensitizer is dissolved in water, a sole organic solvent such as methanol and ethanol, or a mixed solvent thereof, and added at the chemical sensitization, preferably before the initiation of chemical sensitization.

Not only one selenium sensitizer but also two or more of the above-described sensitizers may be used in combination. A combination use of a labile selenium compound and a non-labile selenium compound is preferred.

The amount of the selenium sensitizer added varies depending on the activity of selenium sensitizer used, the kind and size of silver halide, and the temperature and time period of ripening, however, the amount added is preferably $1\times10^{-8}$ mol or more, more preferably from $1\times10^{-7}$ to $5\times10^{-5}$ mol, per mol of silver halide of the emulsion. In the case of using a selenium sensitizer, the chemical ripening temperature is preferably 45° C. or more, more preferably from 50 to 80° C. The pAg and pH may be freely selected. For example, with a pH over a wide range from 4 to 9, the effect of the present invention can be obtained.

The selenium sensitizer is sometimes preferably used in combination with either one or both of sulfur sensitization and noble metal sensitization.

The light-sensitive material of the present invention is sufficient if at least one light-sensitive layer is provided on a support. A typical example thereof is a silver halide photographic light-sensitive material comprising a support having thereon at least one light-sensitive layer consisting of a plurality of silver halide emulsion layers having substantially the same color sensitivity but being different in the light sensitivity. This light-sensitive layer is a unit light-sensitive layer having color sensitivity to any of blue light, green light and red light. In the case of a multilayer silver halide color photographic light-sensitive material, the unit light-sensitive layers are generally arranged in the order of a red-sensitive layer, a green-sensitive layer and a blue-sensitive layer from the support side. However, depending upon the purpose, this arrangement order may be reversed or a layer having different light sensitivity may be interposed between the layers having the same color sensitivity. A light-insensitive layer may also be provided between the above-described silver halide light-sensitive layers or as an uppermost or lowermost layer. This light-insensitive layer may contain a coupler, a DIR compound, a color mixing inhibitor and the like which are described later. The plurality of silver halide emulsion layers constituting each unit light-sensitive layer preferably employ a two-layer structure consisting of high-speed emulsion layer and low-speed emulsion layer by disposing these emulsion layers such that the light sensitivity sequentially becomes lower toward the support as described in German Patent 1,121,470 and British Patent 923,045. It is also possible to provide a low-speed emulsion layer farther from the support and provide a high-speed emulsion layer closer to the support as described in JP-A-57-112751, JP-A-62-200350, JP-A-62-206541 and JP-A-62-206543.

Specific examples of the layer arrangement include, from the remotest side from the support, an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL and an order of BH/BL/GH/GL/RL/RH.

Also, as described in JP-B-55-34932, a layer arrangement of blue-sensitive layer/GH/RH/GL/RL in this order from the remotest side from the support may be employed. Furthermore, as described in JP-A-56-25738 and JP-A-62-63936, a layer arrangement of blue-sensitive layer/GL/RL/GH/RH in this order from the remotest side from the support may also be employed.

Other examples include an arrangement consisting of three layers different in the light sensitivity described in JP-B-49-15495, where a silver halide emulsion layer having highest light sensitivity is provided as an upper layer, a silver halide emulsion layer having light sensitivity lower than that of the upper layer is provided as a medium layer and a silver halide emulsion layer having light sensitivity lower than that of the medium layer is provided as a lower layer so as to sequentially decrease the light sensitivity toward the support. Even in this layer structure consisting of three layers different in the light sensitivity, the layers having the same color sensitivity may be provided in the order of medium-sensitivity emulsion layer/high-speed emulsion layer/low-speed emulsion layer from the remote side from the support, as described in JP-A-59-202464. In addition, the layers may be provided in the order of high-speed emulsion layer/low-speed emulsion layer/medium-sensitivity emulsion layer or low-speed emulsion layer/medium-sensitivity emulsion layer/high-speed emulsion layer. The layer arrangement may be changed as described above also in the case of four or more layers.

In order to improve color reproducibility, a donor layer (CL) having a spectral sensitivity distribution different from that of main light-sensitive layers such as BL, GL and RL and capable of giving an interlayer effect, is preferably provided adjacent to or in the vicinity of a main light-sensitive layer, as described in U.S. Pat. Nos. 4,663,271, 4,705,744 and 4,707,436, JP-A-62-160448 and JP-A-63-89950.

The silver halide for use in the present invention is preferably silver iodobromide, silver iodochloride or silver iodochlorobromide having a silver iodide content of about 30 mol % or less, more preferably silver iodobromide or silver iodochlorobramide having a silver iodide content of about 2 mol % to about 10 mol %.

The silver halide grain in the photographic emulsion may have a regular crystal from such as cubic, octahedral or tetradecahedral form, an irregular crystal form such as spherical or plate form, a crystal defect such as twin, or a composite form of these.

The silver halide may be a fine grain having a grain size of about 0.2 $\mu$m or less or a large-size grain having a projected area diameter up to about 10 $\mu$m, and may be either a polydisperse emulsion or a monodisperse emulsion.

The silver halide photographic emulsion which can be used in the present invention can be prepared according to the method described, for example, in *Research Disclosure* (hereinafter simply referred to as "RD") No. 17643, pp. 22–23, "I. Emulsion Preparation and Types" (December, 1978), *ibid.*, No. 18716, p. 648 (November, 1979), *ibid.*, No. 307105, pp. 863–865 November, 1989), P. Glafkides, *Chemie et Phisique Photographiques*, Paul Montel (1967), G. F. Duffin, *Photographic Emulsion Chemistry*, The Focal Press (1966), and V. L. Zelikman et al., *Making and Coating Photographic Emulsion*, The Focal Press (1964).

The monodisperse emulsions described in U.S. Pat. Nos. 3,574,629 and 3,655,394 and British Patent 1,413,748 are also preferably used.

The silver halide emulsion for use in the present invention is preferably a tabular silver halide grain having adsorbed thereto the sensitizing dye disclosed in the present invention and having a higher surface area/volume ratio. The aspect ratio is preferably 2 or more, more preferably 5 or more, still more preferably 8 or more. The upper limit is not particularly limited but is preferably less than 0.2 $\mu$m, more preferably less than 0.1 $\mu$m, stillmore preferably less than 0.07 $\mu$m.

The term "the aspect ratio is, for example, from 2 to 1,000" as used herein means that silver halide grains having an aspect ratio (equivalent-circle diameter/grain thickness of a silver halide grain) of 2 to 1,000 occupies 50% or more, preferably 70% or more, more preferably 85% or more, of the projected area of all silver halide grains in the emulsion.

The tabular grain can be easily prepared by the methods described in Gutoff, *Photographic Science and Engineering*, Vol. 14, pp. 248–257 (1970), U.S. Pat. Nos. 4,434,226, 4,414,310, 4,433,048 and 4,439,520 and British Patent 2,112,157.

The crystal structure may be homogeneous, may be different in the halogen composition between the interior and the exterior or may have a layer structure. A silver halide having a different composition may be joined by epitaxial junction or the silver halide may be joined with a compound other than silver halide, such as silver rhodanate or lead oxide. Also, a mixture of grains having various crystal forms may be used.

The above-described emulsion may be a surface latent image-type emulsion of forming a latent image mainly on the surface of a grain, an internal latent image-type emulsion of forming a latent image inside a grain, or an emulsion of forming a latent image both on the surface and the inside of a grain, but the emulsion must be a negative type emulsion. The internal latent image-type emulsion may be a core/shell internal latent image-type emulsion described in JP-A-63-264740 and the preparation method of this emulsion is described in JP-A-59-133542. In this emulsion, the thickness of the shell varies depending upon the development processing or the like, but it is preferably from 3 to 40 nm, more preferably from 5 to 20 nm.

The silver halide emulsion is usually subjected to physical ripening, chemical ripening and spectral sensitization before use. The additives used in these steps are described in RD No. 17643, RD No. 18716 and RD No. 307105 and the pertinent portions thereof are summarized in the table set forth later.

The light-sensitive material of the present invention may use a mixture of two or more kinds of emulsions different at least in one property of the light-sensitive silver halide emulsion, such as grain size, grain size distribution, halogen composition, grain shape or sensitivity, in the same layer.

A silver halide grain with the surface being fogged described in U.S. Pat. No. 4,082,553, a silver halide grain with the inside being fogged described in U.S. Pat. No. 4,626,498 and JP-A-59-214852 or a colloidal silver is preferably applied to a light-sensitive silver halide emulsion layer and/or a substantially light-insensitive hydrophilic colloid layer. The term "silver halide grain with the inside or surface being fogged" as used herein means a silver halide grain which can be uniformly (non-imagewise) developed irrespective of an unexposed area or an exposed area of the light-sensitive material. The preparation method of such a grain is described in U.S. Pat. No. 4,626,498 and JP-A-59-214852. The silver halide of forming the inner core of a core/shell type silver halide grain with the inside being fogged may have a different halogen composition. The silver halide with the inside or surface of grain being fogged may be any of silver chloride, silver chlorobromide, silver iodobromide and silver chloroiodobromide. The fogged silver halide grain preferably has an average grain size of 0.01 to 0.75 $\mu$m. more preferably from 0.05 to 0.6 $\mu$m. Although the emulsion may be grains having a regular shape or may be polydisperse, however, the emulsion preferably has monodispersity (an emulsion where at least 95% by weigh or by number of silver halide grains have a grain size within the average grain size ±40%).

In the present invention, a light-insensitive fine grain silver halide is preferably used. The term "light-insensitive fine grain silver halide" as used herein means a silver halide fine grain which is not sensitive to light at the time of imagewise exposure for obtaining a dye image and is substantially not developed at the development process of the dye image. The light-insensitive fine grain silver halide is preferably not fogged previously. The fine grain silver halide has a silver bromide content of 0 to 100 mol % and, if desired, may contain silver chloride and/or silver iodide. The fine grain silver halide preferably contains from 0.5 to 10 mol % of silver iodide. Furthermore, the fine grain silver halide preferably has an average grain size (an average of equivalent-circle diameters of the projected areas) of 0.01 to 0.5 $\mu$m, more preferably from 0.02 to 0.2 $\mu$m.

The fine grain silver halide can be prepared by the same method as those for normal light-sensitive silver halide. The surface of the silver halide grain needs not be optically sensitized and also needs not be spectrally sensitized. However, a well-known stabilizer such as triazole-based compound, azaindene-based compound, benzothiazolium-based compound, mercapto-based compound or zinc compound is preferably added to the fine grain silver halide in advance of the addition to a coating solution. The layer containing fine grain silver halide grains may contain colloidal silver.

The light-sensitive material of the present invention preferably has a coated silver amount of 6.0 g/m$^2$ or less, most preferably 4.5 g/m$^2$ or less.

The photographic additives which can be used in the present invention are also described in RDs and the portions having the pertinent description are shown in the table below.

| Kinds of Additives | RD17643 | RD18716 | RD307105 |
|---|---|---|---|
| 1. Chemical sensitizer | p. 23 | p. 648, right col. | p. 866 |
| 2. Sensitivity increasing agent | | p. 648, right col. | |
| 3. Spectral sensitizer, supersensitizer | pp. 23–24 | p. 649, right col.- p. 649, right col. | pp. 866–868 |
| 4. Brightening agent | p. 24 | p. 647, right col. | p. 868 |
| 5. Light absorbent, filter dye, UV absorbent | pp. 25–26 | p. 649, right col.- p. 650, left col. | p. 873 |
| 6. Binder | p. 26 | p. 651, left col. | pp. 873–874 |
| 7. Plasticizer, lubricant | p. 27 | p. 650, right col. | p. 876 |
| 8. Coating aid, surfactant | pp. 26–27 | p. 650, right col. | pp. 875–876 |
| 9. Antistatic agent | p. 27 | p. 650, right col. | pp. 876–877 |
| 10. Matting agent | | | pp. 878–879 |

Various dye-forming couplers can be used in the light-sensitive material of the present invention and the following couplers are particularly preferred.

Yellow Coupler

Couplers represented by formulae (I) and (II) of EP-A-502424; couplers represented by formulae (1) and (2) (particularly, Y-28 at page 18) of EP-A-513496; couplers represented by formula (I) in claim 1 of EP-A-568037; couplers represented by formula (I) in column 1, lines 45 to 55 of U.S. Pat. No. 5,066,576; couplers represented by formula (I) in paragraph 0008 of JP-A-4-274425; couplers (particularly, D-35 at page 18) described in claim 1 at page 40 of EP-A-498381; couplers represented by formula (Y) at page 4 (particularly, Y-1 (page 17) and Y-54 (page 41)) of EP-A-447969; and couplers represented by formulae (II) to (IV) in column 7, lines 36 to 58 (particularly, II-17, II-19 (column 17) and II-24 (column 19)) of U.S. Pat. No. 4,476,219.

Magenta Coupler

Compounds L-57 (page 11, right lower column), L-68 (page 12, right lower column) and L-77 (page 13, right lower column) of JP-A-3-39737; Compounds A-4-63 (page 134), A-4-73 and A-4-75 (page 139) of EP-A-456257; Compounds M-4, M-6 (page 26) and M-7 (page 27) of EP-A-486965; Compound M-45 (page 19) of EP-A-571959; Compound (M-1) (page 6) of JP-A-5-204106; and Compound M-22 in paragraph 0237 of JP-A-4-362631.

Cyan Coupler

Compounds CX-1, CX-3, CX-4, CX-5, CX-11, CX-12, CX-14 and CX-15 (pages 14 to 16) of JP-A-4-204843; Compounds C-7, C-10 (page 35), C-34, C-35 (page 37), (I-1) and (I-17) (pages 42 and 43) of JP-A-4-43345; couplers represented by formulae (Ia) and (Ib) in claim 1 of JP-A-6-67385.

Polymer Coupler

Compounds P-1 and P-5 (page 11) of JP-A-2-44345.

Preferred examples of the coupler which provides a colored dye having appropriate diffusibility include those described in U.S. Pat No. 4,366,237, British Patent 2,125,570, EP-B-96873 and German Patent 3,234,533.

Coupler for Correcting Unnecessary Absorption of a Colored Dye

Preferred examples of the coupler for correcting unnecessary absorption of a colored dye include yellow colored cyan couplers represented by formulae (CI), (CII), (CIII) and (CIV) described at page 5 of EP-A-456257 (particularly, Compound YC-86 at page 84), Yellow Colored Magenta Couplers ExM-7 (page 202), EX-1 (page 249) and EX-7 (page 251) described in EP-A-456257, Magenta Colored Cyan Couplers CC-9 (column 8) and CC-13 (column 10) described in U.S. Pat. No. 4,833,069, and colorless masking couplers represented by formula (2) (column 8) of U.S. Pat. No. 4,837,136 and formula (A) in claim 1 of WO92/11575 (particularly, compounds described at pages 36 to 45).;

Examples of the coupler which releases a photographically useful group include the following compounds.

Development Inhibitor-releasing Compound

Compounds represented by formulae (I), (II), (III) and (IV) described at page 11 of EP-A-378236 (particularly, T-101 (page 30), T-104 (page 31), T-113 (page 36), T-131 (page 45), T-144 (page 51) and T-158 (page 58)), compounds represented by formula (I) described at page 7 of EP-A-436938 (particularly, D-45 (page 51)); compounds represented by formula (1) of EP-A-568037 (particularly, Compound (23) (page 11)); and compounds represented by formulae (I), (II) and (III) described at pages 5 and 6 of EP-A-440195 (particularly, Compound I-(1) at page 29).

Bleaching Accelerator-releasing Compound

Compounds represented by formulae (I) and (I') at page 5 of EP-A-310125 (particularly, Compounds (60) and (61) at page 61); and compounds represented by formula (I) in claim 1 of JP-A-6-59411 (particularly, Compound (7) (page 7)).

Ligand-releasing Compound

Compounds represented by LIG-X described in claim 1 of U.S. Pat. No. 4,555,478 (particularly, compounds in column 12, lines 21 to 41).

Leuco Dye-releasing Compound

Compounds 1 to 6 in columns 3 to 8 of U. S. Pat. No. 4,749,641.

Fluorescent Dye-releasing Compound

Compounds represented by COUP-DYE in claim 1 of U.S. Pat. No. 4,774,181 (particularly, Compounds 1 to 11 in columns 7 to 10).

Development Accelerator- or Fogging Agent-releasing Compound

Compounds represented by formulae (1), (2) and (3) in column 3 of U.S. Pat. No. 4,656,123 (particularly Compound (I-22) in column 25) and Compound ExZK-2 at page 75, lines 36 to 38 of EP-A-450637.

Compound Which Releases a Group of Becoming Dye First when Released

Compounds represented by formula (I) in claim 1 of U.S. Pat. No. 4,857,447 (particularly, Compounds Y-1 to Y-19 in columns 25 to 36).

Preferred additives other than couplers include the followings.

Dispersion Medium of Oil-soluble Organic Compound

Compounds P-3, P-5, P-16, P-19, P-25, P-30, P-42, P-49, P-54, P-55, P-66, P-81, P-85, P-86 and P-93 of JP-A-62-215272 (pages 140 to 144).

Latex for Impregnation of Oil-soluble Organic Compound

Latexes described in U.S. Pat. No. 4,199,363.

Developing Agent Oxidation Product Scavenger

Compounds represented by formula (I) in column 2, lines 54 to 62 of U.S. Pat. No. 4,978,606 (particularly, Compounds I-(1), I-(2), I-(6) and I-(12) (columns 4 to 5)) and compounds represented by formulae in column 2, lines 5 to 10 of U.S. Pat. No. 4,923,787 (particularly, Compound 1 (column 3))

Stain Inhibitor

Compounds represented by formulae (I) to (III) at page 4, lines 30 to 33 of EP-A-298321 (particularly, Compounds I-47, 1-72, III-1 and III-27 (pages 24 to 48)).

Discoloration Inhibitor

Compounds A-6, A-7, A-20, A-21, A-23, A-24, A-25, A-26, A-30, A-37, A-40, A-42, A-48, A-63, A-90, A-92, A-94: and A-164 of EP-A-298321 (pages 69 to 118), Compounds II-1 to III-23 in columns 25 to 38 of U.S. Pat. No. 5,122,444 (particularly, Compound III-10), Compounds I-1 to III-4 at pages 8 to 12 of EP-A-471347 (particularly, Compound II-2) and Compounds A-1 to A-48 in columns 32 to 40 of U.S. Pat. No. 5,139,931 (particularly, Compounds A-39 and A-42).

Material Which Reduces Amount Used of Coloration Reinforcing Agent or Color Mixing Inhibitor Compounds I-1 to II-15 at pages 5 to 24 of EP-A-411324 (particularly, Compound I-46).

Formalin Scavenger

Compounds SCV-1 to SCV-28 at pages 24 to 29 of EP-A-477932 (particularly Compound SCV-8).

Hardening Agent

Compounds H-1, H-4, H-6, H-8 and H-14 at page 17 of JP-A-1-214845, compounds (Compounds H-1 to H-54) represented by formulae (VII) to (XII) in columns 13 to 23 of U.S. Pat. No. 4,618,573, compounds (Compounds H-1 to H-76) represented by formula (6) at page 8, right lower column of JP-A-2-214852 (particularly, Compound H-14) and compounds described in claim 1 of U.S. Pat. No. 3,325,287.

Development Inhibitor Precursor

Compounds P-24, P-37 and P-39 of JP-A-62-168139. (pages 6 and 7) and compounds described in claim 1 of U.S. Pat. No. 5,019,492 (particularly, Compounds 28 and 29 in column 7).

Antiseptic, Antifungal

Compounds I-1 to III-43 in columns 3 to 15 of U.S. Pat. No. 4,923,790 (particularly, Compounds II-1, II-9, II-10, II-18 and III-25).

Stabilizer, Antifoggant

Compounds I-1 to (14) in columns 6 to 16 of U.S. Pat. No. 4,923,793 (particularly, Compounds I-1, I-60, (2) and (13)) and Compounds 1 to 65 in columns 25 to 32 of U.S. Pat. No. 4,952,483 (particularly, Compound 36);

Chemical Sensitizer

Triphenylphosphine, selenide and Compound 50 of JP-A-5-40324;

Dye

Compounds a-1 to b-20 at pages 15 to 18 (particularly, Compounds a-1, a-12, a-18, a-27, a-35, a-36 and b-5) and Compounds V-1 to V-23 at pages 27 to 29 of JP-A-3-156450 (particularly, Compound V-1), Compounds F-I-1 to F-II-43 at pages 33 to 55 of EP-A-445627 (particularly, Compounds F-I-11 and F-II-8), Compounds III-1 to III-36 at pages 17 to 28 of EP-A-457153 (particularly, Compounds III-1 and III-3), fine crystal dispersion products of Dye-1 to Dye-124 at pages 8 to 26 of WO88/04794, Compounds 1 to 22 at pages 6 to 11 of EP-A-319999 (particularly, Compound 1), Compounds D-1 to D-87 (pages 3 to 28) represented by formulae (1) to (3) of EP-A-519306, Compounds 1 to 22 (columns 3 to 10) represented by formula (I) of U.S. Pat. No. 4,268,622, and Compounds (1) to (31) (columns 2 to 9) represented by formula (I) of U.S. Pat. No. 4,923,788.

UV Absorbent

Compounds (18b) to (18r) and Compounds 101 to 427 (pages 6 to 9) represented by formula (1) of JP-A-46-3335, Compounds (3) to (66) (pages 10 to 44) represented by formula (I) and Compounds HBT-1 to HBT-10 (page 14) represented by formula (III), of EP-A-520938, and Compounds (1) to (31) (columns 2 to 9) represented by formula (1) of EP-A-521823.

The present invention can be preferably applied to various color light-sensitive materials such as color negative film for general use or for movie, color reversal film for slide or for television, color paper, color positive film, color reversal paper and color instant film. Furthermore, the present invention is suitably used for a film unit with a lens described in JP-B-2-32615 and JP-B-U-3-39784 (the term "JP-B-U" as used herein means an "examined Japanese utility model publication").

Examples of the black-and-white photographic light-sensitive material include film for general photographing, instant film, X-ray film, film for medical diagnosis and film for printing light-sensitive material.

In the field of film for medical diagnosis and film for printing light-sensitive material, the exposure can be r efficiently performed using a laser image setter or a laser imager.

The technique in this field is described in JP-A-7-287337, JP-A-4-335342, JP-A-5-313289, JP-A-8-122954 and JP-A-8-292512.

Also, the present invention may be used for a heat-developable light-sensitive material. As for the heat-developable light-sensitive material, a material having a light-sensitive layer comprising a binder matrix having dispersed therein a catalytic amount of photocatalyst (e.g., silver halide), a reducing agent, a reducible silver salt (e.g., organic silver salt) and, if desired, a color control agent for controlling the color of silver, is known. Examples thereof include those described in U.S. Pat. Nos. 3,152,904, 3,457,075, 2,910,377 and U.S. Pat. No. 4,500,626, JP-B-43-4924, JP-A-11-24200, JP-A-11-24201, JP-A-11-30832, JP-A-11-84574, JP-A-11-65021, JP-A-11-109547, JP-A-11-125880, JP-A-11-129629, JP-A-11-133536 to JP-A-11-133539, JP-A-11-133542, JP-A-11-133543, JP-A-11-223898, JP-A-11-352627, JP-A-6-130607, JP-A-6-332134, JP-A-6-332136, JP-A-6-347970, JP-A-7-261354 and JP-A-2001-281785.

Examples of the support which can be appropriately used in the present invention include those described in RD No. 17643, page 28, *ibid.*, No. 18716, from page 647,: right column to page 648, left column and *ibid.*, No. 307105, page 879.

In the light-sensitive material of the present invention, the total thickness of all hydrophilic colloid layers on the side having emulsion layers is preferably 28 μm or less, more preferably 23 μm or less, still more preferably 18 μm or less and particularly preferably 16 μm or less. The layer swelling speed $T_{1/2}$ is preferably 30 seconds or less, more preferably 20 seconds or less. $T_{1/2}$ is defined as the time required for the layer thickness to reach a half (½) of a saturation layer thickness, which corresponds to 90% of the maximum swollen thickness achieved on processing with a color developer at 30° C. for 3 minutes and 15 seconds. The layer thickness means a layer thickness determined at 25° C. and a relative humidity of 55% under humidity conditioning (2 days). $T_{1/2}$ can be measured by means of a swellometer of the type described in A. Green et. al., *Photogr. Sci. Eng.*, Vol. 19, 2, pp. 124–129. The $T_{1/2}$ can be controlled by adding a hardening agent to gelatin as a binder or changing the aging conditions after the coating. The swelling percentage is preferably from 150 to 400%. The swelling percentage can be calculated from the maximum swollen layer thickness under the above-described conditions according to the formula: (maximum swollen layer thickness-layer thickness)/layer thickness.

In the light-sensitive material of the present invention, a hydrophilic colloid layer (called back layer) having a total dry thickness of 2 to 20 μm is preferably provided in the side opposite the side having emulsion layers. This back layer preferably contains al light absorbent, a filter dye, an ultraviolet absorbent, an antistatic agent, a hardening agent, a binder, a plasticizer, a lubricant, a coating aid and a surfactant, which are described above. The back layer preferably has a swelling percentage of 150 to 500%.

The light-sensitive material of the present invention can be developed by a usual method described in RD No:. 17643, pp. 28–29, *ibid.*, No. 18716, page 651, from left to right columns, and *ibid.*, No. 307105, pp. 880–881.

The processing solution for a color negative film, for use in the present invention is described below.

In the color developer for use in the present invention, compounds described in JP-A-4-121739, from page 9, right upper column, line 1 to page 11, left lower column, line 4 may be used. Particularly, in the case of performing a rapid processing, the color developing agent is preferably 2-methyl-4-[N-ethyl-N-(2-hydroxyethyl) amino]aniline, 2-methyl-4-[N-ethyl-N-(3-hydroxypropyl) amino]aniline or 2-methyl-4-[N-ethyl-N-(4-hydroxybutyl)amino]aniline.

The color developing agent is preferably used in a concentration of 0.01 to 0.08 mol, more preferably from 0.015 to 0.06, still more preferably from 0.02 to 0.05 mol, per liter (hereinafter also denoted as "L") of the color developer. In the replenisher for color developer, the color developing agent is preferably contained in a concentration of 1.1 to 3 times, preferably from 1.3 to 2.5 times, the above-described concentration.

As the preservative of the color developer, hydroxylamine can be widely used but in the case where higher preservability is required, a hydroxylamine derivative having a substituent such as an alkyl group, a hydroxylalkyl group, a sulfoalkyl group or a carboxylalkyl group is preferred and specific examples thereof include N,N-di(sulfoethyl) hydroxylamine, monomethylhydroxylamine, dimethylhydroxylamine, monoethylhydroxylamine, diethylhydroxylamine and N,N-di(carboxyethyl)hydroxylamine. Among these, N,N-di(sulfoethyl)hydroxylamine is preferred. This hydroxylamine derivative may be used in combination with hydroxylamine but it is preferred to use one or more of these compounds in place of hydroxylamine.

The preservative is preferably used in a concentration of 0.02 to 0.2 mol/L, more preferably from 0.03 to 0.15 mol/L, still more preferably from 0.04 to 0.1 mol/L. In the replenisher, similarly to the color developing agent, the preservative is preferably contained in a concentration of 1.1 to 3 times the concentration of the mother solution (processing tank solution).

In the color developer, a sulfite is used as the agent for preventing formation of an oxidation product of the color developing agent into tar. The sulfite is preferably used in a concentration of 0.01 to 0.05 mol/L, more preferably from 0.02 to 0.04 mol/L. In the replenisher, the sulfite is preferably used in a concentration of 1. 1 to 3 times the above-described concentration.

The pH of the color developer is preferably from 9.8 to 11.0, more preferably from 10.0 to 10.5. The replenisher is preferably set to a pH from 0.1 to 1.0 higher than the above-described range. For stably maintaining the pH in the above-described range, a known buffer such as carbonate, phosphate, sulfosalicylate or borate is used.

The replenishing amount of color developer is preferably from 80 to 1,300 mL per $m^2$ of the light-sensitive material but from the standpoint of reducing the environmental pollution load, the replenishing amount is preferably lower, specifically, from 80 to 600 mL, more preferably from 80 to 400 mL, per $m^2$ of the light-sensitive material.

The bromide ion concentration in the color developer is usually from 0.01 to 0.06 mol/L, but for the purpose of improving discrimination by suppressing fogging while keeping the sensitivity and at the same time for improving the granularity, the bromide ion concentration is preferably set to 0.015 to 0.03 mol/L. The bromide ion concentration can be adjusted to this range by incorporating bromide ion into the replenisher in such an amount as calculated according to the following formula, however, when C becomes a negative value, bromide ion is preferably not incorporated into the replenisher.

$$C=A-W/V$$

C: bromide ion concentration (mol/L) in replenisher of color developer

A: bromide ion concentration (mol/L) in objective color developer

W: amount (mol) of bromide ion dissolved out from light-sensitive material into color developer when 1 $m^2$ of light-sensitive material is color developed V: replenishing amount (L) of replenisher of color developer per 1 $m^2$ of light-sensitive material Also, for elevating the sensitivity when the replenishing amount is reduced or when the bromide ion concentration is set to a high value, a development accelerator is preferably used, such as pyrazolidones including 1-phenyl-3-pyrazolidone and 1-phenyl-2-methyl-2-hydroxymethyl-3-pyrazolidone, and thioether compounds including 3,6-dithia-1,8-octanediol.

To the processing solution having bleaching ability for use in the present invention, the compounds and the processing conditions described in JP-A-4-125558, from page 4, left lower column, line 16 to page 7, left lower!column, line 6 can be applied.

The bleaching agent preferably has an oxidation-reduction potential of 150 mV or more and specific examples of preferred bleaching agents include those described in JP-A-5-72694 and JP-A-5-173312. In particular, 1,3-diaminopropanetetraacetic acid and a ferric complex salt of Compound 1 as a specific example described at page 17 of JP-A-5-173312 are preferred.

In order to improve the biodegradability of bleaching agent, a ferric complex salt of the compounds described in JP-A-4-251845, JP-A-4-268552, European Patents 588289 and 591934, and JP-A-6-208213 is preferably used as the bleaching agent. The concentration of the bleaching agent is preferably from 0.05 to 0.3 mol per L of the solution having bleaching ability and in particular, for the purpose of reducing the discharge to the environment, the concentration is preferably set to from 0.1 to 0.15 mol/L. In the case where the solution having bleaching ability is a bleaching solution, bromide is preferably incorporated in an amount of from 0.2 to 1 mol/L, more preferably from 0.3 to 0.8 mol/L.

The replenisher of the solution having bleaching ability basically contains the components each in a concentration calculated according to the following formula, whereby the concentrations in the mother solution can be maintained constant.

$$CR=CT\times(V1+V2)/V1+CP$$

CR: concentration of component in replenisher

CT: concentration of component in mother solution (processing tank solution)

CP: concentration of component consumed during processing

V1: replenishing amount (mL) of replenisher having bleaching ability per 1 $m^2$ of light-sensitive material V2 amount (mL) carried over from previous bath by 1 $m^2$ of light-sensitive material In addition, the bleaching solution preferably contains a pH buffer, more preferably a dicarboxylic acid having less odor such as succinic acid, maleic acid, malonic; acid, glutaric acid and adipic acid. A known bleaching accelerator described in JP-A-53-95630, RD No. 17129 and U.S. Pat. No. 3,893,858 is also preferably used.

The bleaching solution is preferably replenished by the bleaching replenisher in an amount of from 50 to 1,000 mL, preferably from 80 to 500 mL, more preferably from 100 to 300 mL, per $m^2$ of the light-sensitive material. Furthermore, the bleaching solution is preferably subjected to aeration.

To the processing solution having fixing ability, the compounds and the processing conditions described in JP-A-4-125558, from page 7, left lower column, line 10 to page 8, right lower column, line 19 can be applied.

In particular, for improving the fixing rate and the preservability, the compounds represented by formulae (I) and (II) of JP-A-6-301169 are preferably incorporated individually or in combination into the processing solution having fixing ability. Also, in view of improvement in the preservability, a sulfinic acid described in JP-A-1-224762 including p-toluene sulfinate is preferably used.

In the solution having bleaching ability or the solution having fixing ability preferably, an ammonium as a cation is preferably used from the standpoint of improving the desilvering property, however, for the purpose of reducing the environmental pollution, ammonia is preferably reduced or not used.

In the steps of bleaching, bleach-fixing and fixing, jet stirring described in JP-A-1-309059 is particularly preferably performed.

The replenishing amount of replenisher in the bleach-fixing or fixing step is from 100 to 1,000 mL, preferably from 150 to 700 mL, more preferably from 200 to 600 mL, per $m^2$ of the light-sensitive material.

In the bleach-fixing or fixing step, a silver recovery device of various types is preferably provided as an in-line or off-line system to recover silver. By providing the device as an in-line system, the silver concentration in the solution can be reduced during the processing, as a ;result, the replenishing amount can be reduced. It is also preferred to recover silver in an off-line system and re-use the residual solution as the replenisher.

The bleach-fixing step or the fixing step can be constituted by a plurality of processing tanks and respective tanks are preferably piped in a cascade manner to provide a multi-stage countercurrent system. In view of the balance with the size of the developing machine, a two-tank cascade construction is generally efficient and the ratio of the processing time in the pre-stage tank to the processing time in the post-stage tank is preferably from 0.5:1 to 1:0.5, more preferably from 0.8:1 to 1:0.8.

For the purpose of improving the preservability, the bleach-fixing solution or the fixing solution preferably contains a free chelating agent not converted into a metal complex and the chelating agent used to this effect is preferably a biodegradable chelating agent described with respect to the bleaching solution.

To the water washing and stabilization steps, the contents described in JP-A-4-125559, from page 12, right lower column, line 6 to page 13, right lower column, line 16 can be preferably applied. In view of conservation of the working environment, it is particularly preferred to use azolylmethylamines described in European Patents 504609 and 519190 or N-methylolazoles described in JP-A-4-362943 in place of formaldehyde or to form a two-equivalent magenta coupler and thereby use a surfactant solution containing no image stabilizer such as formaldehyde.

Furthermore, in order to reduce the dusts attached to the magnetic recording layer coated on the light-sensitive material, a stabilizing solution described in JP-A-6-289559 is preferably used.

From two aspects of ensuring the water washing or stabilizing function and at the same time, reducing waste for the purpose of environmental conservation, the replenishing amount of the washing water or stabilizing solution is preferably from 80 to 1,000 mL, more preferably from 100 to 500 mL, still more preferably from 150 to 300 mL, per 1 $m^2$ of the light-sensitive material. In the processing with the above-described replenishing amount, a known antifungal such as thiabendazole, 1,2-benzoisothiazolin-3-one and 5-chloro-2-methylisothiazolin-3-one, an antibiotic such as gentamicin, and water deionized by an ion exchange resin are preferably used so as to prevent proliferation of bacteria or mold. It is more effective to use deionized water in combination with a zicrobicide or an antibiotic.

The replenishing amount of the solution in the washing water or stabilizing solution tank is preferably reduced by subjecting the solution to reverse osmosis membrane treatment described in JP-A-3-46652, JP-A-3-53246, JP-A-3-55542, JP-A-3-121448 and JP-A-3-126030 and the reverse osmosis membrane used here is preferably a low pressure reverse osmosis membrane.

In the processing of the present invention, compensation for evaporation of the processing solutions disclosed in *JIII Journal of Technical Disclosure*, No. 94–4992 is preferably performed. In particular, the compensation is preferably performed based on the information of temperature and humidity in the environment where the automatic developing machine is installed, according to (formula-1) at page 2 of the publication. The water used for compensating the evaporation is preferably supplied from the replenishing tank of water washing and in this case, deionized water is preferably used as the replenishing water for water washing.

The processing agent for use in the present invention is preferably the processing agent described in *JIII Journal of Technical Disclosure*, from page 3, right column, line 15 to page 4, left column, line 32, and the developing machine used therefor is preferably the film processor described in *ibid.*, page 3, right column, lines 22 to 28.

Specific examples of the processing agent, the automatic developing machine and the evaporation compensation method which are preferably used in practicing the present invention include those described in *JIII Journal of Technical Disclosure*, from page 5, right column, line 11 to page 7, right column, the last line.

The processing agent for use in the present invention may be supplied in any form such as a liquid agent diluted to a concentration on use of the solution or condensed, a granule, a powder, a tablet, a paste or an emulsion. Examples of this processing agent include a liquid, agent housed in a container having low oxygen permeability described in JP-A-63-17453, a vacuum-packaged powder or granule described in JP-A-4-19655 and JP-A-4-230748, a granulate having incorporated thereinto a water-soluble polymer described in JP-A-4-221951, a tablet described in JP-A-51-61837 and JP-A-6-102628, and a pasted processing agent described in Japanese Published Unexamined International Application No. 57-500485, and these all are preferably used. However, in view of convenience on use, a liquid previously prepared to a concentration in the use state is more preferred.

For the container of housing this processing agent, polyethylene, polypropylene, polyvinyl chloride, polyethylene terephthalate and nylon are used as a sole material or a composite material. These materials are selected according to the level of oxygen permeability required. For the solution susceptible to oxidation such as color developer, materials having low oxygen permeability are preferred and more specifically, composite materials of polyethylene terephthalate or polyethylene with nylon are preferred. This material is preferably used for the container to a thickness of 500 to 1,500 $\mu$m so as to give oxygen permeability of $20\times10^5$ $mL/m^2\cdot24$ hrs. Pa or less.

The processing solutions for color reversal film, for use in the present invention are described below.

The processing of a color reversal film is described in detail in *Kochi Gijutsu* (*Known Technique*), No. 6, from page 1, line 5 to page 10, line 5, and from page 15, line 8 to page 24, line 2, issued by Aztec Limited (Apr. 1, 1991), and the contents in the publication all can be preferably employed.

In the processing of a color reversal film, the image stabilizer is incorporated into an adjusting bath or a final bath. The image stabilizer includes formal in, sodium formaldehyde bisulfite and N-methylolazoles, however, in view of the work environment, sodium formaldehyde bisulfite and N-methylolazoles are preferred and among N-methylolazoles, N-methyloltriazole is particularly preferred. The contents on the color developer, the bleaching solution, the fixing solution and the washing water described above with respect to the processing of color negative film can also be preferably applied to the processing of this color reversal film.

Preferred examples of the processing agent for color reversal film, covering the above-described contents include Processing Agent E-6 produced by Eastman Kodak Company and Processing Agent CR-56 produced by Fuji Photo Film Co., Ltd.

The color photographic light-sensitive material of the present invention is suitable also as a negative film for advanced photo system (hereinafter referred to as, an AP system) and examples thereof include NEXIA A, NEXIA F and NEXA H (ISO 200, 100 and 400, respectively) (all manufactured by Fuji Photo Film Co., Ltd., hereinafter referred to as Fuji Film) obtained by processing a film into an AP system format and housing it in a cartridge exclusive to the system. This cartridge film for AP system is loaded into a camera for AP system such as Epion Series (e.g., Epion 300Z) manufactured by Fuji Film. The color photographic light-sensitive material of the present invention is also suitable as a film with a lens such as Fuji Color "Utsurundesu" Super Slim manufactured by Fuji Film Co., Ltd.

The thus- photographed film is subjected to printing through the following steps at the mini-lab. system:

(1) receipt (receipt of exposed cartridge film from users);

(2) detaching step (film is transferred from cartridge to intermediate cartridge for development step);

(3) film development;

(4) reattaching step (return developed negative film into original cartridge);

(5) printing (C/H/P3-type print and index print are continuously and automatically printed on a color paper (preferably on Super FA8 produced by Fuji Film)); and.

(6) check and forwarding (cartridge and index print are checked by the ID number and forwarded together with the print).

Preferred examples of this system include Fuji Film Mini-Lab Champion Super FA-298/F-278/FA-258/FA-238 and Fuji Film Digital Lab System Frontier.

Examples of the film processor for the Mini-Lab Champion include FP922AL/FP562B/FP562B, AL/FP362B/FP362B, and AL, and the recommendable processing chemical therefor is Fuji Color Just It CN-16L and CN-16Q. Examples of the printer processor include PP3008AR/PP3008A/PP1828AR/PP1828A/PP1258AR/PP1258A/PP728AR/PP728A, and the recommendable processing chemical therefor is Fuji Color Just It CP-47L and CP-40FAII. In the Frontier system, a scanner & image processor SP-1000 and a laser printer & paper processor LP-1000P or a laser printer LP-1000W are used. The detacher used in the detaching step and the reattacher used in the reattaching step are preferably DT200/DT100 and AT200/AT100, respectively, manufactured by Fuji Film.

The AP system can also be enjoyed by a photo joy system including digital image work station Aladdin 1000 manufactured by Fuji Film. For example, a developed AP system cartridge film is directly loaded into Aladdin 1000 or the image information on negative film, positive film or print is input using a 35-mm film scanner FE-550 or a flat head scanner PE-550 and the obtained digital image data can be easily worked and edited. The data can be output as a print using digital color printer NC-550AL according to a light fixing type heat-sensitive color printing system, using Pictrography 3000 according to a laser exposure heat development transfer system, or using existing lab equipment through a film recorder. Furthermore, Aladdin 100 can output the digital information directly into a floppy disk or Zip disk or into a CD-R through a CD writer.

On the other hand, at homes, the photograph can be enjoyed on TV merely by loading the developed AP system cartridge film into Photo Player AP-1 manufactured by Fuji Film. When Photo Scanner AS-1 manufactured by Fuji Film is loaded, the image information can be continuously taken in at a high rate into a personal computer. For inputting a film, a print or a stereoscopic material into a personal computer, Photo Vision FV-10/PV-5 manufactured by Fuji Film can be used. The image information recorded on a floppy disk, a Zip disk, a CD-R or a hard disk can be variously worked and enjoyed on a personal computer using Application Soft Photo Factory manufactured by Fuji Film. For outputting a high-quality image print from the personal computer, a digital color printer NC-2/NC-2D employing a photo-fixing type heat-sensitive color print system, manufactured by Fuji Film, is suitably used.

For housing a developed AP system cartridge film, Fuji Color Pocket Album AP-5 Pop L, AP-1 Pop L, AP-1 Pop KG and Cartridge File 16 are preferably used.

The present invention will be described in greater detail below by referring to Examples, however, the present invention should not be construed as being limited thereto.

EXAMPLE 1

Preparation of Silver Bromide Octahedral Emulsion (Emulsion A) and Silver Bromide Tabular Emulsions (Emulsion B and Emulsion c)

To a reactor, 1,000 ml of water, 25 g of deionized ossein gelatin, 15 ml of an aqueous 50% $NH_4NO_3$ solution and 7.5 ml of an aqueous 25% $NH_3$ solution were added. The mixture was kept at 50° C. and thoroughly stirred and thereto, 750 ml of an aqueous 1N silver nitrate solution and 1 mol/L of an aqueous potassium bromide solution were added over 50 minutes. During the reaction, the silver potential was kept at −40 mV. The silver bromide grain obtained was octahedral and had an equivalent-sphere diameter of 0.846±0.036 μm.

The temperature of the obtained emulsion was lowered, a copolymer of isobutene and monosodium maleate was added as a coagulant and the emulsion was desalted by the precipitation washing. Subsequently, 95 g of deionized ossein gelatin and 430 ml of water were added to adjust the pH and the pAg at 50° C. to 6.5 and 8.3, respectively. After adding potassium thiocyanate, chloroauric acid and sodium thiosulfate to give optimal sensitivity, the emulsion was ripened at 55° C. for 50 minutes. The obtained emulsion was designated as Emulsion A.

In 1.2 liter of water, 6.4 g of potassium bromide and 6.2 g of low molecular weight gelatin having an average molecular weight of 15,000 or less were dissolved and while keeping at 30° C., 8.1 ml of an aqueous 16.4% silver nitrate solution and 7.2 ml of an aqueous 23.5% aqueous potassium bromide solution were added by a double jet method over 10 seconds. Subsequently, an aqueous 11.7% gelatin solution was further added and after elevating the temperature to 75° C., the emulsion was ripened for 40 minutes. Thereafter, 370 ml of an aqueous 32.2% silver nitrate solution and an aqueous 20% potassium bromide solution were added over 10 minutes while keeping the silver potential at −20 mV. After the physical ripening for 1 minute, the temperature was lowered to 35° C. As a result, a monodisperse pure silver bromide tabular emulsion (specific gravity: 1.15) having an average projected area diameter of 2.32 μm, a thickness of 0.09 μm (aspect ratio: 25.8) and a variation coefficient in diameter of 15.1% was obtained. After this, the soluble salts were removed by a coagulating precipitation method. While again keeping the temperature at 40° C., 45.6 g of gelatin, 10 ml of an aqueous sodium hydroxide solution in a concentration of 1 mol/L, 167 ml of water and 1.66 ml of 35% phenoxy ethanol were added and the pAg and the. pH were adjusted to 8.3 to 6.20, respectively. After adding potassium thiocyanate, chloroauric acid and sodium thiosulfate to give optimal sensitivity, this emulsion was ripened at 55° C. for 50 minutes. The obtained emulsion was designated as Emulsion B.

Also, an emulsion was prepared by performing the chemical sensitization using potassium thiocyanate, chloroauric acid, pentafluorophenyl-diphenylphosphine selenide and sodium thiosulfate in place of potassium thiocyanate, chloroauric acid and sodium thiosulfate, and the obtained emulsion was designated as Emulsion C.

Assuming that the dye occupation area is 80 $Å^2$, the single layer saturation coverage of Emulsion A was $5.4\times10^{-4}$ mol/mol-Ag and the single layer saturation coverage of Emulsions B and C was $1.42\times10^{-3}$ mol/mol-Ag.

While keeping each of the thus-obtained emulsions at 50° C., a dye shown in Table 1 was added, followed by stirring for 60 minutes.

A gelatin hardening agent and a coating aid were added to the emulsions obtained and each emulsion was coated on a cellulose acetate film support simultaneously with the gelatin protective layer to have a coated silver amount of 3.0 g-Ag/$m^2$. Each film obtained was exposed to a tungsten bulb (color temperature: 2854 K) for 1 second through a continuous wedge color filter. The irradiation, on the samples was performed while cutting light of 400 nm or less by using a color filter Fuji Gelatin Filter SC-40 (manufactured by Fuji Photo Film Co., Ltd.) for minus blue exposure, capable of exciting the, dye side. Each exposed sample was developed with the following surface developer MAA-1 at 20° C. for 10 minutes. Thereafter, the samples each was subjected to fixing shown below and further to water washing and drying treatment.

| Surface Developer MAA-1: | |
|---|---|
| Metol | 2.5 g |
| L-Ascorbic acid | 10 g |
| Nabox (produced by Fuji Photo Film Co., Ltd.) | 35 g |
| Potassium bromide | 1 g |
| Water to make | 1 liter |
| pH | 9.8 |
| Formulation of Fixing Solution: | |
| Ammonium thiosulfate | 170 g |
| Sodium sulfite (anhydrous) | 15 g |
| Boric acid | 7 g |
| Glacial acetic acid | 15 ml |
| Potassium alum | 20 g |
| Ethylenediaminetetraacetic acid | 0.1 g |
| Tartaric acid | 3.5 g |
| Water to make | 1 liter |

Each film subjected to development and other processing treatments was measured on the optical density by Fuji Automatic Densitometer. The sensitivity is a relative value shown by a reciprocal of light amount necessary for giving an optical density of fog+0.2. Samples 11 to 17 are shown by a relative value to the sensitivity as 100 of Sample 11, Samples 18 and 19 are shown by a relative value to the sensitivity as 100 of Sample 18, Samples 20 and 21 are shown by a relative value to the sensitivity as 100 of Sample 20, and Samples 22 to 27 are shown by a relative value to the sensitivity as 100 of Sample 22.

The amount of dye adsorbed was determined as follows. Each liquid emulsion obtained was centrifuged at 10,000 rpm for 10 minutes, the precipitate was freeze-dried, and 25 ml of an aqueous 25% sodium thiosulfate solution and methanol were added to 0.05 g of the precipitate to make 50 ml. The resulting solution was analyzed by high-performance,liquid chromatography and the dye density was determined by quantitation. From the thus-obtained amount of dye adsorbed and the single layer saturation coverage, the number of dye layers adsorbed was determined. The number of dye layers adsorbed is shown here in terms of the number of dye chromophore layers adsorbed. That is, when the number of layers adsorbed of a linked dye having two dye chromophores is 1, the number of dye chromophore layers adsorbed becomes 2.

The light absorption intensity per unit area was measured as follows. The emulsions obtained each was thinly coated on a slide glass and the transmission spectrum and reflection spectrum of individual grains were determined using a microspectrophotometer MSP65 manufactured by Karl Zweiss K.K. by the following method to determine the absorption spectrum. For the reference of transmission spectrum, the area where grains were not present was used, and for the reference of reflection spectrum, the value obtained by measuring silicon carbide of which reflectance is known was used. The measured area is a circular aperture part having a diameter of 1 $\mu$m. After adjusting the position not to allow the aperture part to overlap the contour of a grain, the transmission spectrum and the reflection spectrum were measured in the wave number region from 10,000 $cm^{-1}$ (1,000 nm) to 28,000 $cm^{-1}$ (357 nm). The absorption spectrum was determined from the absorption factor A which is 1—T (transmittance)—R (reflectance). Using the absorption factor A' obtained by subtracting the absorption of silver halide, -Log(1-A') was integrated with respect to the wave number ($cm^{-1}$) and the value obtained was halved and used as a light absorption intensity per unit area. The integration range is from 10,000 to 28,000 $cm^{-1}$. At this time, the light source used was a tungsten lamp and the light source voltage was 8 V. In order to minimize the damage of dye due to the light irradiation, a monochromator in the primary side was used and the wavelength distance and the slit width were set to 2 nm and 2.5 nm, respectively. The absorption spectrum and the light absorption intensity were determined on 200 grains and the average thereof was employed. Samples 11 to 21 are shown by a relative value to the light absorption intensity as 1 of Sa 11 and Samples 22 to 27 are shown by a relative value to the absorption intensity as 1 of Sample 22. The light absorption intensity of Sample 11 was 56 and the light absorption intensity of Sample 22 was 96.

TABLE 1

| Sample | Dye | Emulsion | Fresh Sensitivity | Number of Dye Chromophore Adsorbed | Light Absorption Intensity | Remarks |
|---|---|---|---|---|---|---|
| 11 | SS-1 | C | 100 (control) | 0.98 | 1 (control) | Comparison |
| 12 | SS-2 | C | 2 | 0.02 | 0.03 | " |
| 13 | SS-1:SS-2 = 1:1 | C | 95 | 0.96 | 0.97 | Comparison |

TABLE 1-continued

| Sample | Dye | Emulsion | Fresh Sensitivity | Number of Dye Chromophore Adsorbed | Light Absorption Intensity | Remarks |
|---|---|---|---|---|---|---|
| 14 | (2) | C | 198 | 1.98 | 1.97 | Invention |
| 15 | (1) | C | 196 | 1.96 | 1.96 | " |
| 16 | (7) | C | 196 | 1.97 | 1.95 | " |
| 17 | (8) | C | 185 | 1.83 | 1.85 | " |
| 18 | SS-1 | B | 100 (control) | 0.98 | 1 | Comparison |
| 19 | (2) | B | 190 | 1.95 | 1.90 | Invention |
| 20 | SS-1 | A | 100 (control) | 0.98 | 1 | Comparison |
| 21 | (2) | A | 185 | 1.95 | 1.88 | Invention |
| 22 | SS-3 | C | 100 (control) | 0.96 | 1 (control) | Comparison |
| 23 | SS-3 | C | 95 | 0.96 | 1 | " |
| 24 | (3) | C | 190 | 1.85 | 1.90 | Invention |
| 25 | (4) | C | 190 | 1.86 | 1.91 | " |
| 26 | (5) | C | 189 | 1.84 | 1.89 | " |
| 27 | (6) | C | 193 | 1.93 | 1.94 | " |

Amount of dye added:
Samples 11, 12, 14 to 19, 22 and 24 to 27: $1.48 \times 10^{-3}$ mol/mol-Ag
Samples 13 and 23: $2.96 \times 10^{-3}$ mol/mol-Ag
Samples 20 and 21: $5.45 \times 10^{-4}$ mol/mol-Ag

SS-1

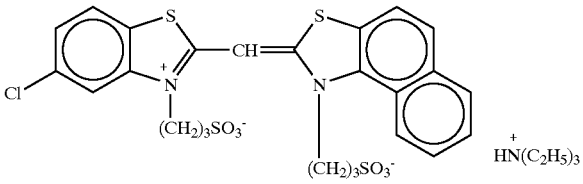

SS-2

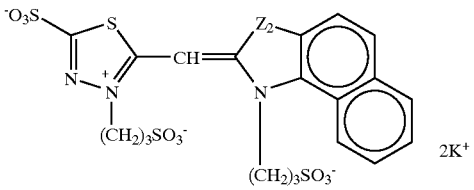

SS-3

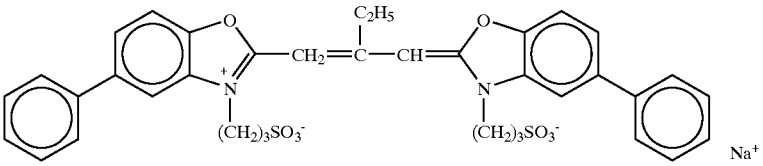

It is seen from Table 1 that samples using the dye of the present invention are excellent by exhibiting high sensitivity as compared with comparative samples. It is also seen that in the case of the dyes of the present invention, the number of dye chromophore layers adsorbed is in excess of 1 and the light absorption intensity is high. These effects are particularly remarkable when the methine dye chromophore containing a basic nucleus comprising a monocyclic heterocyclic ring has an acid radical.

Furthermore, as apparent from the comparison among Samples 11, 14 and 18 and among Samples 19, 20 and 21, the effect of giving high sensitivity is more remarkable in the case of tabular grains. Also, the effect is more remarkable with emulsions subjected to selenium sensitization.

In Sample 27 of the present invention, the distance between wavelengths showing 50% of Amax and the distance between wavelengths showing 50% of Smax are small and this reveals that the absorption distribution and the spectral sensitivity distribution are narrow on the whole. In this sample, the first layer dye chromophore and the second layer dye chromophore both formed a J-association product (i.e., a J-aggregate).

When the percentage of energy transferred to the first layer dye chromophore out of the excitation energy of the excited second layer dye chromophore is estimated from the ratio of the relative quantum yield in the spectral sensitization at an absorption maximum wavelength of the second layer dye chromophore to the relative quantum yield only of the first layer dye chromophore, Samples of the present invention all had an energy transfer percentage of 80% or more.

EXAMPLE 2

Preparation of Seed Emulsion 1,164 ml of an aqueous solution containing 0.017 g of KBr and 0.4 g of oxidation treated gelatin having an average molecular weight of 20,000 was kept at 35° C. and stirred. Thereto, an aqueous $AgNO_3$ (1.6 g) solution, an aqueous KBr solution and an aqueous solution of oxidation treated gelatin (2.1 g) having an average molecular weight of 20,000 were added by a triple jet method over 48 seconds. At this time, the silver potential was kept at 13 mV to the saturated calomel electrode. Thereafter, an aqueous KBr solution was added to make the silver potential to −66 mV and then the temperature was elevated to 60° C. After adding 21 g of succinated gelatin having an average molecular weight of 100,000, an aqueous NaCl (5.1 g) solution was added. Furthermore, an aqueous $AgNO_3$ (206.3 g) solution and an aqueous KBr solution were added by a double jet method while accelerating the flow rate over 61 minutes. At this time, the silver potential was kept at −44 mV, to the saturated calomel electrode. After desalting, succinated gelatin having an average molecular weight of 100,000 was added and the pH and the pAg were adjusted at 40° C. to 5.8 and 8.8, respectively. Thus, a seed emulsion was prepared. This seed emulsion contained 1 mol of Ag and 80 g of gelatin, per 1 kg of the emulsion, and the emulsion grain was a tabular grain having an average equivalent-circle diameter of 1.46 μm, a variation coefficient in the equivalent-circle diameter of 28%, an average thickness of 0.046 μm and an average aspect ratio of 32.

(Formation of Core)

1,200 ml of an aqueous solution containing 134 g of Seed Emulsion a prepared above, 1.9 g of KBr and 22 g of succinated gelatin having an average molecular weight of 100,000 was kept at 75° C. and stirred. An aqueous $AgNO_3$ (43.9 g) solution, an aqueous KBr solution and an aqueous gelatin solution having a molecular weight of 20,000 were mixed in a separate chamber having a magnetic coupling induction-type stirrer described in JP-A-10-43570 immediately before the addition and then added over 25 minutes. At this time, the silver potential was kept at −40 mV to the saturated calomel electrode.

(Formation of First Shell)

After the formation of the core grain above, an aqueous $AgNO_3$ (43.9 g) solution, an aqueous KBr solution and an aqueous gelatin solution having a molecular weight of 20,000 were mixed in the same separate chamber as above immediately before the addition and added over 20 minutes.

At this time, the silver potential was kept at −40 mV to the saturated calomel electrode.

(Formation of Second Shell)

After the formation of the first shell, an aqueous $AgNO_3$ (42.6 g) solution, an aqueous KBr solution and an aqueous gelatin solution having a molecular weight of 20,000 were mixed in the same separate chamber as above immediately before the addition and added over 17 minutes. At this time, the silver potential was kept at −20 mV to the saturated calomel electrode. Thereafter, the temperature was lowered to 55° C.

(Formation of Third Shell)

After the formation of the second shell, the silver potential was adjusted to −55 mV and then, an aqueous $AgNO_3$ (7.1 g) solution, an aqueous KI (6.9 g) solution and an aqueous gelatin solution having a molecular weight of 20,000 were mixed in the same separate chamber as above immediately before the addition and added over 5 minutes.

(Formation of Fourth Shell)

After the formation of the third shell, an aqueous $AgNO_3$ (66.4 g) solution and an aqueous KBr solution were added by a double jet method at a constant flow rate over 30 minutes. On the way of this addition, potassium iridium hexachloride and yellow prussiate of potash were added. At this time, the silver potential was kept at 30 mV to the saturated calomel electrode. Water washing was performed in an ordinary manner, gelatin was added and the pH and the pAg were adjusted at 40° C. to 5.8 and 8.8, respectively. The emulsion obtained was designated as Emulsion b. Emulsion b was a tabular grain having an average equivalent-circle diameter of 3.3 μm, a variation coefficient in the equivalent-circle diameter of 21%, an average thickness of 0.090 μm and an average aspect ratio of 37. Furthermore, 70% or more of the entire projected area was occupied by tabular grains having an equivalent-circle diameter of 3.3 μm or more and a thickness of 0.090 μm or less. Assuming that the dye occupation area is 80 $Å^2$, the single layer saturation coverage was $1.45\times10^{-3}$ mol/mol-Ag.

The temperature of Emulsion b was elevated to 5.6° C., a dye shown in Table 2 was added in an amount of $12.0\times10^{-4}$ mol/mol-Ag and then C-1, potassium thiocyanate, chloroauric acid, sodium thiosulfate and N,N-dimethylselenourea were added to optimally perform the chemical sensitization. Thereafter, a dye shown in Table 2 was added in an amount of $2.5\times10^{-4}$ mol/mol-Ag, followed by stirring for 60 minutes. Furthermore, a dye shown in Table 2 was added in an amount of $2.0\times10^{-3}$ mol/mol-Ag, followed by stirring for 60 minutes.

Here, the sensitizing dyes each was used as a solid fine dispersion prepared by the method described in JP-A-11-52507. More specifically, 0.8 parts by weight of sodium nitrate and 3.2 parts by weight of sodium sulfate were dissolved in 43 parts of ion exchanged water and thereto 13 parts by weight of a sensitizing dye was added and dispersed using a dissolver blade at 2,000 rpm for 20 minutes under the condition of 60° C. to obtain a solid dispersion of the sensitizing dye.

The light absorption intensity per unit area, the amount of dye adsorbed and the number of dye chromophore layers adsorbed were evaluated in the same manner as in Example 1. The light absorption intensity of Sample 21 was 57.

A gelatin hardening agent and a coating aid were added to the emulsions obtained and each emulsion was coated on a cellulose acetate film support simultaneously with the gelatin protective layer to have a coated silver amount of 3.0 g-Ag/$m^2$. Each film obtained was exposed to a tungsten bulb (color temperature: 2854 K) for 1 second through a continuous wedge color filter.

The irradiation on the samples was performed while cutting light of 400 nm or less by using a color filter Fuji Gelatin Filter SC-40 (manufactured by Fuji Photo Film Co., Ltd.) for minus blue exposure, so as to excite the dye side. Each exposed sample was developed at 20° C. for 10 minutes using the same surface developer MAA-1, as in Example 1. Thereafter, the samples each was subjected to fixing, water washing and drying treatment.

Each processed film was measured on the optical density by Fuji Automatic Densitometer. The sensitivity is indicated by a reciprocal of light amount necessary for giving an optical density of fog+0.2 and shown by a relative value to the sensitivity as 100 of Sample 21.

The results are shown in Table 2. In Comparative Sample 21, due to only single layer adsorption, the light absorption intensity was small and the sensitivity was low.

On the other hand, Samples of the present invention all had multilayer adsorption, and large light absorption intensity and high sensitivity were revealed.

When the percentage of energy transferred to the first layer dye chromophore out of the excitation energy of the excited second layer dye chromophore is estimated from the ratio of the relative quantum yield in the spectral sensitization at an absorption maximum wavelength of the second layer dye chromophore to the relative quantum yield only of the first layer dye chromophore, Samples of the present invention all had an energy transfer percentage of 80% or more.

TABLE 2

| Sample | Dye | Sensitivity | Number of Dye Chromophore Layer Adsorbed | Light Absorption Intensity | Remarks |
|---|---|---|---|---|---|
| 21 | SS-4 | 100 (control) | 0.96 | 1 (control) | Comparison |
| 22 | (1E) | 188 | 1.84 | 1.90 | Invention |
| 23 | (17) | 192 | 1.87 | 1.94 | " |
| 24 | (19) | 190 | 1.85 | 1.92 | " |
| 25 | (19) | 197 | 1.93 | 1.98 | " |
| 26 | (23) | 196 | 1.92 | 1.97 | " |
| 27 | (24) | 198 | 1.95 | 2.00 | " |

SS-4

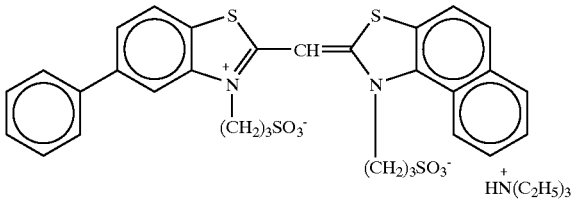

C-5

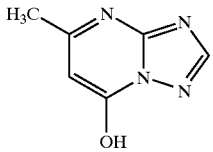

EXAMPLE 3

The evaluation and comparison were performed in the same manner as in Examples 1 and 2 on the system of color negative light-sensitive material of Example 1 of JP-A-11-305369, on the system of color reversal light-sensitive material of Example 1 of JP-A-7-92601 and JP-A-13-160828, on the system of color paper light-sensitive material of Example 1 of JP-A-6-347944, on the system of instant light-sensitive material of Example 1 of JP-A-2000-284442 (Japanese Patent Application No. 11-89801), on the system of printing light-sensitive material of Example 1 of JP-A-8-292512, on the system of X-ray light-sensitive material of Example 1 of JP-A-8-122954, and on the system of heat-developable light-sensitive material of Example 5 of, JP-A-2000-122206, Example 1 of JP-A-2001-281785 and Example 1 of JP-A-6-130607. The results obtained were the same as in Examples 1 and 2.

According to the present invention, a high-sensitive silver halide photographic light-sensitive material can be obtained.

The entitle disclosure of each and every foreign patent application from which the benefit of foreign priority has been claimed in the present application is incorporated herein by reference, as if fully set forth herein.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising at least one dye compound having a plurality of dye chromophores, provided that at least one of said dye chromophores is a methine dye chromophore containing a basic nucleus consisting of a monocyclic heterocyclic ring.

2. The silver halide photographic light-sensitive material as claimed in claim 1, wherein said dye compound is a compound represented by the following formula (I):

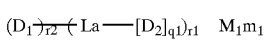

(I)

wherein $D_1$ and $D_2$ each represents a dye chromophore, provided that at least one of $D_1$ and $D_2$ is a methine dye chromophore containing a basic nucleus consisting of a monocyclic heterocyclic ring, La represents a linking group or a single bond, $q_1$, $r_1$ and $r_2$ each represents an integer of 1 to 100, $M_1$ represents an electric charge balancing counter ion and $m_1$ represents a number necessary for neutralizing the electric charge of molecule.

3. The silver halide photographic light-sensitive material as claimed in claim 1, wherein a dye chromophore of the dye compound described in claim 1 is adsorbed to the surface of a silver halide grain to form multiple layers.

4. The silver halide photographic light-sensitive material as claimed in claim 2, wherein a dye chromophore of the dye compound described in claim 2 is adsorbed to the surface of a silver halide grain to form multiple layers.

5. The silver halide photographic light-sensitive material as claimed in claim 1, wherein the methine dye chromophore containing a basic nucleus consisting of a monocyclic heterocyclic ring is represented by the following formula (AI):

(AI)

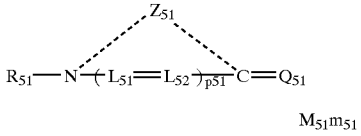

wherein $Z_{51}$ represents an atomic group necessary for forming a monocyclic nitrogen-containing heterocyclic ring, provided that this ring is not condensed by an aromatic ring, $R_{51}$ represents a hydrogen atom, an alkyl group, an aryl group or a heterocyclic group, $Q_{51}$ represents a group necessary for the formation of a methine dye by the compound represented by formula (AI), $L_{51}$ and $L_{52}$ represents a methine group, $p_{51}$ represents 0 or 1, $M_{51}$ represents an electric charge balancing counter ion, and $m_{51}$ represents a number necessary for neutralizing the electric charge of the molecule.

6. The silver halide photographic light-sensitive material as claimed in claim 5, wherein the compound represented by formula (AI) is selected from the compounds represented by the following formula (AII):

(AII)

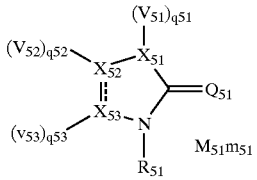

wherein $X_{51}$, $X_{52}$ and $X_{53}$ each represents an oxygen atom, a sulfur atom, a selenium atom, a nitrogen atom or a carbon atom, $V_{51}$, $V_{52}$ and $V_{53}$ each represents a hydrogen atom or a substituent, provided that $V_{51}$, $V_{52}$ and $V_{53}$ are not combined with each other to form an aromatic ring, $q_{51}$, $q_{52}$ and $q_{53}$ each represents 0, 1 or 2, and $Q_{51}$, $R_{51}$, $M_{51}$, and $m_{51}$, have the same meanings as in formula (AI), provided that the bond between $X_{52}$ and $X_{53}$ may be a single bond or a double bond.

7. The silver halide photographic light-sensitive material as claimed in claim 1, wherein the dye chromophore containing a basic nucleus consisting of a monocyclic heterocyclic ring has at least one acid radical.

8. The silver halide photographic light-sensitive material as claimed in claim 1, wherein the basic nucleus consisting of a monocyclic heterocyclic ring has at least one acid radical.

9. The silver halide photographic light-sensitive material as claimed in claim 1, wherein the dye chromophore containing a basic nucleus consisting of a monocyclic heterocyclic ring is present in the second or upper layer.

10. The silver halide photographic light-sensitive material as claimed in claim 1, which contains silver halide grains having a light absorption intensity of 60 or more at the spectral absorption maximum wavelength of less than 500 nm or a light absorption intensity of 100 or more at the spectral absorption maximum wavelength of 500 nm or more.

11. The silver halide photographic light-sensitive material as claimed in claim 1, wherein assuming that the maximum value of spectral absorption factor of the silver halide grain by a sensitizing dye is Amax, the distance between the shortest wavelength showing 50% of Amax and the longest wavelength showing 50% of Amax is 120 nm or less.

12. The silver halide photographic light-sensitive material as claimed in claim 1, wherein assuming that the maximum value of spectral sensitivity of the silver halide grain by a sensitizing dye is Smax, the distance between the shortest wavelength showing 50% of Smax and the longest wavelength showing 50% of Smax is 120 nm or less.

13. The silver halide photographic light-sensitive material as claimed in claim 1, wherein assuming that the maximum value of the spectral absorption factor of the silver halide grain by the dye chromophore in the first layer is A1max, the maximum value of the spectral absorption factor by the dye chromophore in the second or upper layer is A2max, the maximum value of the spectral sensitivity of the silver halide grain by the dye chromophore in the first layer is S1max and the maximum value of the spectral sensitivity by the dye chromophore in the second or upper layer is S2max, each of A1max and A2max or each of S1max and S2max is in the range from 400 to 500 nm, from 500 to 600 nm, from 600 to 700 nm or from 700 to 1,000 nm.

14. The silver halide photographic light-sensitive material as claimed in claim 1, wherein the longest wavelength showing a spectral absorption factor of 50% of Amax or Smax is in the range from 460 to 510 nm, from 560 to 610 nm or from 640 to 730 nm.

15. The silver halide photographic light-sensitive material as claimed in claim 1, wherein in the silver halide grain, the excitation energy of the dye chromophore in the second or upper layer transfers to the dye chromophore in the first layer with an efficiency of 10% or more.

16. The silver halide photographic light-sensitive material as claimed in claim 1, wherein in the silver halide grain, the dye chromophore in the first layer and the dye chromophore in the second or upper layer both show J-band absorption.

17. The silver halide photographic light-sensitive emulsion as claimed in claim 1, wherein in the silver halide photographic light-sensitive emulsion, tabular grains having an aspect ratio of 2 or more are present in a proportion of 50% (area) or more of all silver halide grains in the emulsion.

18. The silver halide photographic light-sensitive emulsion as claimed in claim 1, wherein the silver halide photographic emulsion is subjected to selenium sensitization.

19. The silver halide photographic light-sensitive emulsion as claimed in claim 1, wherein the silver halide grain has a silver halide adsorptive compound other than a sensitizing dye.

20. A silver halide photographic light-sensitive material comprising at least one dye compound having a plurality of dye chromophores, provided that at least one of said dye chromophores is a methine dye chromophore containing a basic nucleus comprising a monocyclic heterocyclic ring.

* * * * *